US011621154B2

(12) United States Patent
Wamsley et al.

(10) Patent No.: US 11,621,154 B2
(45) Date of Patent: Apr. 4, 2023

(54) BENCH-TOP TIME OF FLIGHT MASS SPECTROMETER

(71) Applicant: Micromass UK Limited, Wilmslow (GB)

(72) Inventors: Ruth Wamsley, Rhuddlan/Rhyl (GB); Michael Wilson, Wrexham (GB); Ian Trivett, Cheadle (GB); Peter Carney, Dukinfield (GB); Haydn Murray, Stockport (GB); Paul McIver, Trafford (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 17/057,004

(22) PCT Filed: May 31, 2019

(86) PCT No.: PCT/GB2019/051499

§ 371 (c)(1),
(2) Date: Nov. 19, 2020

(87) PCT Pub. No.: WO2019/229458

PCT Pub. Date: Dec. 5, 2019

(65) Prior Publication Data

US 2021/0210322 A1 Jul. 8, 2021

(30) Foreign Application Priority Data

May 31, 2018 (GB) ..... 1808949

(51) Int. Cl.
*H01J 49/04* (2006.01)
*H01J 49/00* (2006.01)
(Continued)

(52) U.S. Cl.
CPC ..... *H01J 49/0495* (2013.01); *H01J 49/0031* (2013.01); *H01J 49/045* (2013.01);
(Continued)

(58) Field of Classification Search
CPC ..... H01J 49/0495; H01J 49/0031; H01J 49/0422; H01J 49/045; H01J 49/0486;
(Continued)

(56) References Cited

U.S. PATENT DOCUMENTS 2,901,622 A * 8/1959 Baldwin ..... H01J 49/30 250/426
4,314,156 A 2/1982 Kuppermann et al.
(Continued)

FOREIGN PATENT DOCUMENTS

CN 1447031 A 10/2003
CN 103684817 A 3/2014
(Continued)

OTHER PUBLICATIONS

Combined Search and Examination Report under Sections 17 and 18(3), for Application No. GB1907724.7, dated Sep. 25, 2019, 7 pages.

(Continued)

*Primary Examiner* — Wyatt A Stoffa
(74) *Attorney, Agent, or Firm* — Goodwin Procter LLP

(57) ABSTRACT

A mass spectrometer comprising: a vacuum chamber; and an ion inlet assembly for transmitting analyte ions into the vacuum chamber; wherein the spectrometer is configured to operate in a cooling mode in which it selectively controls one or more gas flow to the ion inlet assembly for actively cooling the ion inlet assembly.

15 Claims, 36 Drawing Sheets

(51) Int. Cl.
*H01J 49/06* (2006.01)
*H01J 49/24* (2006.01)
*H01J 49/40* (2006.01)

(52) U.S. Cl.
CPC ..... *H01J 49/0422* (2013.01); *H01J 49/0486* (2013.01); *H01J 49/067* (2013.01); *H01J 49/24* (2013.01); *H01J 49/405* (2013.01)

(58) Field of Classification Search
CPC ..... H01J 49/067; H01J 49/405; H01J 49/24; H01J 49/40
See application file for complete search history.

(56) References Cited

U.S. PATENT DOCUMENTS 4,458,149 A 7/1984 Muga
5,025,391 A 6/1991 Filby et al.
5,272,337 A * 12/1993 Thompson ..... H01J 49/0404 250/288
5,593,123 A 1/1997 Crawford
5,756,994 A * 5/1998 Bajic ..... H01J 49/0445 250/288
5,776,216 A 7/1998 Yang
5,825,025 A 10/1998 Kerley
5,933,335 A 8/1999 Hitchcock et al.
6,013,913 A 1/2000 Hanson
6,049,077 A 4/2000 Franzen
6,106,223 A 8/2000 Leyshon
6,248,998 B1 * 6/2001 Okumoto ..... H01J 49/105 250/288
6,305,975 B1 10/2001 Steiner
6,316,768 B1 11/2001 Rockwood et al.
6,502,999 B1 1/2003 Cohen et al.
6,527,458 B2 3/2003 Kim
6,566,653 B1 5/2003 Gerber et al.
6,570,152 B1 5/2003 Hoyes
6,643,075 B2 11/2003 Wang et al.
6,663,294 B2 12/2003 Crane, Jr. et al.
6,712,528 B2 3/2004 Galeotti et al.
6,772,649 B2 8/2004 Zimmermann et al.
6,792,171 B2 9/2004 Hargis et al.
6,824,314 B2 11/2004 Bendelli et al.
6,835,928 B2 12/2004 Bateman
6,847,036 B1 1/2005 Darling et al.
6,862,378 B2 3/2005 Karnacewicz et al.
6,869,231 B2 3/2005 Chiu et al.
6,877,912 B2 4/2005 Cho et al.
6,888,129 B2 5/2005 Bowdler et al.
6,888,860 B2 5/2005 Shaw
6,903,332 B2 6/2005 Weiss et al.
6,956,205 B2 10/2005 Park
6,977,369 B2 12/2005 Yamaguchi et al.
7,019,285 B2 3/2006 Dresch et al.
7,129,163 B2 10/2006 Sherrer et al.
7,149,389 B2 12/2006 Yoon et al.
7,211,794 B2 5/2007 Malek et al.
7,247,847 B2 7/2007 Webb et al.
7,309,861 B2 12/2007 Brown et al.
7,322,754 B2 1/2008 Wolf et al.
7,359,642 B2 4/2008 Richardson et al.
7,372,021 B2 5/2008 Cotter et al.
7,375,318 B2 5/2008 Kikuma et al.
7,550,722 B2 6/2009 Scheidemann et al.
7,597,488 B2 10/2009 Fisher
7,622,711 B2 11/2009 Wildgoose et al.
7,645,986 B2 1/2010 Kikuma et al.
7,786,435 B2 8/2010 Whitehouse et al.
7,812,309 B2 10/2010 Guevremont et al.
7,820,980 B2 10/2010 Balogh
7,825,374 B2 11/2010 Cotter et al.
7,829,841 B2 11/2010 Bateman et al.
7,888,630 B2 2/2011 Wong
7,893,401 B2 2/2011 Ding
7,919,747 B2 4/2011 Green et al.
7,960,694 B2 6/2011 Hoyes
8,138,119 B2 3/2012 Fischer et al.
8,153,960 B2 4/2012 Giles et al.
8,183,524 B2 5/2012 Kenny et al.
8,227,749 B2 7/2012 Alonso
8,253,096 B2 8/2012 Numata
8,330,101 B2 * 12/2012 Seyfarth ..... H01J 49/107 250/288
8,357,892 B2 1/2013 Suyama et al.
8,426,802 B2 4/2013 Giles et al.
8,507,849 B2 8/2013 Brown
8,513,597 B2 8/2013 Panayi
8,536,523 B2 * 9/2013 Li ..... G01N 27/62 250/288
8,552,367 B2 10/2013 Danel et al.
8,637,810 B2 1/2014 Mukaibatake et al.
8,653,452 B2 2/2014 Albeanu et al.
8,704,172 B2 4/2014 Baykut
8,716,660 B2 5/2014 Green et al.
8,742,339 B2 6/2014 Hoyes
8,822,915 B2 9/2014 Mukaibatake et al.
8,927,928 B2 1/2015 Decker et al.
8,975,578 B2 3/2015 Green et al.
9,012,840 B2 4/2015 Bateman et al.
9,048,075 B1 6/2015 Kodera
9,058,968 B2 6/2015 Danel et al.
9,105,456 B2 8/2015 Jiang et al.
9,184,039 B2 11/2015 Pringle et al.
9,196,469 B2 11/2015 Makarov
9,281,171 B2 3/2016 Bateman et al.
9,287,100 B2 3/2016 Szalay et al.
9,318,309 B2 4/2016 Brown et al.
9,355,832 B2 5/2016 Chiappetta et al.
9,466,472 B2 10/2016 Bateman et al.
9,536,721 B2 1/2017 Berdnikov et al.
9,536,727 B2 1/2017 Satoh
9,552,975 B2 1/2017 Brown et al.
9,564,307 B2 2/2017 Makarov
9,601,323 B2 3/2017 Nishiguchi et al.
9,607,820 B2 3/2017 Bateman et al.
9,754,773 B1 9/2017 Gonzalez et al.
9,768,008 B2 9/2017 Verenchikov
9,786,481 B2 * 10/2017 Gordon ..... F04C 28/00
9,812,308 B2 11/2017 Berdnikov et al.
9,859,106 B2 1/2018 Chiappetta et al.
9,865,444 B2 1/2018 Okumura
9,870,904 B2 1/2018 Covey et al.
9,870,906 B1 1/2018 Quarmby et al.
9,880,129 B2 1/2018 Bateman
9,939,407 B2 4/2018 Giles et al.
9,978,572 B2 5/2018 Giles et al.
9,984,861 B2 5/2018 Giles et al.
9,984,863 B2 5/2018 Verenchikov
10,014,167 B2 7/2018 Zhang et al.
10,020,181 B2 7/2018 Okumura
10,991,565 B2 * 4/2021 Fukui ..... H01J 49/0495
11,075,068 B2 * 7/2021 Vidal-de-Miguel ..... H01J 49/0422
11,175,267 B2 * 11/2021 Jarrold ..... G01N 30/6004
2001/0017351 A1 8/2001 Terakura
2001/0030284 A1 10/2001 Dresch et al.
2002/0100870 A1 8/2002 Whitehouse et al.
2002/0131724 A1 9/2002 Bailey et al.
2003/0003595 A1 1/2003 Amirav
2003/0027354 A1 2/2003 Geli
2003/0050679 A1 3/2003 Park
2003/0193019 A1 10/2003 Nagano et al.
2004/0046116 A1 * 3/2004 Schroeder ..... H01J 49/0086 250/296
2004/0089803 A1 5/2004 Foley
2005/0213353 A1 9/2005 Lys
2006/0076483 A1 4/2006 Scheidemann et al.
2006/0219891 A1 10/2006 Balogh
2006/0226353 A1 * 10/2006 Tang ..... H01J 49/004 250/287
2006/0237663 A1 10/2006 Balogh
2007/0125954 A1 6/2007 Frosien
2007/0164209 A1 7/2007 Balogh
2007/0200060 A1 8/2007 Russ et al.

(56) References Cited

U.S. PATENT DOCUMENTS

| | | | | |
|---|---|---|---|---|
| 2007/0284520 | A1 | 12/2007 | Yamamoto | |
| 2008/0087841 | A1 | 4/2008 | Verbeck et al. | |
| 2008/0149825 | A1 | 6/2008 | Kozlovski et al. | |
| 2008/0272289 | A1 | 11/2008 | Vestal | |
| 2009/0101814 | A1 | 4/2009 | Amirav | |
| 2009/0179148 | A1 | 7/2009 | Yasuda et al. | |
| 2010/0176292 | A1 | 7/2010 | Yamauchi et al. | |
| 2010/0243887 | A1 | 9/2010 | Suyama et al. | |
| 2011/0127416 | A1* | 6/2011 | Campuzano | H01J 49/067 250/282 |
| 2011/0174969 | A1* | 7/2011 | Seyfarth | H01J 49/107 250/288 |
| 2011/0220786 | A1 | 9/2011 | Satoh | |
| 2012/0068064 | A1 | 3/2012 | Numata | |
| 2012/0085901 | A1 | 4/2012 | Gilbert et al. | |
| 2012/0205534 | A1 | 8/2012 | Hunter et al. | |
| 2013/0015342 | A1 | 1/2013 | Steiner et al. | |
| 2013/0183355 | A1 | 7/2013 | Jain et al. | |
| 2014/0097338 | A1 | 4/2014 | Eiler | |
| 2014/0183355 | A1 | 7/2014 | Bartfay-Szabo et al. | |
| 2014/0346345 | A1 | 11/2014 | Makarov | |
| 2014/0367563 | A1 | 12/2014 | Zhong et al. | |
| 2015/0076338 | A1 | 3/2015 | Young et al. | |
| 2015/0123354 | A1 | 5/2015 | Laser et al. | |
| 2015/0228467 | A1 | 8/2015 | Grinfeld et al. | |
| 2015/0263642 | A1 | 9/2015 | Lin et al. | |
| 2015/0270115 | A1 | 9/2015 | Furuhashi | |
| 2015/0323500 | A1 | 11/2015 | Davis et al. | |
| 2016/0086784 | A1* | 3/2016 | Brekenfeld | H01J 49/0422 250/423 R |
| 2016/0148796 | A1 | 5/2016 | Makarov | |
| 2016/0155620 | A1 | 6/2016 | Makarov | |
| 2016/0172179 | A1 | 6/2016 | Deerberg et al. | |
| 2016/0203967 | A1 | 7/2016 | Atkinson et al. | |
| 2016/0247668 | A1 | 8/2016 | Szalay et al. | |
| 2016/0284526 | A1 | 9/2016 | Kenny et al. | |
| 2016/0293395 | A1 | 10/2016 | O'Brien et al. | |
| 2016/0322960 | A1 | 11/2016 | Taylor et al. | |
| 2016/0336158 | A1 | 11/2016 | Kovarik | |
| 2017/0011897 | A1 | 1/2017 | Yamaguchi | |
| 2017/0074283 | A1 | 3/2017 | Manabe | |
| 2017/0082585 | A1 | 3/2017 | DeWitte et al. | |
| 2017/0092477 | A1 | 3/2017 | Giles et al. | |
| 2017/0115383 | A1 | 4/2017 | Fukuo et al. | |
| 2017/0168031 | A1 | 6/2017 | Verenchikov | |
| 2017/0169633 | A1 | 6/2017 | Leung et al. | |
| 2017/0190566 | A1 | 7/2017 | Cramm et al. | |
| 2017/0236699 | A1 | 8/2017 | Ueda et al. | |
| 2017/0287692 | A1 | 10/2017 | Bateman et al. | |
| 2017/0309465 | A1 | 10/2017 | Jarrell | |
| 2017/0372881 | A1 | 12/2017 | Hoyes | |
| 2018/0053640 | A1 | 2/2018 | Kurulugama et al. | |
| 2018/0068840 | A1* | 3/2018 | Newton | H01J 49/145 |
| 2018/0102241 | A1 | 4/2018 | Gordon et al. | |
| 2020/0312647 | A1 | 10/2020 | Imazu et al. | |
| 2020/0411303 | A1* | 12/2020 | Vidal-de-Miguel | H01J 49/165 |
| 2021/0210322 | A1* | 7/2021 | Wamsley | H01J 49/0495 |
| 2021/0285956 | A1* | 9/2021 | Bajic | H01J 49/062 |

FOREIGN PATENT DOCUMENTS

| | | | |
|---|---|---|---|
| CN | 105030148 | A | 11/2015 |
| CN | 205705229 | U | 11/2016 |
| CN | 206955673 | U | 2/2018 |
| DE | 2817665 | A1 | 10/1979 |
| DE | 102018105603 | A1 | 5/2018 |
| EP | 0233784 | A2 | 8/1987 |
| EP | 0317060 | A2 | 5/1989 |
| EP | 0792091 | A1 | 8/1997 |
| EP | 0919726 | A1 | 6/1999 |
| EP | 1137044 | A2 | 9/2001 |
| EP | 1393059 | A1 | 3/2004 |
| EP | 1530229 | A1 | 5/2005 |
| EP | 1597749 | A2 | 11/2005 |
| EP | 1820203 | A2 | 8/2007 |
| EP | 1830386 | A2 | 9/2007 |
| EP | 1933365 | A1 | 6/2008 |
| EP | 1933366 | A1 | 6/2008 |
| EP | 1964153 | A2 | 9/2008 |
| EP | 1166328 | B1 | 11/2008 |
| EP | 1397822 | B1 | 3/2010 |
| EP | 1884980 | B1 | 6/2011 |
| EP | 1817789 | B1 | 11/2011 |
| EP | 2431997 | A2 | 3/2012 |
| EP | 2450941 | A1 | 5/2012 |
| EP | 1825496 | B1 | 6/2012 |
| EP | 2533042 | A1 | 12/2012 |
| EP | 2567397 | A2 | 3/2013 |
| EP | 2587521 | A1 | 5/2013 |
| EP | 2092549 | B1 | 8/2013 |
| EP | 2660850 | A1 | 11/2013 |
| EP | 2633299 | B1 | 9/2014 |
| EP | 2774172 | A2 | 9/2014 |
| EP | 2797105 | A1 | 10/2014 |
| EP | 2798657 | A2 | 11/2014 |
| EP | 2806553 | A2 | 11/2014 |
| EP | 1810314 | B1 | 4/2015 |
| EP | 2866247 | A1 | 4/2015 |
| EP | 1738398 | B1 | 6/2015 |
| EP | 2038913 | B1 | 7/2015 |
| EP | 2913914 | A1 | 9/2015 |
| EP | 3005403 | A2 | 4/2016 |
| EP | 3073509 | A1 | 9/2016 |
| EP | 3084422 | A1 | 10/2016 |
| EP | 3211781 | A1 | 8/2017 |
| EP | 2033208 | B1 | 11/2017 |
| EP | 3244439 | A1 | 11/2017 |
| EP | 1789989 | B1 | 12/2017 |
| EP | 2485243 | B1 | 3/2018 |
| EP | 3404695 | A1 | 11/2018 |
| EP | 1880406 | B1 | 7/2019 |
| GB | 1593998 | A | 7/1981 |
| GB | 2219432 | A | 12/1989 |
| GB | 2329066 | A | 3/1999 |
| GB | 2435712 | A | 9/2007 |
| GB | 2440970 | A | 2/2008 |
| GB | 2443952 | A | 5/2008 |
| GB | 2455171 | A | 6/2009 |
| GB | 2473839 | A | 3/2011 |
| GB | 2486584 | A | 6/2012 |
| GB | 2489975 | A | 10/2012 |
| GB | 2493072 | A | 1/2013 |
| GB | 2515284 | A | 12/2014 |
| GB | 2519853 | A | 5/2015 |
| GB | 2525960 | A | 11/2015 |
| GB | 2530367 | A | 3/2016 |
| GB | 2533168 | A | 6/2016 |
| GB | 2541808 | A | 3/2017 |
| GB | 2552965 | A | 2/2018 |
| JP | S60180322 | A | 9/1985 |
| JP | S63146963 | U | 9/1988 |
| JP | H01121747 | A | 5/1989 |
| JP | H03233850 | A | 10/1991 |
| JP | H10233187 | A | 9/1998 |
| JP | H1125903 | A | 1/1999 |
| JP | H11230087 | A | 8/1999 |
| JP | 2001050944 | A | 2/2001 |
| JP | 2004226313 | A | 8/2004 |
| JP | 2005285543 | A | 10/2005 |
| JP | 2012043672 | A | 3/2012 |
| JP | 2014022075 | A | 2/2014 |
| JP | 2015121406 | A * | 7/2015 |
| JP | 2015121406 | A | 7/2015 |
| WO | 9921212 | A1 | 4/1999 |
| WO | 0185312 | A1 | 11/2001 |
| WO | 02101382 | A1 | 12/2002 |
| WO | 2004077488 | A2 | 9/2004 |
| WO | 2006061625 | A1 | 6/2006 |
| WO | 2006129083 | A2 | 12/2006 |
| WO | 2007071991 | A2 | 6/2007 |
| WO | 2007131146 | A2 | 11/2007 |
| WO | 2008071923 | A2 | 6/2008 |
| WO | 2009037483 | A2 | 3/2009 |

(56) References Cited

FOREIGN PATENT DOCUMENTS

| | | | |
|---|---|---|---|
| WO | 2010064321 | A1 | 6/2010 |
| WO | 2011106640 | A2 | 9/2011 |
| WO | 2011138669 | A2 | 11/2011 |
| WO | 2012058632 | A1 | 5/2012 |
| WO | 2012125318 | A2 | 9/2012 |
| WO | 2012125381 | A1 | 9/2012 |
| WO | 2013039772 | A1 | 3/2013 |
| WO | 2013064842 | A2 | 5/2013 |
| WO | 2013066881 | A2 | 5/2013 |
| WO | 2013098642 | A2 | 7/2013 |
| WO | 2014074822 | A1 | 5/2014 |
| WO | 2014191750 | A1 | 12/2014 |
| WO | 2014194023 | A2 | 12/2014 |
| WO | 2014194172 | A2 | 12/2014 |
| WO | 2015009478 | A1 | 1/2015 |
| WO | 2015040386 | A1 | 3/2015 |
| WO | 2015092501 | A1 | 6/2015 |
| WO | 2015189550 | A1 | 12/2015 |
| WO | 2017060991 | A1 | 4/2017 |
| WO | 2017122276 | A1 | 7/2017 |
| WO | 2018138814 | A1 | 8/2018 |
| WO | 2019224948 | A1 | 11/2019 |

OTHER PUBLICATIONS

Invitation to Pay Additional Fees and, Where Applicable, Protest Fee for International application No. PCT/GB2019/051494, dated Sep. 19, 2019.

Combined Search and Examination Report under Sections 17 and 18(3), dated Sep. 27, 2019, for Application No. GB1907736.1, 6 pages.

Invitation to Pay Additional Fees and, Where Applicable, Protest Fees, for International application No. PCT/GB2019/051499, dated Sep. 4, 2019.

Invitation to Pay Additional Fees and, Where Applicable, Protest Fee, for International Application No. PCT/GB2019/051496, dated Aug. 29, 2019.

Anonymous, "Time-of-flight mass spectrometry", Wikipedia, Apr. 28, 2018 (Apr. 28, 2018), XP055614063, Retrieved from the Internet:URL:https://en.wikipedia.org/w/index.php title=Time-of-flight_mass_spectrometry oldid=838663844 [retrieved on Aug. 20, 2019].

Invitation to Pay Additional Fees and, Where Applicable, Protest Fees for International application No. PCT/GB2019/051497, dated Sep. 2, 2019.

Combined Search and Examination Report under Sections 17 and 18(3) for Application No. GB1907745.2, dated Aug. 13, 2019, 7 pages.

Invitation to Pay Additional Fees and, Where Applicable, Protest Fee, for International application No. PCT/GB2019/051501, dated Jul. 29, 2019, 14 pages.

International Search Report and Written Opinion for International application No. PCT/GB2019/051497, dated Nov. 5, 2019, 19 pages.

International Search Report and Written Opinion for International application No. PCT/GB2019/051503, dated Sep. 25, 2019, 17 pages.

International Search Report and Written Opinion for International application No. PCT/GB2019/051496, dated Oct. 23, 2019, 29 pages.

International Search Report and Written Opinion for International application No. PCT/GB2019/051506, dated Sep. 25, 2019, 14 pages.

International Search Report and Written Opinion for International application No. PCT/GB2019/051494, dated Nov. 18, 2019, 20 pages.

International Search Report and Written Opinion for International application No. PCT/GB2019/051507, dated Oct. 15, 2019, 17 pages.

International Search Report and Written Opinion for International application No. PCT/GB2019/051508, dated Oct. 23, 2019, 16 pages.

International Search Report and Written Opinion for International application No. PCT/GB2019/051499, dated Nov. 5, 2019, 19 pages.

Examination Report under Section 18(3) for Application No. GB1907719.7, dated Jul. 28, 2021, 9 pages.

Parkes, S. SpaceWire User Guide, STAR-Dundee [online] 2012 [retrieved on Aug. 13, 2021]. Retrieved from Internet URL: https://www.star-dundee.com/wp-content/star_uploads/general/SpaceWire-Users-Guide.pdf, 117 pages.

SCIEX, "3200 Series of Instruments System User Guide" [online], published Apr. 2018, available from: https://sciex.com/content/dam/SCIEX/pdf/customer-docs/user-guide/3200-system-user-guide-en.pdf, 241 pages.

Combined Search and Examination Report under Sections 17 and 18(3), for Application No. GB2100898.2, dated Jun. 21, 2021, 7 pages.

Combined Search and Examination Report under Sections 17 and 18(3), for Application No. GB2001530.1, dated Aug. 5, 2020, 7 pages.

Thermo Fisher Scientific, Inc, Feb. 2015, Orbitrap Fusion Hardware Manual [online]. Retrieved from Internet URL: http://www.unitylabservices.eu/content/dam/tfs/ATG/CMD/cmddocuments/oper/oper/ms/lc-ms/sys/Man-80000-97016-Orbitrap-Fusion-Hardware-Man8000097016-A-EN.pdf, 122 pages.

Shion, H., et al., "Meeting the Challenges of Implementing Accurate-Mass Mass Spectrometry for Biotherapeutic Development in Regulated/non-Regulated Environments", 2019 BioPharma Analytical Summit BioAccord Abstract. ASMS MS-in-QC, PowerPoint 24 pages.

International Preliminary Report on Patentability for International application No. PCT/GB2019/051510, dated Dec. 1, 2020, 7 pages.

Examination Report under Section 18(3) for Application No. GB1907739.5, dated Nov. 3, 2020, 5 pages.

Combined Search and Examination Report under Sections 17 and 18(3) for Application No. GB1808932.6, dated Nov. 21, 2018, 4 pages.

Combined Search and Examination Report under Sections 17 and 18(3) for Application No. GB1808890.6, dated Nov. 28, 2018, 7 pages.

Combined Search and Examination Report under Sections 17 and 18(3) for Application No. GB1808912.8, dated Nov. 30, 2018, 10 pages.

Combined Search and Examination Report under Sections 17 and 18(3) for Application No. GB1808942.5, dated Dec. 3, 2018, 7 pages.

Chernushevich, I. V., et al., "An introduction to quadrupole-time-of-flight mass spectrometry", Journal of Mass Spectrometry, 36(8):849-65 (2001) Abstract only.

Chernushevich, I.V., et al., "Charge state separation for protein applications using a quadrupole time-of-flight mass spectrometer", Rapid Communications in Mass Spectrometry 17(13):1416-1424 (2003). Abstract only.

Makarov, A. et al., "Performance evaluation of a hybrid linear ion trap/orbitrap mass spectrometer," Analytical Chemistry, 78(7):2113-20 (2006).

Combined Search and Examination Report under Sections 117 and 18(3) for Application No. GB1808948.2 dated Nov. 21, 2018, 7 pages.

Combined Search and Examination Report under Sections 17 and 18(3) for Application No. GB1808893.0 dated Nov. 27, 2018, 8 pages.

Combined Search and Examination Report under Sections 17 and 18(3) for Application No. GB1808936.7 dated Nov. 20, 2018, 10 pages.

Combined Search and Examination Report under Sections 17 and 18(3) for Application No. GB1808892.2, dated Dec. 3, 2018, 6 pages.

Combined Search and Examination Report under Sections 17 and 18(3) for Applicaton No. GB1808894.8 dated Dec. 3, 2018, 7 pages.

(56) References Cited

OTHER PUBLICATIONS

Combined Search and Examination Report under Sections 17 and 18(3) for Application No. GB1808949.0 dated Oct. 31, 2018, 8 pages.
Combined Search and Examination Report under Sections 17 and 18(3) for Application No. GB1907722.1 dated Jun. 28, 2019, 8 pages.
Combined Search and Examination Report under Sections 17 and 18(3) for Application No. GB1808889.8 dated Nov. 30, 2018, 7 pages.
International Search Report and Written Opinion for International application No. PCT/GB2019/051504, dated Jul. 23, 2019, 11 pages.
Combined Search and Examination Report under Sections 17 and 18(3) for Application No. GB1818003.4, dated May 2, 2019, 6 pages.
Invitation to pay additional fees and, where applicable, protest fee for PCT/GB2019/051508, dated Aug. 28, 2019.
Author unknown, "Operating Manual and Programming Reference, Models RGA100, RGA200, and RGA300 Residual Gas Analyzer," Stanford Research Systems Revision 1.8 (May 2009).
Jungmann, J. H., et al., "An in-vacuum, pixelated detection system for mass spectrometric analysis and imaging of macromolecules," International Journal of Mass Spectrometry, 341-342:34-44 (2013).
Invitation to pay additional fees and, where applicable, protest fee for International application No. PCT/GB2019/051507, dated Aug. 20, 2019, 16 pages.
Yang, C., and Hanley, L., "ChiMS: Open-source instrument control software platform on LabVIEW for imaging/depth profiling mass spectrometers," Review of Scientific Instruments, 86:065106-1 through 065016-7 (2015).
Invitation to pay additional fees and, where applicable, protest fee for International application No. PCT/GB2019/051506, dated Jul. 22, 2019, 13 pages.
Invitation to pay addition al fees and, where applicable, protest fee for PCT/GB2019/051503, dated Jul. 25, 2019, 17 pages.
International Search Report and Written Opinion for International application No. PCT/GB2019/051500, dated Aug. 5, 2019, 9 pages.
Kozlov, B., et al., "Time-of-flight mass spectrometer for investigations of laser ablation," ASMS Conference paper, Dallas, TX (May 1999). [Retrieved from the Internet URL: https//www.researchgate.net/publication/330202298_Time-of-flight_mass_spectrometer_for_investigations_of_laser_ablation]. Abstract.
Shion, H., et al., "Towards Overcoming the Challenges of Implementing Accurate Mass MS for Routine Biotherapeutic Analysis" 2018 ASMS Prototype oa-TOF Abstract HYS Final.
Shion, S., et al., "Towards Overcoming the Challenges of Implementing Accurate Mass MS for Routine Biotherapeutic Analysis" 2018 ASMS Prototype oa-TOF WP699 HYS Final Poster.
Shion, H., et al., "A Fit-for-purpose Accurate Mass MS for Routine Biotherapeutic Analysis", 2018 CASSS Mass Spec HYS Final Poster.
Shion, H., et al., "A Fit-for-purpose Accurate Mass MS for Routine Biotherapeutic Analysis", 2018 CASSS Mass Spec BioTof HYS Final, Abstract.
Shion, H., et al., "Progress Towards Implementing Simple Time-of-flight Accurate Mass MS for Routine Biotherapeutic Analysis", XXII (IMSC) International Mass Spectrometry Conference Florence, Italy (2018) Abstract.
Shion, H., et al., "Progress Towards Implementing Simple Time-of-flight Accurate Mass MS for Routine Biotherapeutic Analysis", XXII International Mass Spectrometry Conference Florence, Italy (2018) poster.
Shion, H., et al., "Meeting the Challenges of Implementing Accurate-Mass Mass Spectrometry for Biotherapeutic Development in Regulated/non-Regulated Environments", 2019 ASMS BioAccord Oral Session PowerPoint.
Shion, H., et al., "Meeting the Challenges of Implementing Accurate-Mass Mass Spectrometry for Biotherapeutic Development in Regulated/non-Regulated Environments", 2019 ASMS BioAccord Abstract.
Shion, H., et al., "Meeting the Challenges of Implementing Accurate-Mass Mass Spectrometry for Biotherapeutic Development in Regulated/non-Regulated Environments" 2019 ATEurope BioAccord, Abstract.
Shion, H., et al., "Meeting the Challenges of Implementing Accurate-Mass Mass Spectrometry for Biotherapeutic Development in Regulated/non-Regulated Environments" 2019 ATEurope BioAccord, Poster.
Shion, H., et al., "Meeting the Challenges of Implementing Accurate-Mass Mass Spectrometry for biotherapeutic Development in Regulated/non-Regulated Environments", 2019 BioPharma Analytical Summit BioAccord, abstract.
Shion, H., et al., "Meeting the Challenges of Implementing Accurate-Mass Mass Spectrometry for Biotherapeutic Development in Regulated/non-Regulated Environments", 2019 Bio Pharma Summit BioAccord, Poster.
Shion, H., "Enabling Routine and Reproducible Biotherapeutic Analysis when Data Integrity Matters", 2019 15th Annual PEGs Boston Waters BioAccord, PowerPoint 29 pages.
Shion, H., "Enabling Routine and Reproducible Biotherapeutic Analysis when Data Integrity Matters", 2019 15th Annual PEGs Boston Waters BioAccord, Abstract.
Shion, H., et al., "Meeting the Challenges of Implementing Accurate-Mass Mass Spectrometry for Biotherapeutic Development in Regulated/non-Regulated Environments", 2019 Pitt Con Bio Accord, Poster.
Shion, H., et al., "Meeting the Challenges of Implementing Accurate-Mass Mass Spectrometry for Biotherapeutic Development in Regulated/non-Regulated Environments", 2019 Pitt Con Bio Accord, Abstract.
Combined Search and Exam Report from IPO for GB Application No. 1907739.5, dated Nov. 27, 2019, 8 pages.
International Search Report and Written Opinion for International application No. PCT/GB2019/051510, dated Aug. 29, 2019, 13 pages.
Combined Search and Exam Report from IPO for GB Application No. 1907735.3, dated Nov. 25, 2019, 7 pages.
Combined S and E Report under Sections 17 and 18(3) for Application No. GB1907734.6, dated Oct. 31, 2019, 7 pages.
International Search Report and Written Opinion for International Application No. PCT/GB2019/051498, dated Nov. 6, 2019, 21 pages.
Combined Search and Examination Report under Sections 17 and 18(3) for Application No. GB1907719.7, dated Nov. 15, 2019, 11 pages.
Author unknown, "Waters Xevo G2-S QTof Operators Overview and Maintenance Guide", Feb. 11, 2013 (Feb. 11, 2013), XP55606374, Retrieved from the Internet: URL:https://www.waters.eom/webassets/cms/support/docs/xevo_g2-s_qtof_715003596rb.pdf [retrieved on Jul. 17, 2019].
International Search Report and Written Opinion for International application No. PCT/GB2019/051501, dated Sep. 25, 2019, 17 pages.
Examination Report under Section 18(3) for Application No. GB1907722.1, dated Oct. 26, 2021, 4 pages.
Examination Report under Section 18(3) for Application No. GB2020743.7, dated Jan. 28, 2022, 6 pages.

* cited by examiner

Fig. 16F

| Control Name | Relative voltage | | | Absolute volatge range (V) | Polarity* |
|---|---|---|---|---|---|
| | Range from (V) | Range (V) | w.r.t. | | |
| Capillary | 0 | 1500 | Ground | 1500 | Same |
| Source offset | 0 | 30 | Step 1 gradient | 400 | Same |
| Step 1 gradient | 0 | 30 | Step 1 offset | 370 | Same |
| Step 1 offset | 0 | 40 | Step 2 offset (cone) | 340 | Same |
| Step 2 gradient | 0 | 40 | Step 2 offset (cone) | 340 | Same |
| Step 2 offset (cone) | 0 | 200 | Aperture 1 | 300 | Same |
| Aperture 1 | 0 | 10 | Ion guide gradient | 100 | Same |
| Ion guide gradient | 0 | 5 | Ion guide offset A | 90 | Same |
| Ion guide offset A | 0 | 5 | Ion guide offset B (entrance) | 85 | Same |
| Ion guide offset B (entrance) | 0 | 80 | Ground | 80 | Same |
| Aperture 2 | 0 | 10 | Ion guide offset (entrance) | 80 | Opposite |
| Aperture 2 trap | 0 | 10 | Ion guide offset (entrance) | 90 | Same |
| Acceleration 1 | 0 | 100 | Ion guide offset (entrance) | 80 | Opposite |
| Acceleration 2 | 0 | 100 | Ion guide offset (entrance) | 80 | Opposite |
| Aperture 3 | 0 | 0 | Ground | 0 | n/a |
| Transport 1 | 0 | 100 | Ion guide offset (entrance) | 80 | Opposite |
| Transport 2 | 0 | 100 | Ion guide offset (entrance) | 85 | Opposite |
| Steering | -5 | 5 | Transport 2 | 85 | Opposite |
| Tube lens | 0 | 0 | Ground | 0 | n/a |
| Entrance plate | 0 | 0 | Ground | 0 | n/a |
| Pusher | 0 | 1100 | Ground | 1000 | Same |
| Pusher offset | -5 | 5 | Ground | 10 | Same |
| Third grid | 0 | 0 | Ground | 0 | n/a |
| Second grid | 0 | 0 | Ground | 0 | n/a |
| Flight tube | 0 | 4500 | Ground | 4500 | Opposite |
| Reflectron grid | 0 | 0 | Ground | 0 | n/a |
| Reflectron | 0 | 1725 | Ground | 1725 | Same |
| Detector | 0 | 4000 | Flight tube | 8500 | Positive |

BENCH-TOP TIME OF FLIGHT MASS SPECTROMETER

CROSS-REFERENCE TO RELATED APPLICATIONS

This application is a U.S. national phase filing claiming the benefit of and priority to International Patent Application No. PCT/GB2019/051499, filed on May 31, 2019, which claims priority from and the benefit of United Kingdom patent application No. 1808949.0 filed on May 31, 2018. The entire contents of these applications are incorporated herein by reference.

FIELD OF THE INVENTION

The present invention relates generally to mass spectrometry and in particular to a small footprint or bench-top Time of Flight ("TOF") mass spectrometer which has particular application in the biopharmaceutical industry.

BACKGROUND

Conventional mass spectrometers which may be used, for example, in the biopharmaceutical industry tend to be relatively complex and have a relatively large footprint.

Scientists in the biopharmaceutical industry need to collect high resolution accurate mass data for their samples in order to provide more comprehensive information than can be obtained using LCUV analysis. Conventionally, this is typically achieved either by running relatively complex mass spectrometry equipment or by outsourcing the analysis to a specialist service.

It is desired to provide a reduced footprint Time of Flight ("TOF") mass spectrometer which may have particular application in the biopharmaceutical industry.

SUMMARY

From an first aspect, the present invention provides a mass spectrometer comprising: a vacuum chamber; an ion inlet assembly for transmitting analyte ions into the vacuum chamber; wherein the spectrometer is configured to operate in a cooling mode in which it selectively controls one or more gas flow to the ion inlet assembly for actively cooling the ion inlet assembly.

Embodiments of the invention provide means for reducing the burn risk associated with performing maintenance on the ion inlet assembly.

The spectrometer may comprise one or more temperature sensor for monitoring a temperature of the ion inlet assembly and/or an ion block in which the ion inlet assembly is mounted; wherein the spectrometer is configured to monitor the temperature sensed by the one or more temperature sensor during the cooling mode and to end the cooling mode when the sensed temperature has decreased to a predetermined temperature.

The predetermined temperature may be set to a temperature corresponding to that at which the ion inlet assembly is deemed safe to be handled by a user, e.g. ≤70° C.; ≤65° C.; ≤60° C.; ≤55° C.; ≤50° C.; ≤45° C.; or ≤40° C.

The spectrometer may comprise an ion source and an ion source heater for heating the ion source, and/or an ion block in which the ion inlet assembly is mounted and an ion block heater for heating the ion block. The spectrometer may be configured to switch off, or reduce electrical power to, the ion source heater and/or ion block heater during the cooling mode.

The spectrometer may be configured to end the cooling mode at a predetermined time after having switched off, or reduced the electrical power to, the ion source heater and/or ion block heater.

The spectrometer may be configured to end the cooling mode by switching off said one or more gas flow to the ion inlet assembly for actively cooling the ion inlet assembly.

The ion inlet assembly may comprise an inner cone having an inner aperture therein for receiving and transmitting the analyte ions to the vacuum chamber, and an outer cone surrounding the inner cone and having an outer aperture therein. The spectrometer may be configured to flow one of said one or more gas flow between said inner and outer cones and through said outer aperture, in said cooling mode, for cooling the inner and outer cones.

The spectrometer may be configured to flow gas through the ion block in which the ion inlet assembly is mounted, through an annular region between the inner and outer cones, and out of the outer orifice in the outer cone.

The spectrometer may comprise an ion source proximate the ion inlet assembly, said ion source comprising a probe having at least one gas conduit for supplying one of said one or more gas flow to the ion inlet assembly, in said cooling mode, for cooling the ion inlet assembly.

The ion source may be a high pressure ion source, such as an atmospheric pressure ionisation (API) ion source, e.g. an ESI ion source.

The probe may comprise a liquid conduit for supplying liquid towards a tip of the probe, and a nebuliser gas conduit for supplying a nebulising gas to the tip of the probe for nebulising the liquid. The spectrometer may be configured to supply one of said one or more gas flows through said nebuliser gas conduit, in said cooling mode, for cooling said ion inlet assembly.

The probe may further comprise a desolvation gas conduit for supplying a desolvation gas to the tip of the probe for desolvating the liquid and a desolvation gas heater for heating the desolvation gas and/or desolvation gas conduit. The spectrometer may be configured, in said cooling mode, to switch off or turn down the desolvation gas heater and supply one of said one or more gas flows through said desolvation gas conduit for cooling said ion inlet assembly.

The liquid may be a solution of analyte in a solvent which may be received by the probe, for example, from an upstream LC device.

The spectrometer may comprise an ion source enclosure mounted over the ion inlet assembly (e.g. over the ion block) such that the probe tip is between the ion source enclosure and the ion inlet assembly.

The spectrometer may be configured to control said one or more gas flow, in said cooling mode, for actively cooling the probe and/or ion source enclosure.

The spectrometer may comprise a gas inlet for receiving pressurised gas from a pressurised gas supply, one or more valve for selectively supplying said pressurised gas from the gas inlet to said ion inlet assembly and/or probe.

The spectrometer may comprise said pressurised gas supply.

The gas may be an inert gas such as nitrogen.

The spectrometer may comprise one or more temperature sensor for monitoring the temperature of the ion inlet assembly and/or an ion block in which the ion inlet assembly is located and/or the probe and/or the source enclosure during the cooling mode. The spectrometer may be configured to monitor the temperature sensed by the one or more temperature sensor during the ion cooling mode and control a user interface or signalling device to signal when the temperature has decreased to a predetermined temperature and/or remains above a predetermined temperature.

The predetermined temperature may be set to a temperature corresponding to that at which the ion inlet assembly and/or ion block and/or probe and/or source enclosure is deemed safe to be handled by a user, e.g. 70° C.; 65° C.; 60° C.; 55° C.; 50° C.; 45° C.; or 40° C.

The spectrometer may comprise an ion source, an access door for accessing the ion source, and a detector for detecting when the door is opened. The spectrometer may be configured to turn off said one or more gas flow in response to the detector detecting that the door has been opened.

This may reduce the risk of the user being exposed to the gas used for cooling, which may present a suffocation risk or other hazard.

The first aspect of the present invention also provides a method comprising:

providing a mass spectrometer as described above: and operating the spectrometer in the cooling mode in which it supplies said one or more gas flow to the ion inlet assembly so as to cool the ion inlet assembly.

The method may comprise dismantling the ion inlet assembly (e.g. removing at least part of the ion inlet assembly from the ion block) after it has been cooled by the one or more gas flow.

From a second aspect the present invention provides a mass spectrometer comprising:

an ion source arranged proximate an upstream end thereof;

a solvent waste conduit having an entrance opening proximate said upstream end and arranged to receive solvent from the ion source, and an exit opening for transmitting said solvent away from the ion source and out of the spectrometer; and an outermost casing forming the external surface of the spectrometer;

wherein the solvent waste conduit passes through the outermost casing at, or proximate, said upstream end of the spectrometer.

The inventors have recognised that the configuration of the solvent waste conduit is important. In the embodiments of the invention, the solvent waste conduit from the ion source passes through the outermost casing of the spectrometer proximate to where the ion source is located. As such, the length of the solvent waste conduit inside the outermost casing may be relatively short, thus reducing the likelihood of a leak from the solvent waste conduit at a location inside of the outermost casing. Furthermore, the relatively short length of the solvent waste conduit inside the casing, and its location at the upstream end, ensures that if it does leak the solvent is less likely to come into contact with electrical components inside the mass spectrometer (e.g. high voltage components), which could potentially present a fire and/or electrocution hazard.

The ion source may be configured to receive a solution of analyte carried in solvent and to desolvate the solution, thereby producing said solvent waste. The ion source also ionises the analyte. For example, the mass spectrometer may comprise an ESI ion source.

The spectrometer may comprise a liquid chromatography separator for supplying the ion source with a solution of analyte carried in solvent.

The spectrometer may comprise a vacuum housing, wherein the ion source is mounted to, or adjacent, a first side of the vacuum housing; and wherein the solvent waste conduit passes into the first side of the vacuum housing, within a wall of the vacuum housing, and back out of the wall of the vacuum housing.

The vacuum housing may house ion-optical components for manipulating ions, such as an ion guide and/or mass analyser.

The solvent waste conduit may exit the wall of the vacuum housing at said first side.

However, it is contemplated that the conduit need not exit the vacuum housing at the first side, but may exit at a second side of the vacuum housing, e.g. that is orthogonal to the first side, as long as it exits proximate the upstream end of the spectrometer.

The portion of the solvent waste conduit extending through the wall of the vacuum housing may be configured such that, in use, solvent waste is drained from the entrance opening towards the exit opening under the effect of gravity.

The solvent waste conduit may therefore extends vertically, with the exit opening arranged lower than the entrance opening. Additionally, or alternatively, the conduit may be pumped to remove the solvent waste from the spectrometer.

The outermost casing may have an aperture through which said solvent waste conduit passes, wherein the aperture may be arranged in a side of the casing that is substantially orthogonal to the first side of the vacuum housing.

The solvent waste conduit may be configured to receive liquid solvent waste from the ion source and pass it to the exit opening.

The spectrometer may comprise an ion source enclosure, wherein the ion source is enclosed between the ion source enclosure and a vacuum chamber, and wherein the entrance opening of the solvent waste conduit is arranged inside of the ion source enclosure.

The entrance opening of the solvent waste conduit may be arranged adjacent, or in, a lowermost internal surface of the ion source enclosure.

The solvent waste conduit may comprise a flexible waste tube having an exit end through which the waste solvent leaves the spectrometer.

The length of the solvent waste conduit arranged inside of the outermost casing may be selected from the group consisting of: ≤1.5 m; ≤1.4 m; ≤1.3 m; ≤1.2 m; ≤1.1 m; ≤1 m; ≤0.9 m; ≤0.8 m; ≤0.7 m; ≤0.6 m; ≤0.5 m; and ≤0.4 m.

The ion source may be an atmospheric pressure ion source. For example, the ion source may be an ESI ion source.

The ion source may be connected to one or more fluidic supply lines configured to supply solvent to the ion source.

The fluidic supply lines may comprise at least one of: a first fluidic supply line connected to an upstream liquid chromatography (LC) separation device; a second fluidic supply line connected to a solvent bottle for receiving a wash solution; and a third fluidic supply line connected to a solvent bottle for receiving a calibrant solution.

The second aspect the present invention also provides a method of mass spectrometry comprising:

providing a spectrometer as described above;

receiving solvent from the ion source in the entrance opening of the solvent waste conduit and transferring the solvent through the solvent waste conduit and out through the outermost casing at, or proximate, the upstream end of the spectrometer.

As used herein, the term "solvent waste" may refer to solvents which have been introduced into the ion source and/or ion source enclosure, and which are not intended for mass analysis. Accordingly the solvent waste comprises solvent which is not be transmitted through the pumping block to components downstream of the pumping block. The solvent waste may comprise solvent from an upstream liquid chromatography (LC) separation device, or may comprise solvents from other sources (such as solvent bottles) that are introduced into the source enclosure as part of a calibration or cleaning routine.

From a third aspect, the present invention provides a mass spectrometer comprising:

an ion source enclosure having a gas inlet and an exhaust;

a gas supply valve for controlling the supply of gas into the gas inlet; and a pressure sensor for determining the pressure in the ion source enclosure or exhaust;

wherein the spectrometer is configured to perform a source pressure test by:

a) opening the gas supply valve for allowing gas to enter the gas inlet;

b) determining the gas pressure in the ion source enclosure or exhaust using the pressure sensor; and then c) closing the gas supply valve, and/or controlling a user interface of the mass spectrometer to signal an alert, in response to the sensed gas pressure being at or above a first predetermined pressure at the end of a first predetermined time period after having opened the gas supply valve.

The spectrometer is configured to determine if the exhaust is blocked, by sensing the pressure in the source enclosure or exhaust whilst gas is being supplied into the ion source enclosure. The spectrometer waits until the end of the first predetermined time period before closing the gas supply valve or alerting the user, if the pressure is above the first predetermined pressure. This avoids false failures of the pressure test, e.g. due to temporary blocking of the exhaust by the presence of residual fluid (such as waste solvent) from previous ion source operation, which may still be draining out of the exhaust. The predetermined time period is set such that at the end of this period it would be expected that all such fluid would have drained out of the exhaust, and that therefore a high pressure at the end of this period is indicative of a genuine problem with the exhaust.

It is to be noted that this is distinguished from pressure tests that indicate a fail state due to a blocked exhaust based on continuous pressure monitoring, since such systems do not wait until the end of a predetermined time period after having opened the gas valve before determining the pressure test has been failed. Rather, such systems simply indicate a failure as soon as the pressure rises above a given value. This cannot account for temporary blocking of the exhaust, such as due to the presence of liquids. Similarly, the timing of the first pressure check in a periodic pressure checking system would not be predetermined in relation to the time that the gas supply valve is opened, and so may indicate a fail too early.

The exhaust may be arranged and configured to drain fluid out of the ion source enclosure. For example, the exhaust may be a solvent waste conduit for draining solvent from the ion source enclosure.

The first predetermined time period may be set to be a value such that any fluid present in the exhaust will have been drained out of the exhaust within said first predetermined time period after having opened the gas supply valve.

The spectrometer may comprise a pressurised gas supply connected to the gas inlet via the gas supply valve.

The first predetermined time period may be T seconds after having opened the gas supply valve, wherein T is selected from: ≥5; ≥10; ≥15; ≥20; ≥25; ≥30; and ≥35.

The alert may indicate the exhaust is blocked.

The ion source enclosure includes an ionisation device for ionising analyte delivered thereto.

The spectrometer may comprise an atmospheric pressure ionisation probe in the ion source enclosure, wherein the probe comprises said gas inlet.

The probe may include a capillary for delivering an analyte solution therethrough and at least one gas channel for nebulising and/or desolvating the analyte solution, wherein the gas inlet is connected to said at least one gas channel. For example, the probe may be an ESI probe.

If, before the end of the first predetermined time period, the sensed gas pressure is between said first predetermined pressure and a higher threshold pressure, then the spectrometer may wait for said first predetermined time period to end before performing step c) above.

If, before the end of the predetermined period, the sensed gas pressure is above the higher threshold pressure then the spectrometer may close the gas supply valve, and/or control the user interface to signal an alert, without waiting until the end of the first predetermined time period.

If, before the end of the first predetermined time period, the sensed gas pressure is below said first predetermined pressure then the spectrometer may determine that the exhaust is not blocked, and/or may not close the gas supply valve and/or may not control the user interface to signal the alert.

The spectrometer may comprise an exhaust valve for selectively closing the exhaust; wherein if, before the end of the first predetermined time period, the sensed gas pressure is below said first predetermined pressure then the spectrometer may maintain the gas supply valve open and closes the exhaust valve.

This enables the spectrometer to check for leaks from the source enclosure other than through the exhaust. For example, the ion source enclosure may be repeatedly mountable and demountable, in a sealing manner, over the ion inlet to the spectrometer and the pressure test may test for leaks from such seals. Additionally, or alternatively, the probe of the ion source may be mountable and demountable, in a sealing manner in the ion source enclosure and the pressure test may test for leaks from such a seal.

The spectrometer may be configured to determine the gas pressure in the ion source enclosure after closing the exhaust valve and to then open the exhaust valve if the sensed gas pressure is at or above a second predetermined pressure.

The spectrometer may determine that there is no unintended gas leak from the ion source enclosure if the sensed gas pressure after closing the exhaust valve is at or above a/the second predetermined pressure. The spectrometer may not therefore control the user interface to signal an alert that there is a gas leak.

The use of the second predetermined time delay helps prevent false failures of the test, e.g. due to trapped liquid being present in the system.

The gas supply valve may also be closed if the sensed gas pressure is at or above the second predetermined pressure.

The spectrometer may then control the user interface to signal that the pressure test has been passed.

The spectrometer may be configured to close the gas supply valve, and/or control a user interface of the mass spectrometer to signal an alert, in response to the sensed gas pressure being below a, or the, second predetermined pressure after a second predetermined time period after having closed the exhaust valve.

The alert may indicate that there is possibly a gas leak from the source enclosure, or that there is a gas leak from the source enclosure.

The second predetermined time period may be selected from: ≥5; ≥10; ≥15; ≥20; ≥25; ≥30; and ≥35.

If, before the end of the second predetermined time period, the sensed gas pressure is below the second predetermined gas pressure then the spectrometer may maintain the gas supply valve open, and/or control the user interface to signal an alert.

The alert may indicate that there is possibly a gas leak from the source enclosure.

The alert may be suppressed for a third predetermined time period, shorter than the second predetermined time period, after having closed the exhaust valve. This prevents the alert being indicated before there has been enough time for pressure to build up in the ion source enclosure.

The third predetermined time period may be selected from: ≥1, ≥2, ≥3, ≥4 and ≥5 seconds.

The spectrometer may comprise a door for accessing the ion source enclosure and a door sensor for detecting when the door is closed, wherein the spectrometer is configured to automatically perform said source pressure test in response to the door sensor detecting that the door has been closed.

The door sensor may be a switch, such as a mechanical or electronic switch. For example, the sensor may be a microswitch. Alternatively, the spectrometer may have a source enclosure sensor for detecting when the source enclosure is mounted to another part of the spectrometer, such as over the ion block. The spectrometer may be configured to automatically perform the source pressure test in response to detecting that this mounting has occurred. The sensor may be a switch, such as a mechanical or electronic switch (e.g. a microswitch).

The third aspect of the invention also provides a method of mass spectrometry comprising:

providing a mass spectrometer as described above;

connecting a pressurised gas supply to said gas inlet;

opening the gas supply valve such that pressurised gas enters the gas inlet;

determining the gas pressure in the ion source enclosure or exhaust; and then closing the gas supply valve, and/or controlling the user interface of the mass spectrometer to signal an alert, if the sensed gas pressure is at or above the first predetermined pressure at the end of the first predetermined time period after having opened the gas supply valve.

The method may comprise setting the first predetermined time period to be a value such that fluid present in the exhaust drains out of the exhaust within said first predetermined time period after having opened the gas supply valve.

The gas leak test is considered novel in its own right.

Accordingly, from a fourth aspect the present invention therefore also provides a mass spectrometer comprising:

an ion source enclosure having a gas inlet and an exhaust;

a gas supply valve for controlling the supply of gas into the gas inlet;

an exhaust valve for selectively opening and closing the exhaust; and a pressure sensor for determining the pressure in the ion source enclosure or exhaust;

wherein the spectrometer is configured to perform a source pressure test by:

a) opening the gas supply valve for allowing gas to enter the gas inlet;

b) closing the exhaust valve;

b) determining the gas pressure in the ion source enclosure or exhaust using the pressure sensor; and then c) closing the gas supply valve, and/or controlling a user interface of the mass spectrometer to signal an alert, in response to the sensed gas pressure being below a predetermined pressure.

The spectrometer is configured to determine if the ion source enclosure is leaking, other than through the exhaust. For example, the ion source enclosure may be repeatedly mountable and demountable, in a sealing manner, over the ion inlet to the spectrometer and the pressure test may test for leaks from such seals. Additionally, or alternatively, the probe of the ion source may be mountable and demountable, in a sealing manner in the ion source enclosure and the pressure test may test for leaks from such a seal. By closing the exhaust valve the system is better able to determine if there is a leak from the ion source enclosure.

The alert may be an alert that the ion source enclosure is leaking.

It will be appreciated that the gas supply valve may be opened before the exhaust valve is closed, or vice versa.

Step c) above may comprise closing the gas supply valve, and/or controlling the user interface to signal the alert, in response to the sensed gas pressure being below a predetermined pressure at the end of a predetermined time period after having closed the exhaust valve.

The use of the predetermined time delay helps prevent false failures of the test, e.g. due to trapped liquid being present in the system. This is in contrast to other systems that determine a pressure test failure due to a leak if the pressure does not rise above a certain level, before waiting for the end of a predetermined period.

The spectrometer may be configured to determine the gas pressure in the ion source enclosure after closing the exhaust valve and to then open the exhaust valve if the sensed gas pressure is at or above the predetermined pressure.

In this instance the spectrometer may determine that there is no unintended gas leak from the ion source enclosure if the sensed gas pressure after closing the exhaust valve is at or above a/the predetermined pressure. The spectrometer may not therefore control the user interface to signal an alert that there is a (gas) leak.

The gas supply valve may also be closed if the sensed gas pressure is at or above the second predetermined pressure.

The spectrometer may then control the user interface to signal that the pressure test has been passed.

The predetermined time period may be selected from: ≥5; ≥10; ≥15; ≥20; ≥25; ≥30; and ≥35.

If, before the end of the predetermined time period, the sensed gas pressure is below the predetermined gas pressure then the spectrometer may maintain the gas supply valve open, and/or control the user interface to signal an alert.

The alert may indicate that there is possibly a gas leak from the source enclosure. The alert may be suppressed for a predetermined time delay, shorter than the predetermined time period, after having closed the exhaust valve. This prevents the alert being indicated before there has been enough time for pressure to build up in the ion source enclosure.

The predetermined time delay may be selected from: ≥1, ≥2, ≥3, ≥4 and ≥5 seconds.

The spectrometer may comprise a door for accessing the ion source enclosure and a door sensor for detecting when the door is closed, wherein the spectrometer is configured to automatically perform said source pressure test in response to the door sensor detecting that the door has been closed. The door sensor may be a switch, such as a mechanical or electronic switch. For example, the sensor may be a microswitch.

Alternatively, the spectrometer may have a source enclosure sensor for detecting when the source enclosure is mounted to another part of the spectrometer, such as over the ion block. The spectrometer may be configured to automatically perform the source pressure test in response to detecting that this mounting has occurred. The sensor may be a switch, such as a mechanical or electronic switch (e.g. a microswitch).

The fourth aspect of the invention also provides a method of mass spectrometry comprising:

providing a mass spectrometer as described above;

connecting a pressurised gas supply to said gas inlet;

opening the gas supply valve such that pressurised gas enters the gas inlet;

closing the exhaust valve;

determining the gas pressure in the ion source enclosure or exhaust; and then closing the gas supply valve, and/or controlling the user interface of the mass spectrometer to signal an alert, if the sensed gas pressure is below the predetermined pressure.

According to various embodiments described herein a relatively small footprint or compact Time of Flight ("TOF") mass spectrometer ("MS") or analytical instrument is provided which has a relatively high resolution. The mass spectrometer may have particular application in the biopharmaceutical industry and in the field of general analytical Electrospray Ionisation ("ESI") and subsequent mass analysis. The mass spectrometer according to various embodiments is a high performance instrument wherein manufacturing costs have been reduced without compromising performance.

The instrument according to various embodiments is particularly user friendly compared with the majority of other conventional instruments. The instrument may have single button which can be activated by a user in order to turn the instrument ON and at the same time initiate an instrument self-setup routine. The instrument may, in particular, have a health diagnostics system which is both helpful for users whilst providing improved diagnosis and fault resolution.

According to various embodiments the instrument may have a health diagnostics or health check which is arranged to bring the overall instrument, and in particular the mass spectrometer and mass analyser, into a state of readiness after a period of inactivity or power saving. The same health diagnostic system may also be utilised to bring the instrument into a state of readiness after maintenance or after the instrument switches from a maintenance mode of operation into an operational state. Furthermore, the health diagnostics system may also be used to monitor the instrument, mass spectrometer or mass analyser on a periodic basis in order to ensure that the instrument in operating within defined operational parameters and hence the integrity of mass spectral or other data obtained is not compromised.

The health check system may determine various actions which either should automatically be performed or which are presented to a user to decide whether or not to proceed with. For example, the health check system may determine that no corrective action or other measure is required i.e. that the instrument is operating as expected within defined operational limits. The health check system may also determine that an automatic operation should be performed in order, for example, to correct or adjust the instrument in response to a detected error warning, error status or anomaly. The health check system may also inform the user that the user should either take a certain course of action or to give approval for the control system to take a certain course of action. Various embodiments are also contemplated wherein the health check system make seek negative approval i.e. the health check system may inform a user that a certain course of action will be taken, optionally after a defined time delay, unless the user instructs otherwise or cancels the proposed action suggested by the control system.

Embodiments are also contemplated wherein the level of detail provided to a user may vary dependent upon the level of experience of the user. For example, the health check system may provide either very detailed instructions or simplified instructions to a relatively unskilled user.

The health check system may provide a different level of detail to a highly skilled user such as a service engineer. In particular, additional data and/or instructions may be provided to a service engineer which may not be provided to a regular user. It is also contemplated that instructions given to a regular user may include icons and/or moving graphical images. For example, a user may be guided by the health check system in order to correct a fault and once it is determined that a user has completed a step then the control system may change the icon and/or moving graphical images which are displayed to the user in order to continue to guide the user through the process.

The instrument according to various embodiments has been designed to be as small as possible whilst also being generally compatible with existing UPLC systems. The instrument is easy to operate and has been designed to have a high level of reliability. Furthermore, the instrument has been designed so as to simplify diagnostic and servicing thereby minimising instrument downtime and operational costs.

According to various embodiments the instrument has particular utility in the health services market and may be integrated with Desorption Electrospray Ionisation ("DESI") and Rapid Evaporative Ionisation Mass Spectrometry ("REIMS") ion sources in order to deliver commercially available In Vitro Diagnostic Medical Device ("IVD")/Medical Device ("MD") solutions for targeted applications.

The mass spectrometer may, for example, be used for microbe identification purposes, histopathology, tissue imaging and surgical (theatre) applications.

The mass spectrometer has a significantly enhanced user experience compared with conventional mass spectrometers and has a high degree of robustness. The instrument is particularly easy to use (especially for non-expert users) and has a high level of accessibility.

The mass spectrometer has been designed to integrate easily with liquid chromatography ("LC") separation systems so that a LC-TOF MS instrument may be provided. The instrument is particularly suited for routine characterisation and monitoring applications in the biopharmaceutical industry. The instrument enables non-expert users to collect high resolution accurate mass data and to derive meaningful information from the data quickly and easily. This results in improved understanding of products and processes with the potential to shorten time to market and reduce costs.

The instrument may be used in biopharmaceutical last stage development and quality control ("QC") applications. The instrument also has particular application in small molecule pharmaceutical, food and environmental ("F&E") and chemical materials analyses.

The instrument has enhanced mass detection capabilities i.e. high mass resolution, accurate mass and an extended mass range. The instrument also has the ability to fragment parent ions into daughter or fragment ions so that MS/MS type experiments may be performed.

BRIEF DESCRIPTION OF THE DRAWINGS

Various embodiments together with other arrangements given for illustrative purposes only will now be described, by way of example only, and with reference to the accompanying drawings in which:

FIG. 10B shows a monolithic pusher plate assembly according to various embodiments and FIG. 100 shows a pusher plate assembly with a pusher electrode assembly or module and an ion detector assembly or module mounted thereto;

FIG. 16F illustrates the relative voltages and absolute voltage ranges at which the various ion optical components such as the Electrospray capillary probe, differential pumping apertures, transfer lens electrodes, pusher electrodes, reflectron electrodes and the detector are maintained according to various embodiments.

DETAILED DESCRIPTION

Various aspects of a newly developed mass spectrometer are disclosed. The mass spectrometer comprises a modified and improved ion inlet assembly, a modified first ion guide, a modified quadrupole rod set ion guide, improved transfer optics, a novel cantilevered time of flight arrangement, a modified reflectron arrangement together with advanced electronics and an improved user interface.

The mass spectrometer has been designed to have a high level of performance, to be highly reliable, to offer a significantly improved user experience compared with the majority of conventional mass spectrometers, to have a very high level of EMC compliance and to have advanced safety features.

The instrument comprises a highly accurate mass analyser and overall the instrument is small and compact with a high degree of robustness. The instrument has been designed to reduce manufacturing cost without compromising performance at the same time making the instrument more reliable and easier to service. The instrument is particularly easy to use, easy to maintain and easy to service. The instrument constitutes a next-generation bench-top Time of Flight mass spectrometer.

Figure 1:
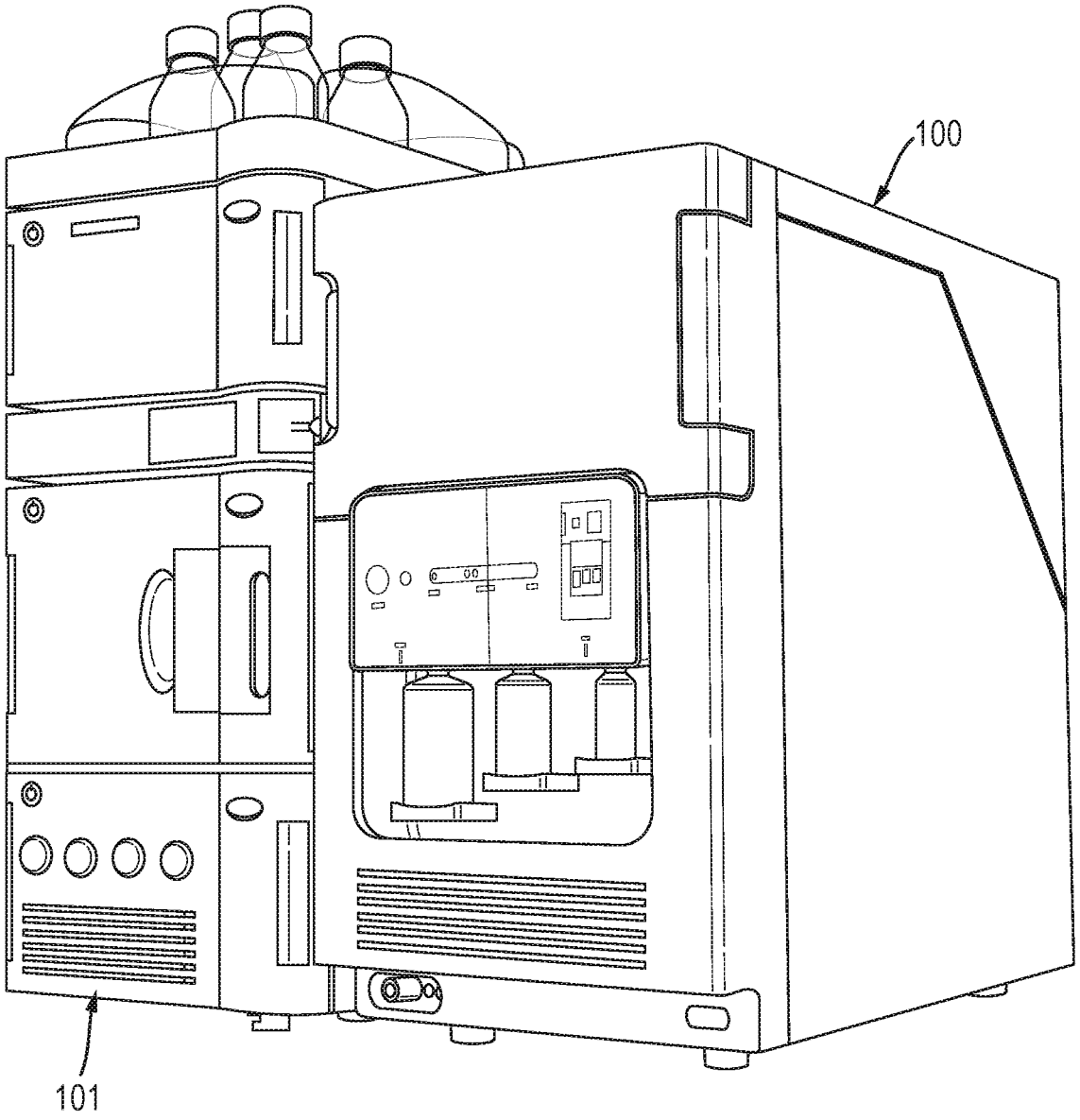
FIG. 1 shows a perspective view of a bench-top Time of Flight mass spectrometer according to various embodiments coupled to a conventional bench-top liquid chromatography ("LC") separation system.

FIG. 1 shows a bench-top mass spectrometer 100 according to various embodiments which is shown coupled to a conventional bench-top liquid chromatography separation device 101. The mass spectrometer 100 has been designed with ease of use in mind. In particular, a simplified user interface and front display is provided and instrument serviceability has been significantly improved and optimised relative to conventional instruments. The mass spectrometer 100 has an improved mechanical design with a reduced part count and benefits from a simplified manufacturing process thereby leading to a reduced cost design, improved reliability and simplified service procedures. The mass spectrometer has been designed to be highly electromagnetic compatible ("EMC") and exhibits very low electromagnetic interference ("EMI").

Figure 2A:
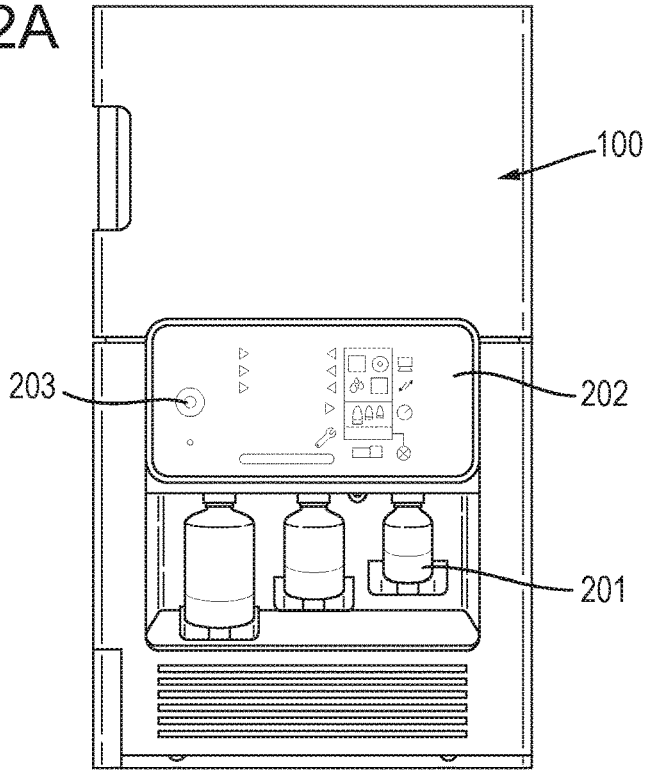
FIG. 2A shows a front view of a bench-top mass spectrometer according to various embodiments showing three solvent bottles loaded into the instrument and a front display panel.
Figure 2B:
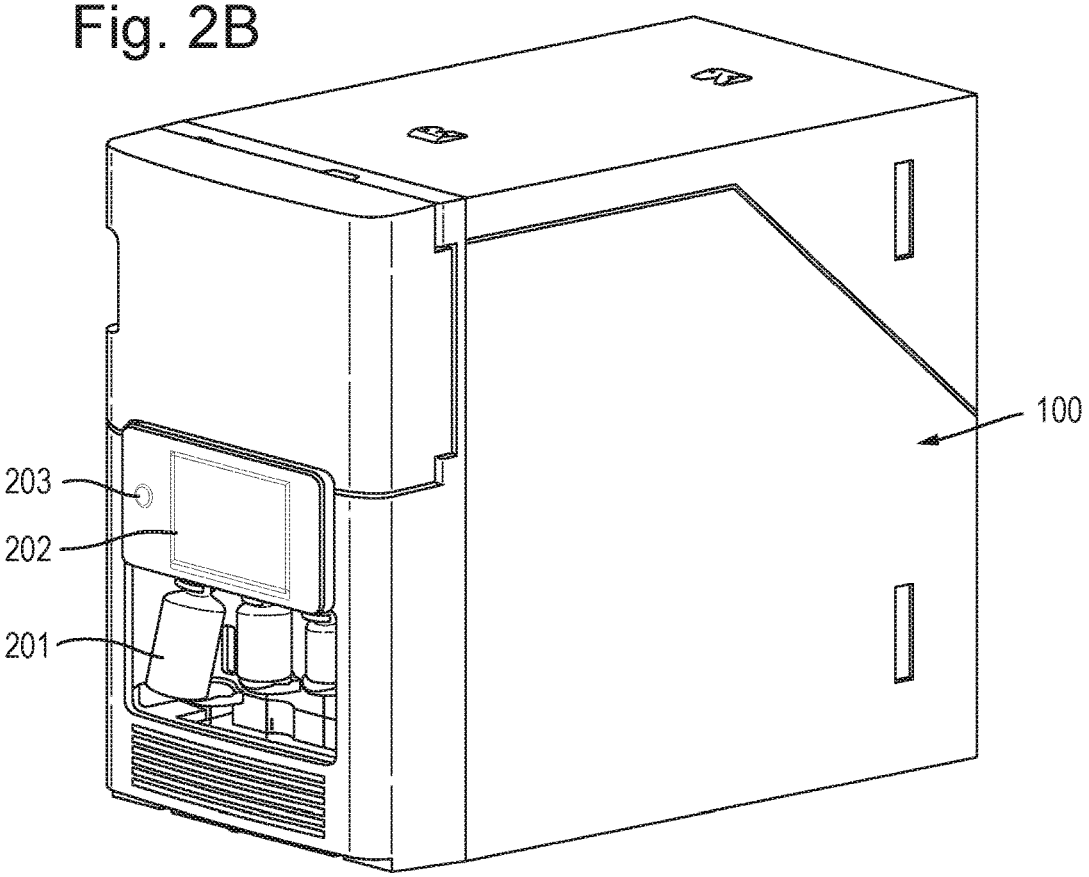
FIG. 2B shows a perspective view of a mass spectrometer according to various embodiments and FIG. 2C illustrates in more detail various icons which may be displayed on the front display panel in order to highlight the status of the instrument to a user and to indicate if a potential fault has been detected.

FIG. 2A shows a front view of the mass spectrometer 100 according to various embodiments and FIG. 2B shows a perspective view of the mass spectrometer according to various embodiments. Three solvent bottles 201 may be coupled, plugged in or otherwise connected or inserted into the mass spectrometer 100. The solvent bottles 201 may be back lit in order to highlight the fill status of the solvent bottles 201 to a user.

One problem with a known mass spectrometer having a plurality of solvent bottles is that a user may connect a solvent bottle in a wrong location or position. Furthermore, a user may mount a solvent bottle but conventional mounting mechanisms will not ensure that a label on the front of the solvent bottle will be positioned so that it can be viewed by a user i.e. conventional instruments may allow a solvent bottle to be connected where a front facing label ends up facing away from the user. Accordingly, one problem with conventional instruments is that a user may not be able to read a label on a solvent bottle due to the fact that the solvent bottle ends up being positioned with the label of the solvent bottle facing away from the user. According to various embodiments conventional screw mounts which are conventionally used to mount solvent bottles have been replaced with a resilient spring mounting mechanism which allows the solvent bottles 201 to be connected without rotation.

According to various embodiments the solvent bottles 201 may be illuminated by a LED light tile in order to indicate the fill level of the solvent bottles 201 to a user. It will be understood that a single LED illuminating a bottle will be insufficient since the fluid in a solvent bottle 201 can attenuate the light from the LED. Furthermore, there is no good single position for locating a single LED.

The mass spectrometer 100 may have a display panel 202 upon which various icons may be displayed when illuminated by the instrument control system.

A start button 203 may be positioned on or adjacent the front display panel 202. A user may press the start button 203 which will then initiate a power-up sequence or routine. The power-up sequence or routine may comprise powering-up all instrument modules and initiating instrument pump-down i.e. generating a low pressure in each of the vacuum chambers within the body of the mass spectrometer 100.

According to various embodiments the power-up sequence or routine may or may not include running a source pressure test and switching the instrument into an Operate mode of operation.

According to various embodiments a user may hold the start button 203 for a period of time, e.g. 5 seconds, in order to initiate a power-down sequence.

If the instrument is in a maintenance mode of operation then pressing the start button 203 on the front panel of the instrument may initiate a power-up sequence. Furthermore, when the instrument is in a maintenance mode of operation then holding the start button 203 on the front panel of the instrument for a period of time, e.g. 5 seconds, may initiate a power-down sequence.

Figure 2C:
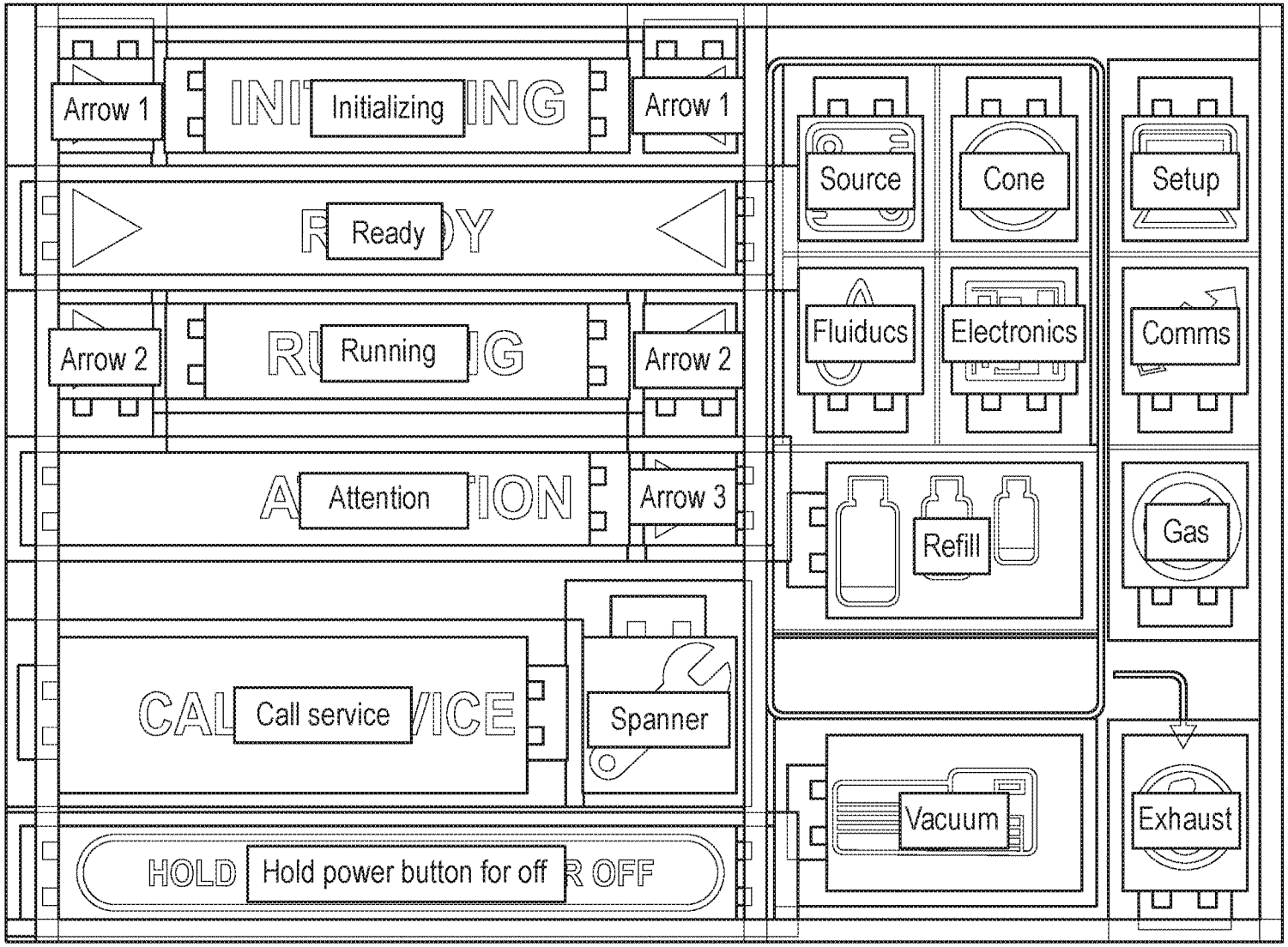

FIG. 2C illustrates in greater detail various icons which may be displayed on the display panel 202 and which may illuminated under the control of instrument hardware and/or software. According to various embodiments one side of the display panel 202 (e.g. the left-hand side) may have various icons which generally relate to the status of the instrument or mass spectrometer 100. For example, icons may be displayed in the colour green to indicate that the instrument is in an initialisation mode of operation, a ready mode of operation or a running mode of operation.

In the event of a detected error which may require user interaction or user input a yellow or amber warning message may be displayed. A yellow or amber warning message or icon may be displayed on the display panel 202 and may convey only relatively general information to a user e.g. indicating that there is a potential fault and a general indication of what component or aspect of the instrument may be at fault.

According to various embodiments it may be necessary for a user to refer to an associated computer display or monitor in order to get fuller details or gain a fuller appreciation of the nature of the fault and to receive details of potential corrective action which is recommended to perform in order to correct the fault or to place the instrument in a desired operational state.

A user may be invited to confirm that a corrective action should be performed and/or a user may be informed that a certain corrective action is being performed.

In the event of a detected error which cannot be readily corrected by a user and which instead requires the services of a skilled service engineer then a warning message may be displayed indicating that a service engineer needs to be called. A warning message indicating the need for a service engineer may be displayed in the colour red and a spanner or other icon may also be displayed or illuminated to indicate to a user that an engineer is required.

The display panel 202 may also display a message that the power button 203 should be pressed in order to turn the instrument OFF.

According to an embodiment one side of the display panel 202 (e.g. the right-hand side) may have various icons which indicate different components or modules of the instrument where an error or fault has been detected. For example, a yellow or amber icon may be displayed or illuminated in order to indicate an error or fault with the ion source, a fault in the inlet cone region, a fault with the fluidic systems, an electronics fault, a fault with one or more of the solvent or other bottles 201 (i.e. indicating that one or more solvent bottles 201 needing to be refilled or emptied), a vacuum pressure fault associated with one or more of the vacuum chambers, an instrument setup error, a communication error, a problem with a gas supply or a problem with an exhaust.

It will be understood that the display panel 202 may merely indicate the general status of the instrument and/or the general nature of a fault. In order to be able to resolve the fault or to understand the exact nature of an error or fault a user may need to refer to the display screen of an associated computer or other device. For example, as will be understood by those skilled in the art an associated computer or other device may be arranged to receive and process mass spectral and other data output from the instrument or mass spectrometer 100 and may display mass spectral data or images on a computer display screen for the benefit of a user.

According to various embodiments the status display may indicate whether the instrument is in one of the following states namely Running, Ready, Getting Ready, Ready Blocked or Error.

The status display may display health check indicators such as Service Required, Cone, Source, Set-up, Vacuum, Communications, Fluidics, Gas, Exhaust, Electronics, Lock-mass, Calibrant and Wash.

A "Hold power button for OFF" LED tile is shown in FIG. 2C and may remain illuminated when the power button 203 is pressed and may remain illuminated until the power button 203 is released or until a period of time (e.g. 5 seconds) has elapsed whichever is sooner. If the power button 203 is released before the set period of time (e.g. less than 5 seconds after it is pressed) then the "Hold power button for OFF" LED tile may fade out over a time period of e.g. 2 s.

The initialising LED tile may be illuminated when the instrument is started via the power button 203 and may remain ON until software assumes control of the status panel or until a power-up sequence or routine times out.

According to various embodiments an instrument health check may be performed and printer style error correction instructions may be provided to a user via a display screen of a computer monitor (which may be separate to the front display panel 202) in order to help guide a user through any steps that the user may need to perform.

The instrument may attempt to self-diagnose any error messages or warning status alert(s) and may attempt to rectify any problem(s) either with or without notifying the user. Depending upon the severity of any problem the instrument control system may either attempt to correct the problem(s) itself, request the user to carry out some form of intervention in order to attempt to correct the issue or problem(s) or may inform the user that the instrument requires a service engineer.

In the event where corrective action may be taken by a user then the instrument may display instructions for the user to follow and may provide details of methods or steps that should be performed which may allow the user to fix or otherwise resolve the problem or error. A resolve button may be provided on a display screen which may be pressed by a user having followed the suggested resolution instructions. The instrument may then run a test again and/or may check if the issue has indeed been corrected. For example, if a user were to trigger an interlock then once the interlock is closed a pressure test routine may be initialised as detailed below.

Figure 3:
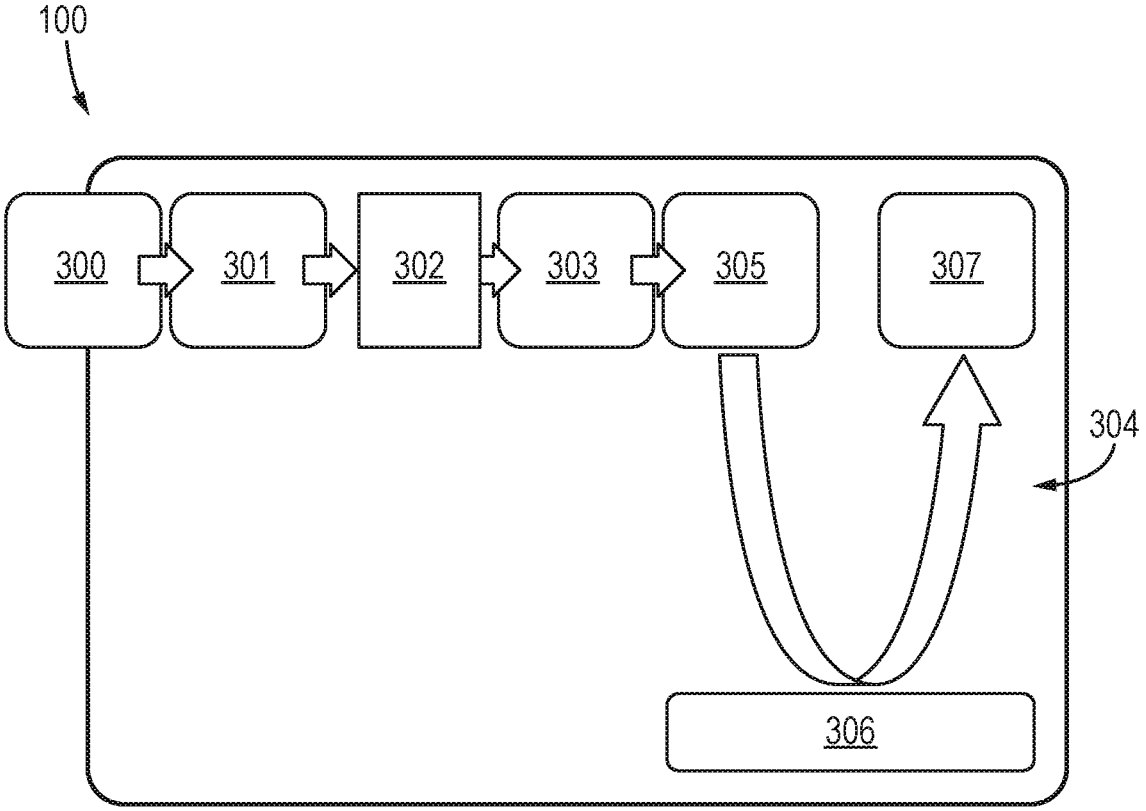
FIG. 3 shows a schematic representation of mass spectrometer according to various embodiments, wherein the instrument comprises an Electrospray Ionisation ("ESI") or other ion source, a conjoined ring ion guide, a segmented quadrupole rod set ion guide, one or more transfer lenses and a Time of Flight mass analyser comprising a pusher electrode, a reflectron and an ion detector.

FIG. 3 shows a high level schematic of the mass spectrometer 100 according to various embodiments wherein the instrument may comprise an ion source 300, such as an Electrospray Ionisation ("ESI") ion source. However, it should be understood that the use of an Electrospray Ionisation ion source 300 is not essential and that according to other embodiments a different type of ion source may be used. For example, according to various embodiments a Desorption Electrospray Ionisation ("DESI") ion source may be used. According to yet further embodiments a Rapid Evaporative Ionisation Mass Spectrometry ("REIMS") ion source may be used.

If an Electrospray ion source 300 is provided then the ion source 300 may comprise an Electrospray probe and associated power supply.

Figure 6A:
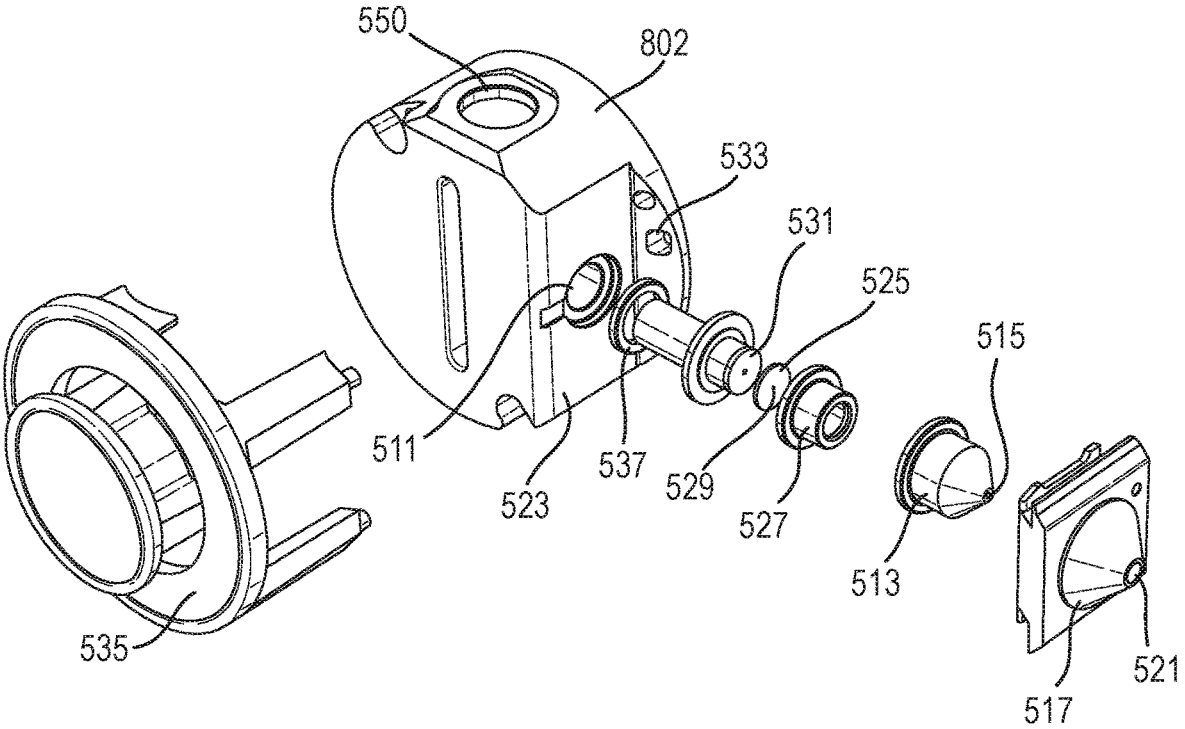
Fig. 6A Prior art
FIG. 6A shows an exploded view of the first known ion inlet assembly.
Figure 6B:
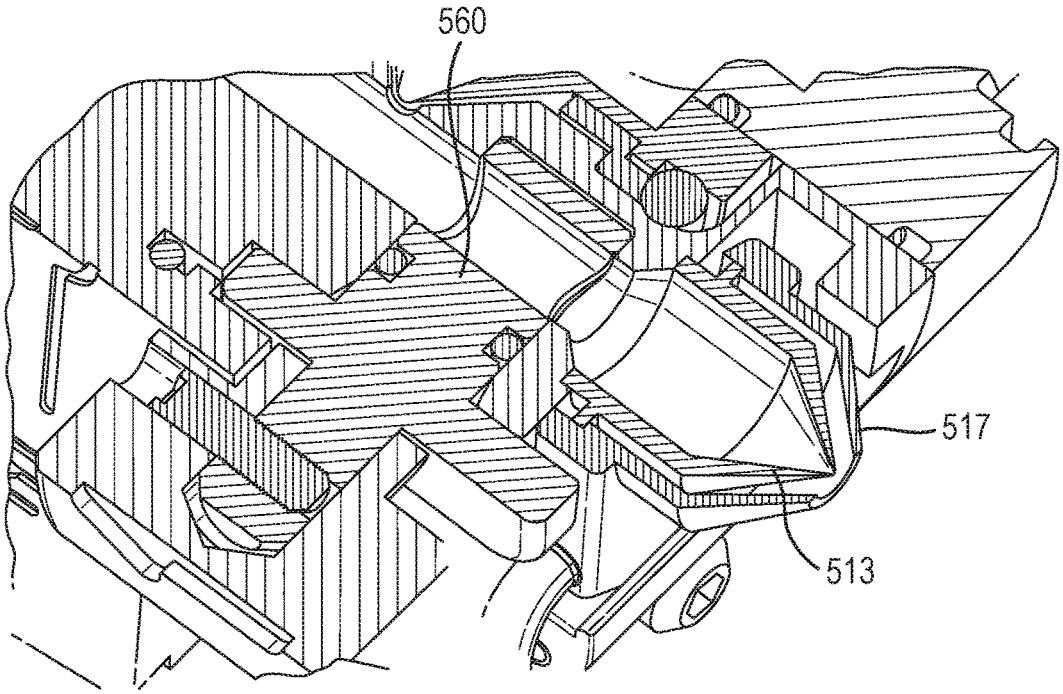
Fig. 6B Prior art
FIG. 6B shows a second different known ion inlet assembly having an isolation valve.
Figure 6C:
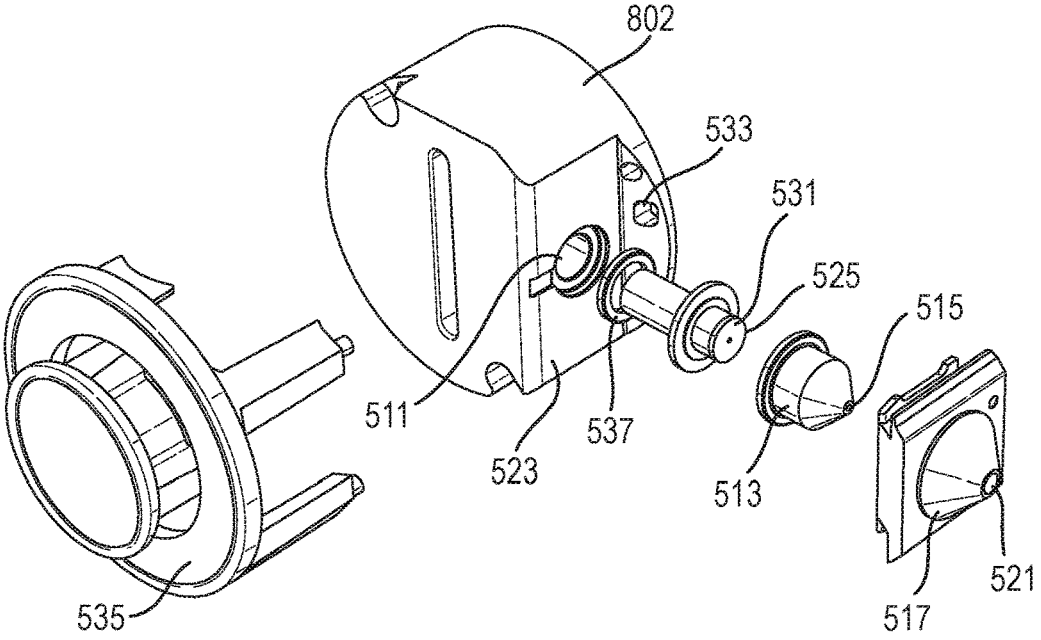
FIG. 6C shows an exploded view of an ion inlet assembly according to various embodiments.

The initial stage of the associated mass spectrometer 100 comprises an ion block 802 (as shown in FIG. 6C) and a source enclosure may be provided if an Electrospray Ionisation ion source 300 is provided.

If a Desorption Electrospray Ionisation ("DESI") ion source is provided then the ion source may comprise a DESI source, a DESI sprayer and an associated DESI power supply. The initial stage of the associated mass spectrometer may comprise an ion block 802 as shown in more detail in FIG. 6C. However, according to various embodiments if a DESI source is provided then the ion block 802 may not enclosed by a source enclosure.

It will be understood that a REIMS source involves the transfer of analyte, smoke, fumes, liquid, gas, surgical smoke, aerosol or vapour produced from a sample which may comprise a tissue sample. In some embodiments, the REIMS source may be arranged and adapted to aspirate the analyte, smoke, fumes, liquid, gas, surgical smoke, aerosol or vapour in a substantially pulsed manner. The REIMS source may be arranged and adapted to aspirate the analyte, smoke, fumes, liquid, gas, surgical smoke, aerosol or vapour substantially only when an electrosurgical cutting applied voltage or potential is supplied to one or more electrodes, one or more electrosurgical tips or one or more laser or other cutting devices.

The mass spectrometer 100 may be arranged so as to be capable of obtaining ion images of a sample. For example, according to various embodiments mass spectral and/or other physico-chemical data may be obtained as a function of position across a portion of a sample. Accordingly, a determination can be made as to how the nature of the sample may vary as a function of position along, across or within the sample.

The mass spectrometer 100 may comprise a first ion guide 301 such as a StepWave® ion guide 301 having a plurality of ring and conjoined ring electrodes. The mass spectrometer 100 may further comprise a segmented quadrupole rod set ion guide 302, one or more transfer lenses 303 and a Time of Flight mass analyser 304. The quadrupole rod set ion guide 302 may be operated in an ion guiding mode of operation and/or in a mass filtering mode of operation. The Time of Flight mass analyser 304 may comprise a linear acceleration Time of Flight region or an orthogonal acceleration Time of Flight mass analyser.

If the Time of Flight mass analyser comprises an orthogonal acceleration Time of Flight mass analyser 304 then the mass analyser 304 may comprise a pusher electrode 305, a reflectron 306 and an ion detector 307. The ion detector 307 may be arranged to detect ions which have been reflected by the reflectron 306. It should be understood, however, that the provision of a reflectron 306 though desirable is not essential.

According to various embodiments the first ion guide 301 may be provided downstream of an atmospheric pressure interface. The atmospheric pressure interface may comprises an ion inlet assembly.

The first ion guide 301 may be located in a first vacuum chamber or first differential pumping region.

The first ion guide 301 may comprise a part ring, part conjoined ring ion guide assembly wherein ions may be transferred in a generally radial direction from a first ion path formed within a first plurality of ring or conjoined ring electrodes into a second ion path formed by a second plurality of ring or conjoined ring electrodes. The first and second plurality of ring electrodes may be conjoined along at least a portion of their length. Ions may be radially confined within the first and second plurality of ring electrodes.

The second ion path may be aligned with a differential pumping aperture which may lead into a second vacuum chamber or second differential pumping region.

The first ion guide 301 may be utilised to separate charged analyte ions from unwanted neutral particles. The unwanted neutral particles may be arranged to flow towards an exhaust port whereas analyte ions are directed on to a different flow path and are arranged to be optimally transmitted through a differential pumping aperture into an adjacent downstream vacuum chamber.

It is also contemplated that according to various embodiments ions may in a mode of operation be fragmented within the first ion guide 301. In particular, the mass spectrometer 100 may be operated in a mode of operation wherein the gas pressure in the vacuum chamber housing the first ion guide 301 is maintained such that when a voltage supply causes ions to be accelerated into or along the first ion guide 301 then the ions may be arranged to collide with background gas in the vacuum chamber and to fragment to form fragment, daughter or product ions. According to various embodiments a static DC voltage gradient may be maintained along at least a portion of the first ion guide 301 in order to urge ions along and through the first ion guide 301 and optionally to cause ions in a mode of operation to fragment.

However, it should be understood that it is not essential that the mass spectrometer 100 is arranged so as to be capable of performing ion fragmentation in the first ion guide 301 in a mode of operation.

The mass spectrometer 100 may comprise a second ion guide 302 downstream of the first ion guide 302 and the second ion guide 302 may be located in the second vacuum chamber or second differential pumping region.

The second ion guide 302 may comprise a segmented quadrupole rod set ion guide or mass filter 302. However, other embodiments are contemplated wherein the second ion guide 302 may comprise a quadrupole ion guide, a hexapole ion guide, an octopole ion guide, a multipole ion guide, a segmented multipole ion guide, an ion funnel ion guide, an ion tunnel ion guide (e.g. comprising a plurality of ring electrodes each having an aperture through which ions may pass or otherwise forming an ion guiding region) or a conjoined ring ion guide.

The mass spectrometer 100 may comprise one or more transfer lenses 303 located downstream of the second ion guide 302. One of more of the transfer lenses 303 may be located in a third vacuum chamber or third differential pumping region. Ions may be passed through a further differential pumping aperture into a fourth vacuum chamber or fourth differential pumping region. One or more transfer lenses 303 may also be located in the fourth vacuum chamber or fourth differential pumping region.

The mass spectrometer 100 may comprise a mass analyser 304 located downstream of the one or more transfer lenses 303 and may be located, for example, in the fourth or further vacuum chamber or fourth or further differential pumping region. The mass analyser 304 may comprise a Time of Flight ("TOF") mass analyser. The Time of Flight mass analyser 304 may comprise a linear or an orthogonal acceleration Time of Flight mass analyser.

According to various embodiments an orthogonal acceleration Time of Flight mass analyser 304 may be provided comprising one or more orthogonal acceleration pusher electrode(s) 305 (or alternatively and/or additionally one or more puller electrode(s)) and an ion detector 307 separated by a field free drift region. The Time of Flight mass analyser 304 may optionally comprise one or more reflectrons 306 intermediate the pusher electrode 305 and the ion detector 307.

Although highly desirable, it should be recognised that the mass analyser does not have to comprise a Time of Flight mass analyser 304. More generally, the mass analyser 304 may comprise either: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; or (xiv) a linear acceleration Time of Flight mass analyser.

Although not shown in FIG. 3, the mass spectrometer 100 may also comprise one or more optional further devices or stages. For example, according to various embodiments the mass spectrometer 100 may additionally comprise one or more ion mobility separation devices and/or one or more Field Asymmetric Ion Mobility Spectrometer ("FAIMS") devices and/or one or more devices for separating ions temporally and/or spatially according to one or more physico-chemical properties. For example, the mass spectrometer 100 according to various embodiments may comprise one or more separation stages for temporally or otherwise separating ions according to their mass, collision cross section, conformation, ion mobility, differential ion mobility or another physico-chemical parameter.

The mass spectrometer 100 may comprise one or more discrete ion traps or one or more ion trapping regions. However, as will be described in more detail below, an axial trapping voltage may be applied to one or more sections or one or more electrodes of either the first ion guide 301 and/or the second ion guide 302 in order to confine ions axially for a short period of time. For example, ions may be trapped or confined axially for a period of time and then released. The ions may be released in a synchronised manner with a downstream ion optical component. For example, in order to enhance the duty cycle of analyte ions of interest, an axial trapping voltage may be applied to the last electrode or stage of the second ion guide 302. The axial trapping voltage may then be removed and the application of a voltage pulse to the pusher electrode 305 of the Time of Flight mass analyser 304 may be synchronised with the pulsed release of ions so as to increase the duty cycle of analyte ions of interest which are then subsequently mass analysed by the mass analyser 304. This approach may be referred to as an Enhanced Duty Cycle ("EDC") mode of operation.

Furthermore, the mass spectrometer 100 may comprise one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The mass spectrometer 100 may comprise one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter.

The fourth or further vacuum chamber or fourth or further differential pumping region may be maintained at a lower pressure than the third vacuum chamber or third differential pumping region. The third vacuum chamber or third differential pumping region may be maintained at a lower pressure than the second vacuum chamber or second differential pumping region and the second vacuum chamber or second differential pumping region may be maintained at a lower pressure than the first vacuum chamber or first differential pumping region. The first vacuum chamber or first differential pumping region may be maintained at lower pressure than ambient. Ambient pressure may be considered to be approx. 1013 mbar at sea level.

The mass spectrometer 100 may comprise an ion source configured to generate analyte ions. In various particular embodiments, the ion source may comprise an Atmospheric Pressure Ionisation ("API") ion source such as an Electrospray Ionisation ("ESI") ion source or an Atmospheric Pressure Chemical Ionisation ("APCI") ion source.

Figure 4:
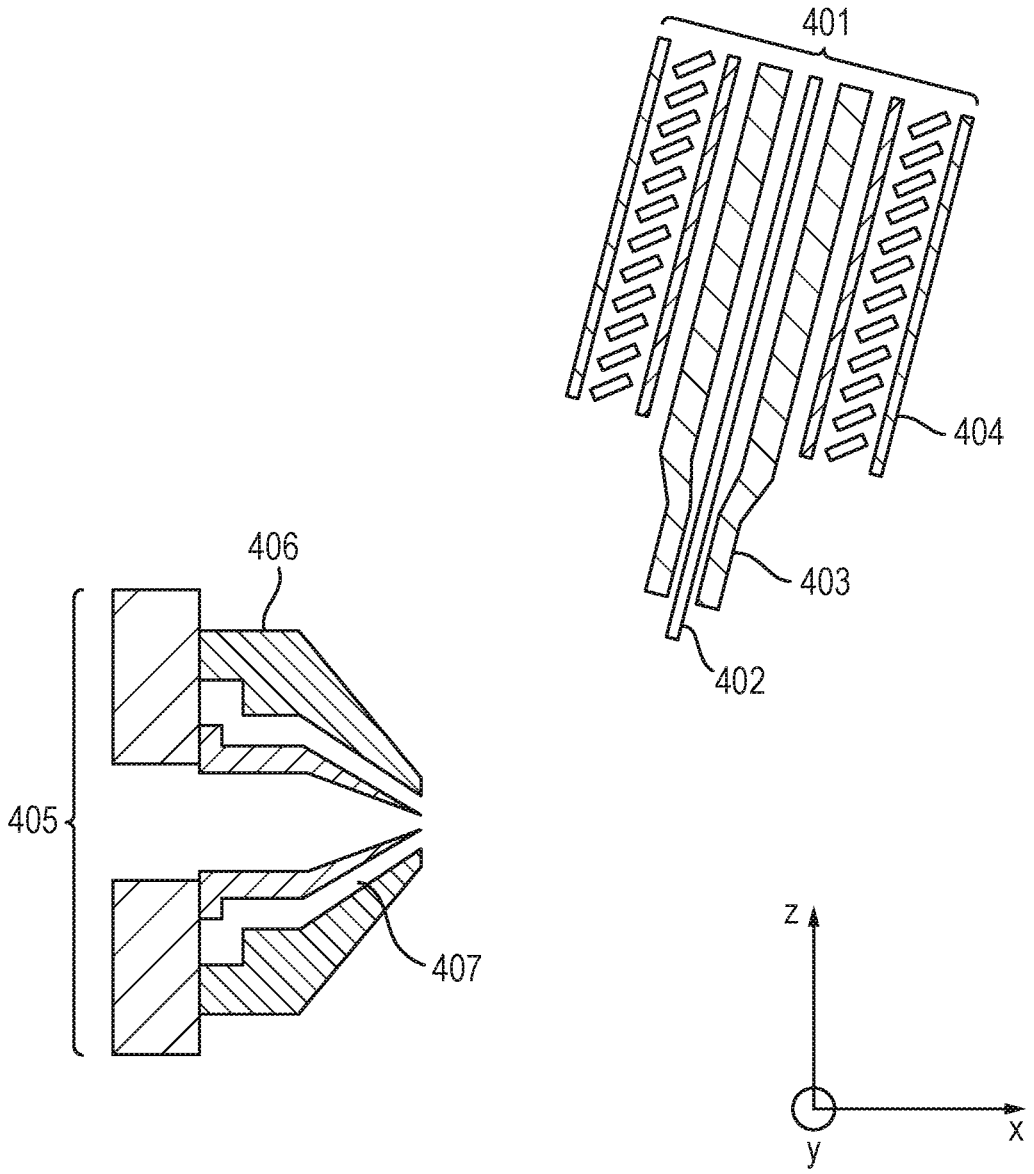
Fig. 4 Prior art
FIG. 4 shows a known Atmospheric Pressure Ionisation ("API") ion source which may be used with the mass spectrometer according to various embodiments.

FIG. 4 shows in general form a known Atmospheric Pressure Ionisation ("API") ion source such as an Electrospray Ionisation ("ESI") ion source or an Atmospheric Pressure Chemical Ionisation ("APCI") ion source. The ion source may comprise, for example, an Electrospray Ionisation probe 401 which may comprise an inner capillary tube 402 through which an analyte liquid may be supplied. The analyte liquid may comprise mobile phase from a LC column or an infusion pump. The analyte liquid enters via the inner capillary tube 402 or probe and is pneumatically converted to an electrostatically charged aerosol spray. Solvent is evaporated from the spray by means of heated desolvation gas. Desolvation gas may be provided through an annulus which surrounds both the inner capillary tube 402 and an intermediate surrounding nebuliser tube 403 through which a nebuliser gas emerges. The desolvation gas may be heated by an annular electrical desolvation heater 404. The resulting analyte and solvent ions are then directed towards a sample or sampling cone aperture mounted into an ion block 405 forming an initial stage of the mass spectrometer 100.

The inner capillary tube 402 is preferably surrounded by a nebuliser tube 403. The emitting end of the inner capillary tube 402 may protrude beyond the nebuliser tube 403. The inner capillary tube 402 and the nebuliser tube 403 may be surrounded by a desolvation heater arrangement 404 as shown in FIG. 4 wherein the desolvation heater 404 may be arranged to heat a desolvation gas. The desolvation heater 404 may be arranged to heat a desolvation gas from ambient temperature up to a temperature of around 600° C. According to various embodiments the desolvation heater 404 is always OFF when the API gas is OFF.

The desolvation gas and the nebuliser gas may comprise nitrogen, air or another gas or mixture of gases. The same gas (e.g. nitrogen, air or another gas or mixture of gases) may be used as both a desolvation gas, nebuliser gas and cone gas. The function of the cone gas will be described in more detail below.

The inner probe capillary 402 may be readily replaced by an unskilled user without needing to use any tools. The Electrospray probe 402 may support LC flow rates in the range of 0.3 to 1.0 mL/min.

According to various embodiments an optical detector may be used in series with the mass spectrometer 100. It will be understood that an optical detector may have a maximum pressure capability of approx. 1000 psi. Accordingly, the Electrospray Ionisation probe 401 may be arranged so as not to cause a back pressure of greater than around 500 psi, allowing for back pressure caused by other system components. The instrument may be arranged so that a flow of 50:50 methanol/water at 1.0 mL/min does not create a backpressure greater than 500 psi.

According to various embodiments a nebuliser flow rate of between 106 to 159 L/hour may be utilised.

The ESI probe 401 may be powered by a power supply which may have an operating range of 0.3 to 1.5 kV.

It should, however, be understood that various other different types of ion source may instead be coupled to the mass spectrometer 100. For example, according to various embodiments, the ion source may more generally comprise either: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; (xxix) a Surface Assisted Laser Desorption Ionisation ("SALDI") ion source; or (xxx) a Low Temperature Plasma ("LTP") ion source.

A chromatography or other separation device may be provided upstream of the ion source 300 and may be coupled so as to provide an effluent to the ion source 300. The chromatography separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The mass spectrometer 100 may comprise an atmospheric pressure interface or ion inlet assembly downstream of the ion source 300. According to various embodiments the atmospheric pressure interface may comprise a sample or sampling cone 406,407 which is located downstream of the ion source 401. Analyte ions generated by the ion source 401 may pass via the sample or sampling cone 406,407 into or onwards towards a first vacuum chamber or first differential pumping region of the mass spectrometer 100. However, according to other embodiments the atmospheric pressure interface may comprise a capillary interface.

As shown in FIG. 4, ions generated by the ion source 401 may be directed towards an atmospheric pressure interface which may comprise an outer gas cone 406 and an inner sample cone 407. A cone gas may be supplied to an annular region between the inner sample cone 407 and the outer gas cone 406. The cone gas may emerge from the annulus in a direction which is generally opposed to the direction of ion travel into the mass spectrometer 100. The cone gas may act as a declustering gas which effectively pushes away large contaminants thereby preventing large contaminants from impacting upon the outer cone 406 and/or inner cone 407 and also preventing the large contaminants from entering into the initial vacuum stage of the mass spectrometer 100.

Figure 5:
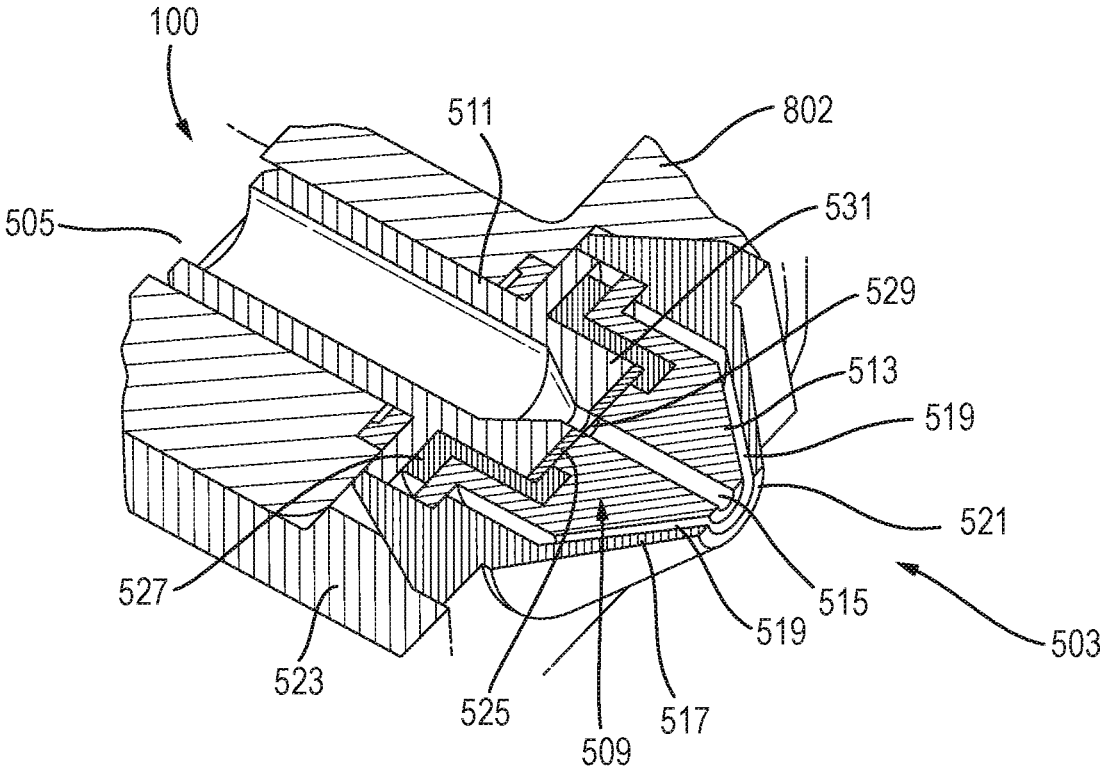
Fig. 5 Prior art
FIG. 5 shows a first known ion inlet assembly which shares features with an ion inlet assembly according to various embodiments.

FIG. 5 shows in more detail a first known ion inlet assembly which is similar to an ion inlet assembly according to various embodiments. The known ion inlet assembly as shown and described below with reference to FIGS. 5 and 6A is presented in order to highlight various aspects of an ion inlet assembly according to various embodiments and also so that differences between an ion inlet assembly according to various embodiments as shown and discussed below with reference to FIG. 6C can be fully appreciated.

With reference to FIG. 5, it will be understood that the ion source (not shown) generates analyte ions which are directed towards a vacuum chamber 505 of the mass spectrometer 100.

A gas cone assembly is provided comprising an inner gas cone or sampling cone 513 having an aperture 515 and an outer gas cone 517 having an aperture 521. A disposable disc 525 is arranged beneath or downstream of the inner gas cone or sampling 513 and is held in position by a mounting element 527. The disc 525 covers an aperture 511 of the vacuum chamber 505. The disc 525 is removably held in position by the inner gas cone 513 resting upon the mounting element 527.

As will be discussed in more detail below with reference to FIG. 6C, according to various embodiments the mounting element 527 is not provided in the preferred ion inlet assembly.

The disc 525 has an aperture or sampling orifice 529 through which ions can pass.

A carrier 531 is arranged underneath or below the disc 525. The carrier 531 is arranged to cover the aperture 511 of the vacuum chamber 505. Upon removal of the disc 525, the carrier 531 may remain in place due to suction pressure.

FIG. 6A shows an exploded view of the first known ion inlet assembly. The outer gas cone 517 has a cone aperture 521 and is slidably mounted within a clamp 535. The clamp 535 allows a user to remove the outer gas cone 517 without physically having to touch the outer gas cone 517 which will get hot during use.

An inner gas cone or sampling cone 513 is shown mounted behind or below the outer gas cone 517.

The known arrangement utilises a carrier 531 which has a 1 mm diameter aperture. The ion block 802 is also shown having a calibration port 550. However, the calibration port 550 is not provided in an ion inlet assembly according to various embodiments.

FIG. 6B shows an second different known ion inlet assembly as used on a different instrument which has an isolation valve 560 which is required to hold vacuum pressure when the outer cone gas nozzle 517 and the inner nozzle 513 are removed for servicing. The inner cone 513 has a gas limiting orifice into the subsequent stages of the mass spectrometer. The inner gas cone 513 comprises a high cost, highly precisioned part which requires routine removal and cleaning. The inner gas cone 513 is not a disposable or consumable item. Prior to removing the inner sampling cone 513 the isolation valve 560 must be rotated into a closed position in order to isolate the downstream vacuum stages of the mass spectrometer from atmospheric pressure. The isolation valve 560 is therefore required in order to hold vacuum pressure whilst the inner gas sampling cone 513 is removed for cleaning.

FIG. 6C shows an exploded view of an ion inlet assembly according to various embodiments. The ion inlet assembly according to various embodiments is generally similar to the first known ion inlet assembly as shown and described above with reference to FIGS. 5 and 6A except for a few differences. One difference is that a calibration port 550 is not provided in the ion block 802 and a mounting member or mounting element 527 is not provided.

Accordingly, the ion block 802 and ion inlet assembly have been simplified. Furthermore, importantly the disc 525 may comprise a 0.25 or 0.30 mm diameter aperture disc 525 which is substantially smaller diameter than conventional arrangements.

According to various embodiments both the disc 525 and the vacuum holding member or carrier 531 may have a substantially smaller diameter aperture than conventional arrangements such as the first known arrangement as shown and described above with reference to FIGS. 5 and 6A.

For example, the first known instrument utilises a vacuum holding member or carrier 531 which has a 1 mm diameter aperture. In contrast, according to various embodiments the vacuum holding member or carrier 531 according to various embodiments may have a much smaller diameter aperture e.g. a 0.3 mm or 0.40 mm diameter aperture.

Figure 6D:
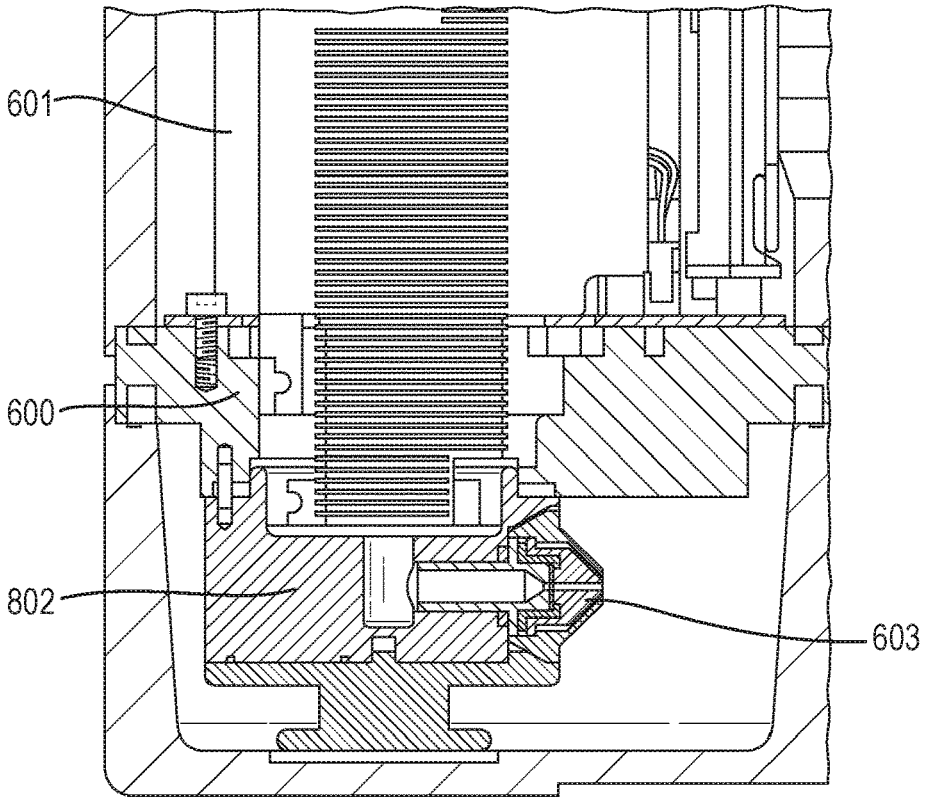
FIG. 6D shows the arrangement of an ion block attached to a pumping block upstream of a vacuum chamber housing a first ion guide according to various embodiments.

FIG. 6D shows in more detail how the ion block assembly 802 according to various embodiments may be enclosed in an atmospheric pressure source or housing. The ion block assembly 802 may be mounted to a pumping block or thermal interface 600. Ions pass through the ion block assembly 802 and then through the pumping block or thermal interface 600 into a first vacuum chamber 601 of the mass spectrometer 100. The first vacuum chamber 601 preferably houses the first ion guide 301 which as shown in FIG. 6D and which may comprise a conjoined ring ion guide 301. FIG. 6D also indicates how ion entry 603 into the mass spectrometer 100 also represents a potential leak path. A correct pressure balance is required between the diameters of the various gas flow restriction apertures in the ion inlet assembly with the configuration of the vacuum pumping system.

Figure 6E:
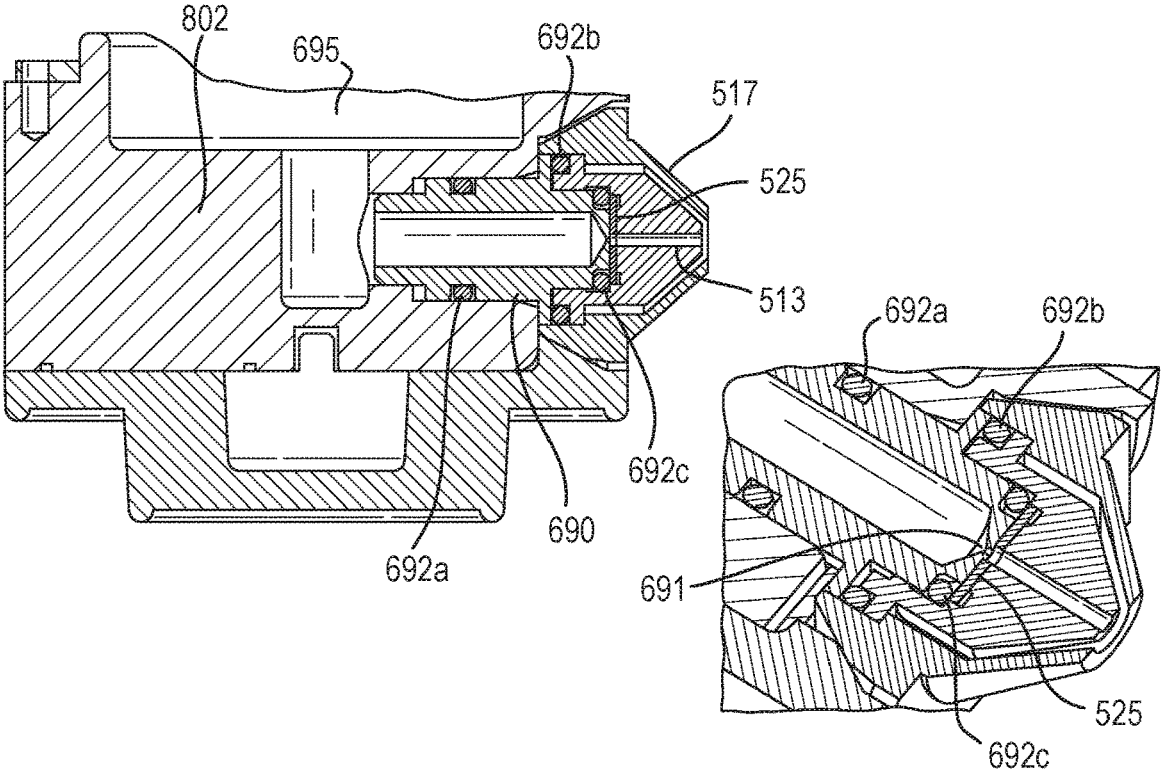
FIG. 6E shows in more detail a fixed valve assembly which is retained within an ion block according to various embodiments.

FIG. 6E shows the ion inlet assembly according to various embodiments and illustrates how ions pass through an outer gas cone 517 and an inner gas cone or sampling cone 513 before passing through an apertured disc 525. No mounting member or mounting element is provided unlike the first known ion inlet assembly as described above.

The ions then pass through an aperture in a fixed valve 690. The fixed valve 690 is held in place by suction pressure and is not removable by a user in normal operation. Three O-ring vacuum seals 692*a*,692*b*,692*c* are shown. The fixed valve 690 may be formed from stainless steel. A vacuum region 695 of the mass spectrometer 100 is generally indicated.

Figure 6F:
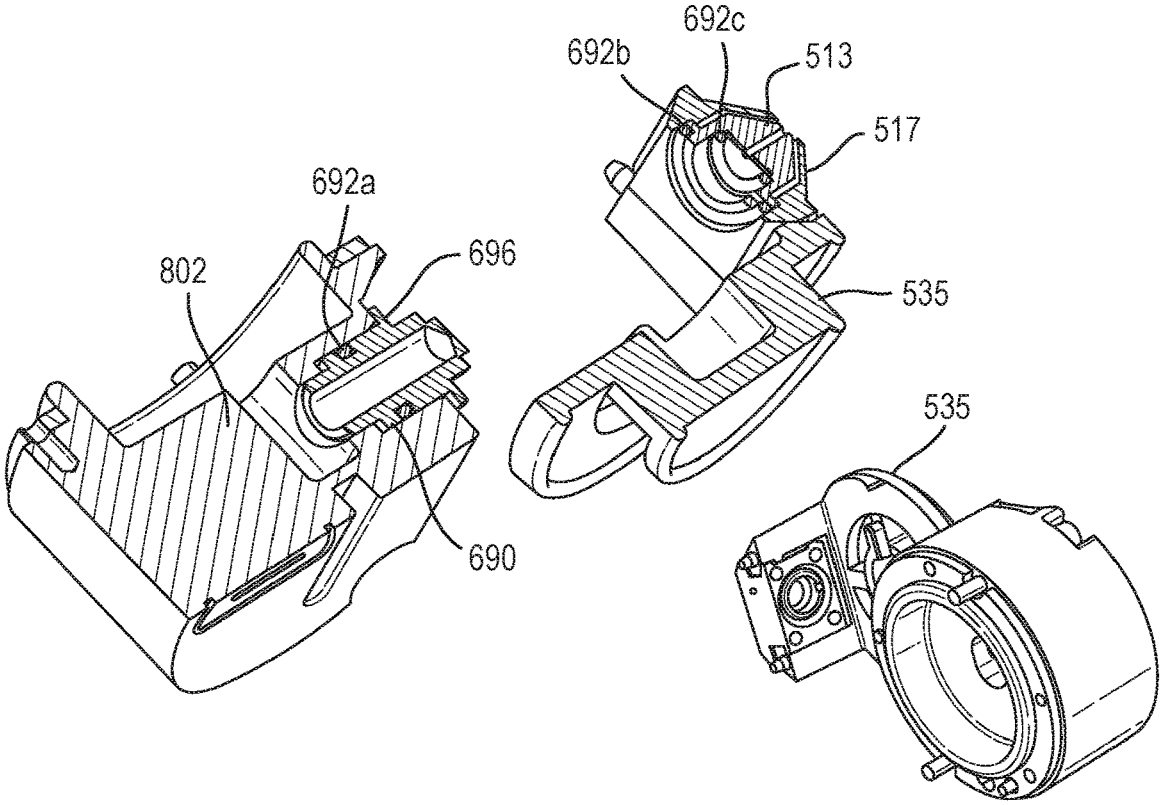
FIG. 6F shows the removal by a user of a cone assembly attached to a clamp to expose a fixed valve having a gas flow restriction aperture which is sufficient to maintain the low pressure within a downstream vacuum chamber when the cone is removed and FIG. 6G illustrates how the fixed valve may be retained in position by suction pressure according to various embodiments.

FIG. 6F shows the outer cone 517, inner sampling cone 513 and apertured disc 525 having been removed by a user by withdrawing or removing a clamp 535 to which at least the outer cone 517 is slidably inserted. According to various embodiments the inner sampling cone 513 may also be attached or secured to the outer cone 517 so that both are removed at the same time.

Instead of utilising a conventional rotatable isolation valve, a fixed non-rotatable valve 690 is provided or otherwise retained in the ion block 802. An O-ring seal 692*a* is shown which ensures that a vacuum seal is provided between the exterior body of the fixed valve 690 and the ion block 802. An ion block voltage contact 696 is also shown. O-rings seals 692*b*,692*c* for the inner and outer cones 513,517 are also shown.

Figure 6G:
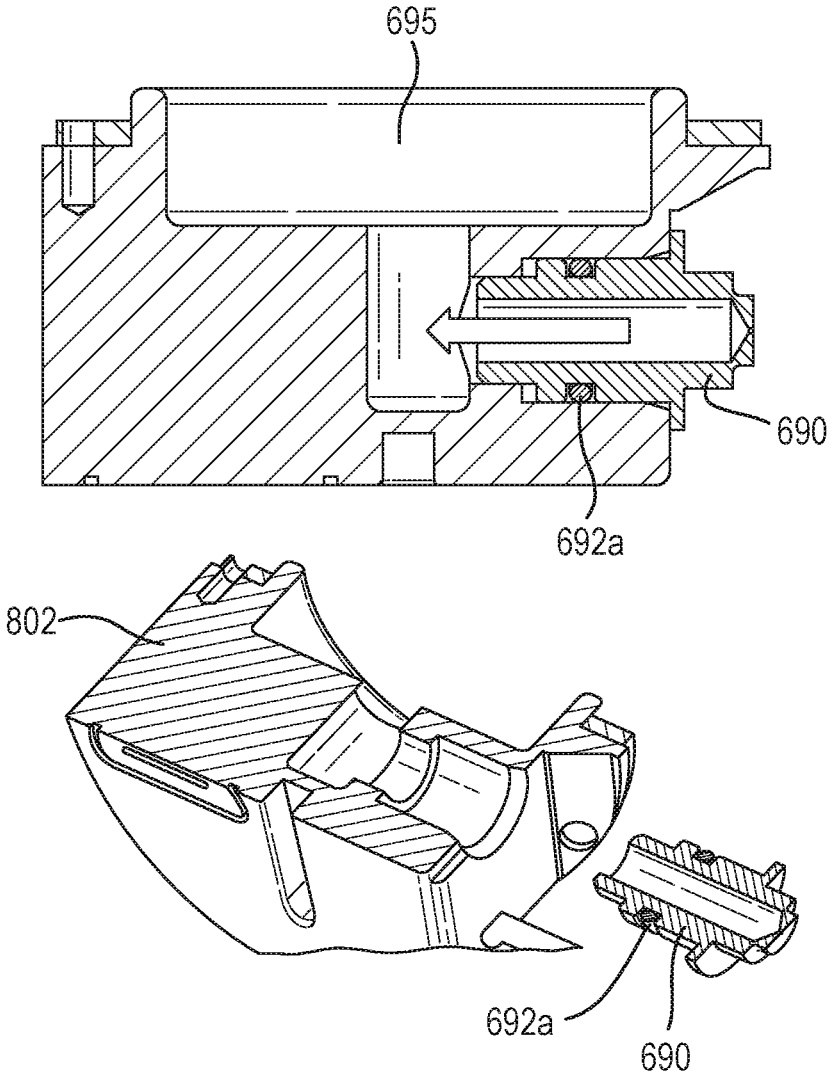

FIG. 6G illustrates how according to various embodiments a fixed valve 690 may be retained within an ion block 802 and may form a gas tight sealing therewith by virtue of an O-ring seal 692*a*. A user is unable to remove the fixed valve 690 from the ion block 802 when the instrument is operated due to the vacuum pressure within the vacuum chamber 695 of the instrument. The direction of suction force which holds the fixed valve 690 in a fixed position against the ion block 802 during normal operation is shown.

The size of the entrance aperture into the fixed valve 690 is designed for optimum operation conditions and component reliability. Various embodiments are contemplated wherein the shape of the entrance aperture may be cylindrical. However, other embodiments are contemplated wherein there may be more than one entrance aperture and/or wherein the one or more entrance apertures to the fixed valve 690 may have a non-circular aperture. Embodiments are also contemplated wherein the one or more entrance apertures may be angled at a non-zero angle to the longitudinal axis of the fixed valve 690.

It will be understood that total removal of the fixed valve 690 from the ion block 802 will rapidly result in total loss of vacuum pressure within the mass spectrometer 100.

According to various embodiments the ion inlet assembly may be temporarily sealed in order to allow a vacuum housing within the mass spectrometer 100 to be filled with dry nitrogen for shipping. It will be appreciated that filling a vacuum chamber with dry nitrogen allows faster initial pump-down during user initial instrument installation.

It will be appreciated that since according to various embodiments the internal aperture in the vacuum holding member or carrier 531 is substantially smaller in diameter than conventional arrangements, then the vacuum within the first and subsequent vacuum chambers of the instrument can be maintained for substantially longer periods of time than is possible conventionally when the disc 525 is removed and/or replaced.

Accordingly, the mass spectrometer 100 according to various embodiments does not require an isolation valve in contrast with other known mass spectrometers in order to maintain the vacuum within the instrument when a component such as the outer gas cone 517, the inner gas cone 513 or the disc 525 are removed.

A mass spectrometer 100 according to various embodiments therefore enables a reduced cost instrument to be provided which is also simpler for a user to operate since no isolation valve is needed. Furthermore, a user does not need to be understand or learn how to operate such an isolation valve.

The ion block assembly 802 may comprise a heater in order to keep the ion block 802 above ambient temperature in order to prevent droplets of analyte, solvent, neutral particles or condensation from forming within the ion block 802.

According to an embodiment when a user wishes to replace and/or remove either the outer cone 517 and/or the inner sampling cone 513 and/or the disc 525 then both the source or ion block heater and the desolvation heater 404 may be turned OFF. The temperature of the ion block 802 may be monitored by a thermocouple which may be provided within the ion block heater or which may be otherwise provided in or adjacent to the ion block 802.

When the temperature of the ion block is determined to have dropped below a certain temperature such as e.g. 55° C. then the user may be informed that the clamp 535, outer gas cone 517, inner gas sampling cone 513 and disc 525 are sufficiently cooled down such that a user can touch them without serious risk of injury.

According to various embodiment a user can simply remove and/or replace the outer gas cone 517 and/or inner gas sampling cone 513 and/or disc 525 in less than two minutes without needing to vent the instrument. In particular, the low pressure within the instrument is maintained for a sufficient period of time by the aperture in the fixed valve 690.

According to various embodiments the instrument may be arranged so that the maximum leak rate into the source or ion block 802 during sample cone maintenance is approx. 7 mbar Us. For example, assuming a backing pump speed of 9 $m^3$/hour (2.5 L/s) and a maximum acceptable pressure of 3 mbar, then the maximum leak rate during sampling cone maintenance may be approx. 2.5 L/s×3 mbar=7.5 mbar Us.

The ion block 802 may comprise an ion block heater having a K-type thermistor. As will be described in more detail below, according to various embodiments the source (ion block) heater may be disabled to allow forced cooling of the source or ion block 802. For example, desolvation heater 404 and/or ion block heater may be switched OFF whilst API gas is supplied to the ion block 802 in order to cool it down. According to various embodiments either a desolvation gas flow and/or a nebuliser gas flow from the probe 401 may be directed towards the cone region 517,513 of the ion block 802. Additionally and/or alternatively, the cone gas supply may be used to cool the ion block 802 and the inner and outer cones 513,517. In particular, by turning the desolvation heater 404 OFF but maintaining a supply of nebuliser and/or desolvation gas from the probe 401 so as to fill the enclosure housing the ion block with ambient temperature nitrogen or other gas will have a rapid cooling effect upon the metal and plastic components forming the ion inlet assembly which may be touched by a user during servicing. Ambient temperature (e.g. in the range 18-25° C.) cone gas may also be supplied in order to assist with cooling the ion inlet assembly in a rapid manner. Conventional instruments do not have the functionality to induce rapid cooling of the ion block 802 and gas cones 521,513.

Liquid and gaseous exhaust from the source enclosure may be fed into a trap bottle. The drain tubing may be routed so as to avoid electronic components and wiring. The instrument may be arranged so that liquid in the source enclosure always drains out even when the instrument is switched OFF. For example, it will be understood that an LC flow into the source enclosure could be present at any time.

An exhaust check valve may be provided so that when the API gas is turned OFF the exhaust check valve prevents a vacuum from forming in the source enclosure and trap bottle. The exhaust trap bottle may have a capacity 5L.

The fluidics system may comprise a piston pump which allows the automated introduction of a set-up solution into the ion source. The piston pump may have a flow rate range of 0.4 to 50 mL/min. A divert/select valve may be provided which allows rapid automated changeover between LC flow and the flow of one or two internal set-up solutions into the source.

According to various embodiments three solvent bottles 201 may be provided. Solvent A bottle may have a capacity within the range 250-300 mL, solvent B bottle may have a capacity within the range 50-60 mL and solvent C bottle may have a capacity within the range 100-125 mL. The solvent bottles 201 may be readily observable by a user who may easily refill the solvent bottles.

According to an embodiment solvent A may comprise a lock-mass, solvent B may comprise a calibrant and solvent C may comprise a wash. Solvent C (wash) may be connected to a rinse port.

A driver PCB may be provided in order to control the piston pump and the divert/select valve. On power-up the piston pump may be homed and various purge parameters may be set.

Fluidics may be controlled by software and may be enabled as a function of the instrument state and the API gas valve state in a manner as detailed below:

| Instrument state | API gas valve | Software control of fluidics |
|---|---|---|
| Operate | Open | Enabled |
| Operate | Closed | Disabled |
| Over-pressure | Open | Enabled |
| Over-pressure | Closed | Disabled |
| Power Save | Open | Disabled |
| Power Save | Closed | Disabled |

When software control of the fluidics is disabled then the valve is set to a divert position and the pump is stopped.

Figure 7A:
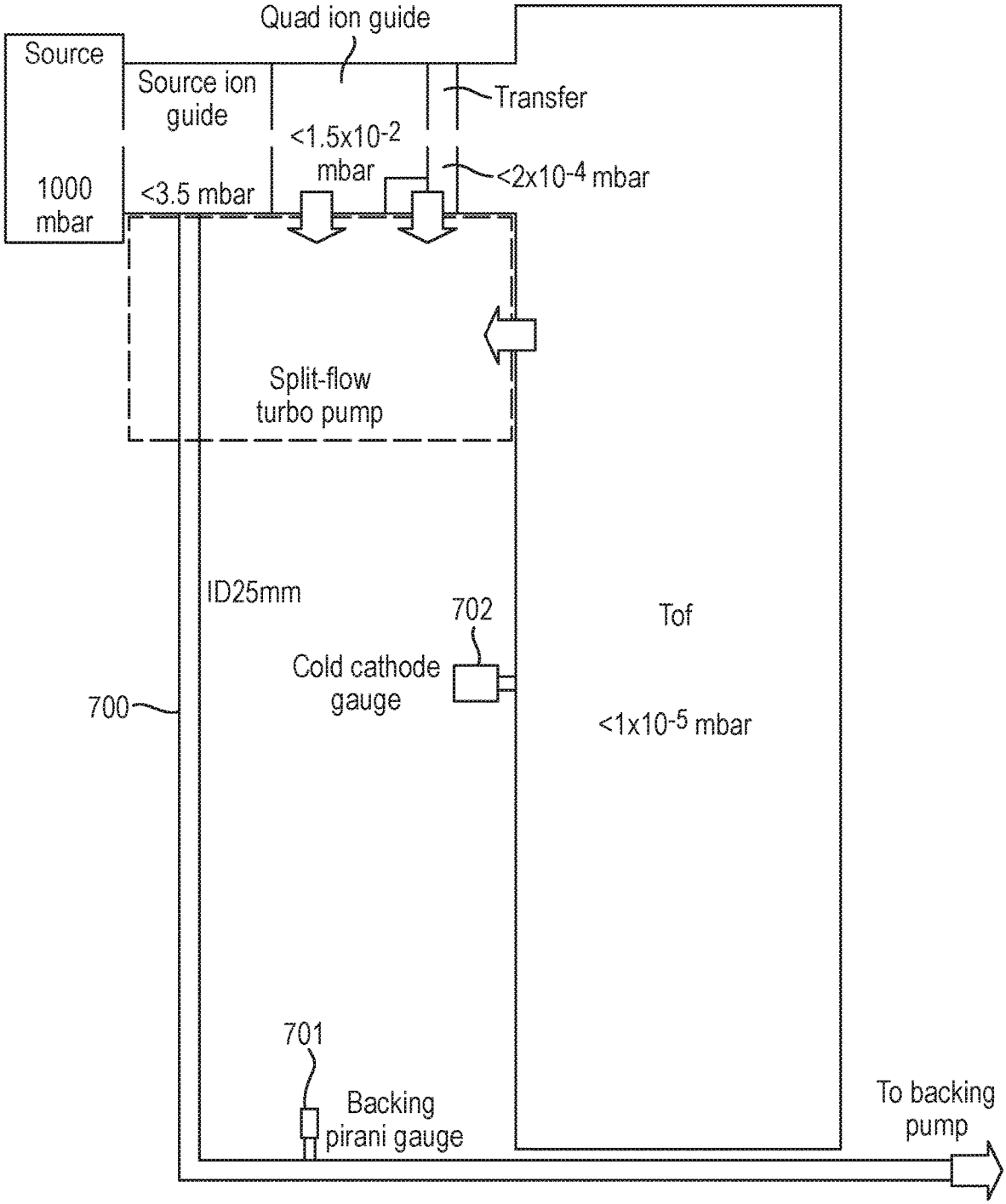
FIG. 7A shows a pumping arrangement according to various embodiments.

FIG. 7A illustrates a vacuum pumping arrangement according to various embodiments.

A split-flow turbo molecular vacuum pump (commonly referred to as a "turbo" pump) may be used to pump the fourth or further vacuum chamber or fourth or further differential pumping region, the third vacuum chamber or third differential pumping region, and the second vacuum chamber or second differential pumping region. According to an embodiment the turbo pump may comprise either a Pfeiffer® Splitflow 310 fitted with a TC110 controller or an Edwards® nEXT300/100/100D turbo pump. The turbo pump may be air cooled by a cooling fan.

The turbo molecular vacuum pump may be backed by a rough, roughing or backing pump such as a rotary vane vacuum pump or a diaphragm vacuum pump. The rough, roughing or backing pump may also be used to pump the first vacuum chamber housing the first ion guide 301. The rough, roughing or backing pump may comprise an Edwards® nRV14i backing pump. The backing pump may be provided external to the instrument and may be connected to the first vacuum chamber which houses the first ion guide 301 via a backing line 700 as shown in FIG. 7A.

A first pressure gauge such as a cold cathode gauge 702 may be arranged and adapted to monitor the pressure of the fourth or further vacuum chamber or fourth or further differential pumping region. According to an embodiment the Time of Flight housing pressure may be monitored by an Inficon® MAG500 cold cathode gauge 702.

A second pressure gauge such as a Pirani gauge 701 may be arranged and adapted to monitor the pressure of the backing pump line 700 and hence the first vacuum chamber which is in fluid communication with the upstream pumping block 600 and ion block 802. According to an embodiment the instrument backing pressure may be monitored by an Inficon® PSG500 Pirani gauge 701.

According to various embodiments the observed leak plus outgassing rate of the Time of Flight chamber may be arranged to be less than $4\times10^{-5}$ mbar L/s. Assuming a 200 L/s effective turbo pumping speed then the allowable leak plus outgassing rate is $5\times10^{-7}$ mbar×200 L/s=$1\times10^{-4}$ mbar Us.

A turbo pump such as an Edwards® nEXT300/100/100D turbo pump may be used which has a main port pumping speed of 400 L/s. As will be detailed in more detail below, EMC shielding measures may reduce the pumping speed by approx. 20% so that the effective pumping speed is 320 L/s.

Accordingly, the ultimate vacuum according to various embodiments may be $4\times10^{-5}$ mbar L/s/320 L/s=$1.25\times10^{-7}$ mbar.

Figure 7B:
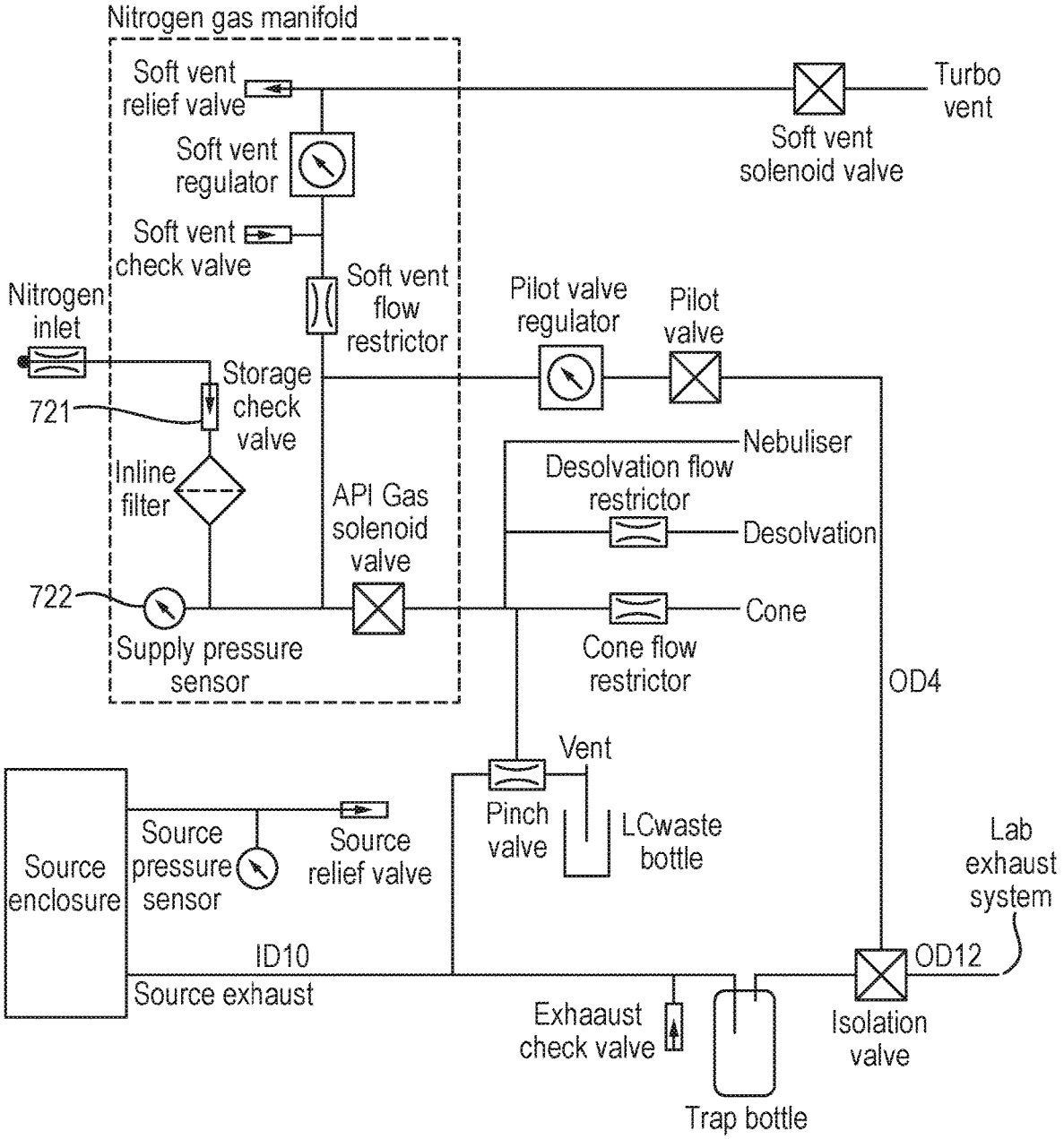
FIG. 7B shows further details of a gas handling system which may be implemented.

According to an embodiment a pump-down sequence may comprise closing a soft vent solenoid as shown in FIG. 7B, starting the backing pump and waiting until the backing pressure drops to 32 mbar. If 32 mbar is not reached within 3 minutes of starting the backing pump then a vent sequence may be performed. Assuming that a pressure of 32 mbar is reached within 3 minutes then the turbo pump is then started. When the turbo speed exceeds 80% of maximum speed then the Time of Flight vacuum gauge 702 may then be switched ON. It will be understood that the vacuum gauge 702 is a sensitive detector and hence is only switched ON when the vacuum pressure is such that the vacuum gauge 702 which not be damaged.

If the turbo speed does not reach 80% of maximum speed within 8 minutes then a vent sequence may be performed.

A pump-down sequence may be deemed completed once the Time of Flight vacuum chamber pressure is determined to be $<1\times10^{-5}$ mbar.

If a vent sequence is to be performed then the instrument may be switched to a Standby mode of operation. The Time of Flight vacuum gauge 702 may be switched OFF and the turbo pump may also be switched OFF. When the turbo pump speed falls to less than 80% of maximum then a soft vent solenoid valve as shown in FIG. 7B may be opened. The system may then wait for 10 seconds before then switching OFF the backing pump.

It will be understood by those skilled in the art that the purpose of the turbo soft vent solenoid valve as shown in FIG. 7B and the soft vent line is to enable the turbo pump to be vented at a controlled rate. It will be understood that if the turbo pump is vented at too fast a rate then the turbo pump may be damaged.

The instrument may switch into a maintenance mode of operation which allows an engineer to perform service work on all instrument sub-systems except for the vacuum system or a subsystem incorporating the vacuum system without having to vent the instrument. The instrument may be pumped down in maintenance mode and conversely the instrument may also be vented in maintenance mode.

A vacuum system protection mechanism may be provided wherein if the turbo speed falls to less than 80% of maximum speed then a vent sequence is initiated. Similarly, if the backing pressure increases to greater than 10 mbar then a vent sequence may also be initiated. According to an embodiment if the turbo power exceeds 120 W for more than 15 minutes then a vent sequence may also be initiated. If on instrument power-up the turbo pump speed is >80% of maximum then the instrument may be set to a pumped state, otherwise the instrument may be set to a venting state.

FIG. 7B shows a schematic of a gas handling system which may be utilised according to various embodiments. A storage check valve 721 may be provided which allows the instrument to be filled with nitrogen for storage and transport. The storage check valve 721 is in fluid communication with an inline filter.

A soft vent flow restrictor may be provided which may limit the maximum gas flow to less than the capacity of a soft vent relief valve in order to prevent the analyser pressure from exceeding 0.5 bar in a single fault condition. The soft vent flow restrictor may comprise an orifice having a diameter in the range 0.70 to 0.75 mm.

A supply pressure sensor 722 may be provided which may indicate if the nitrogen pressure has fallen below 4 bar.

An API gas solenoid valve may be provided which is normally closed and which has an aperture diameter of not less than 1.4 mm.

An API gas inlet is shown which preferably comprises a Nitrogen gas inlet. According to various embodiments the nebuliser gas, desolvation gas and cone gas are all supplied from a common source of nitrogen gas.

A soft vent regulator may be provided which may function to prevent the analyser pressure exceeding 0.5 bar in normal condition.

A soft vent check valve may be provided which may allow the instrument to vent to atmosphere in the event that the nitrogen supply is OFF.

A soft vent relief valve may be provided which may have a cracking pressure of 345 mbar. The soft vent relief valve may function to prevent the pressure in the analyser from exceeding 0.5 bar in a single fault condition. The gas flow rate through the soft vent relief valve may be arranged so as not to be less than 2000 L/h at a differential pressure of 0.5 bar.

The soft vent solenoid valve may normally be in an open position. The soft vent solenoid valve may be arranged to restrict the gas flow rate in order to allow venting of the turbo pump at 100% rotational speed without causing damage to the pump. The maximum orifice diameter may be 1.0 mm.

The maximum nitrogen flow may be restricted such that in the event of a catastrophic failure of the gas handling the maximum leak rate of nitrogen into the lab should be less than 20% of the maximum safe flow rate. According to various embodiments an orifice having a diameter of 1.4 to 1.45 mm may be used.

A source pressure sensor may be provided.

A source relief valve having a cracking pressure of 345 mbar may be provided. The source relief valve may be arranged to prevent the pressure in the source from exceeding 0.5 bar in a single fault condition. The gas flow rate through the source relief valve may be arranged so as not to be less than 2000 L/h at a differential pumping pressure of 0.5 bar. A suitable valve is a Ham-Let® H-480-S-G-1/4-5 psi valve.

A cone restrictor may be provided to restrict the cone flow rate to 36 L/hour for an input pressure of 7 bar. The cone restrictor may comprise a 0.114 mm orifice.

The desolvation flow may be restricted by a desolvation flow restrictor to a flow rate of 940 L/hour for an input pressure of 7 bar. The desolvation flow restrictor may comprise a 0.58 mm orifice.

A pinch valve may be provided which has a pilot operating pressure range of at least 4 to 7 bar gauge. The pinch valve may normally be open and may have a maximum inlet operating pressure of at least 0.5 bar gauge.

When the instrument is requested to turn the API gas OFF, then control software may close the API gas valve, wait 2 seconds and then close the source exhaust valve.

In the event of an API gas failure wherein the pressure switch opens (pressure <4 bar) then software control of the API gas may be disabled and the API gas valve may be closed. The system may then wait 2 seconds before closing the exhaust valve.

In order to turn the API gas ON a source pressure monitor may be turned ON except while a source pressure test is performed. An API gas ON or OFF request from software may be stored as an API Gas Request state which can either be ON or OFF. Further details are presented below:

| API Gas Request state | API Gas Control state | API gas valve |
|---|---|---|
| ON | Enabled | Open |
| ON | Disabled | Closed |
| OFF | Enabled | Closed |
| OFF | Disabled | Closed |

Figure 7C:
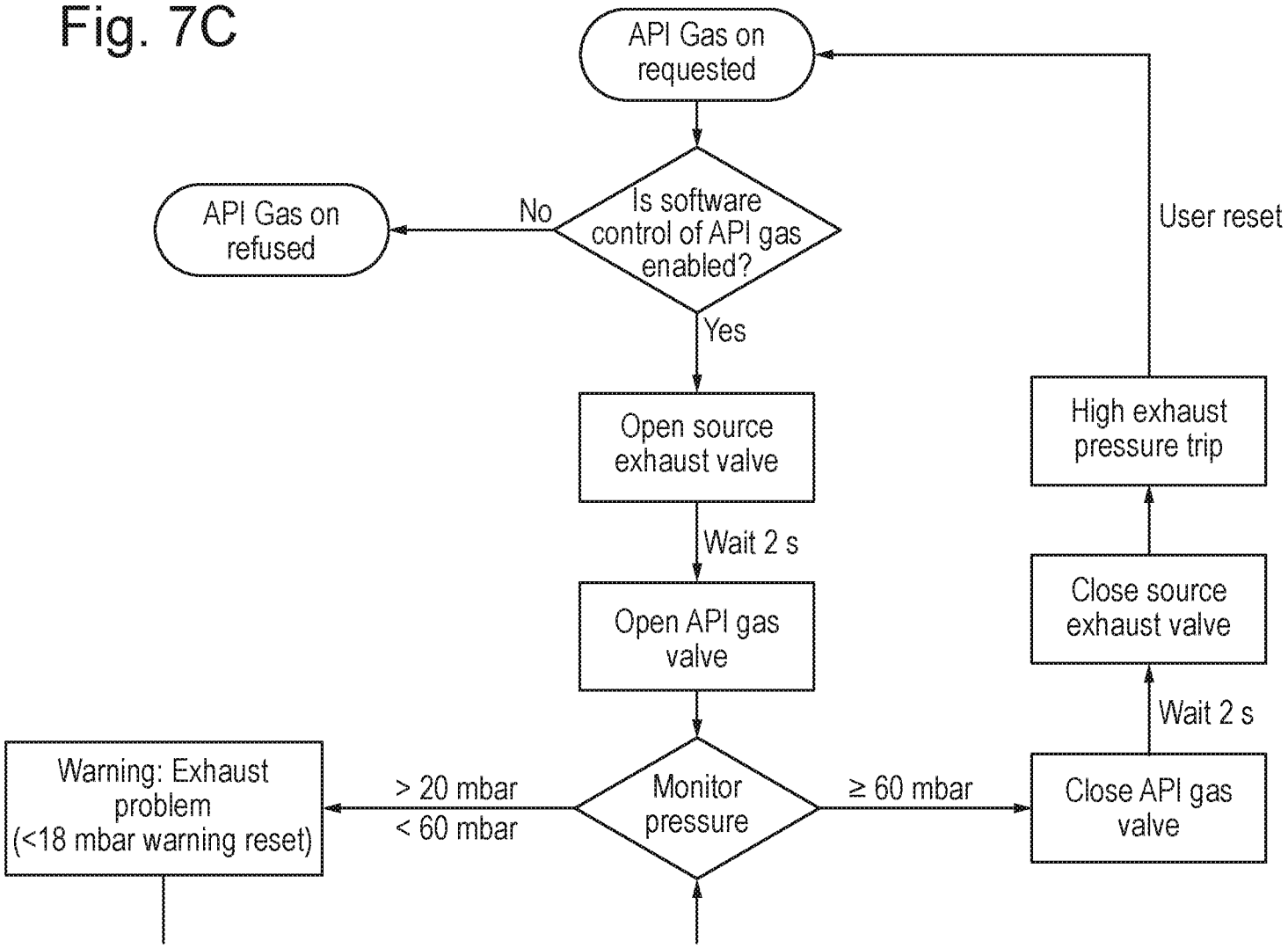
FIG. 7C shows a flow diagram illustrating the steps which may be performed following a user request to the turn the Atmospheric Pressure Ionisation ("API") gas ON and FIG. 7D shows a flow chart illustrating a source pressure test which may be performed according to various embodiments.

FIG. 7C shows a flow diagram showing an instrument response to a user request to turn the API gas ON. A determination may be made as to whether or not software control of API gas is enabled. If software control is not enabled then the request may be refused. If software control of API gas is enabled then the open source exhaust valve may be opened. Then after a delay of 2 seconds the API gas valve may be opened. The pressure is then monitored. If the pressure is determined to be between 20-60 mbar then a warning message may be communicated or issued. If the pressure is greater than 60 mbar then then the API gas valve may be closed. Then after a delay of 2 seconds the source exhaust valve may be closed and a high exhaust pressure trip may occur.

A high exhaust pressure trip may be reset by running a source pressure test.

According to various embodiments the API gas valve may be closed within 100 ms of an excess pressure being sensed by the source pressure sensor.

Figure 7D:
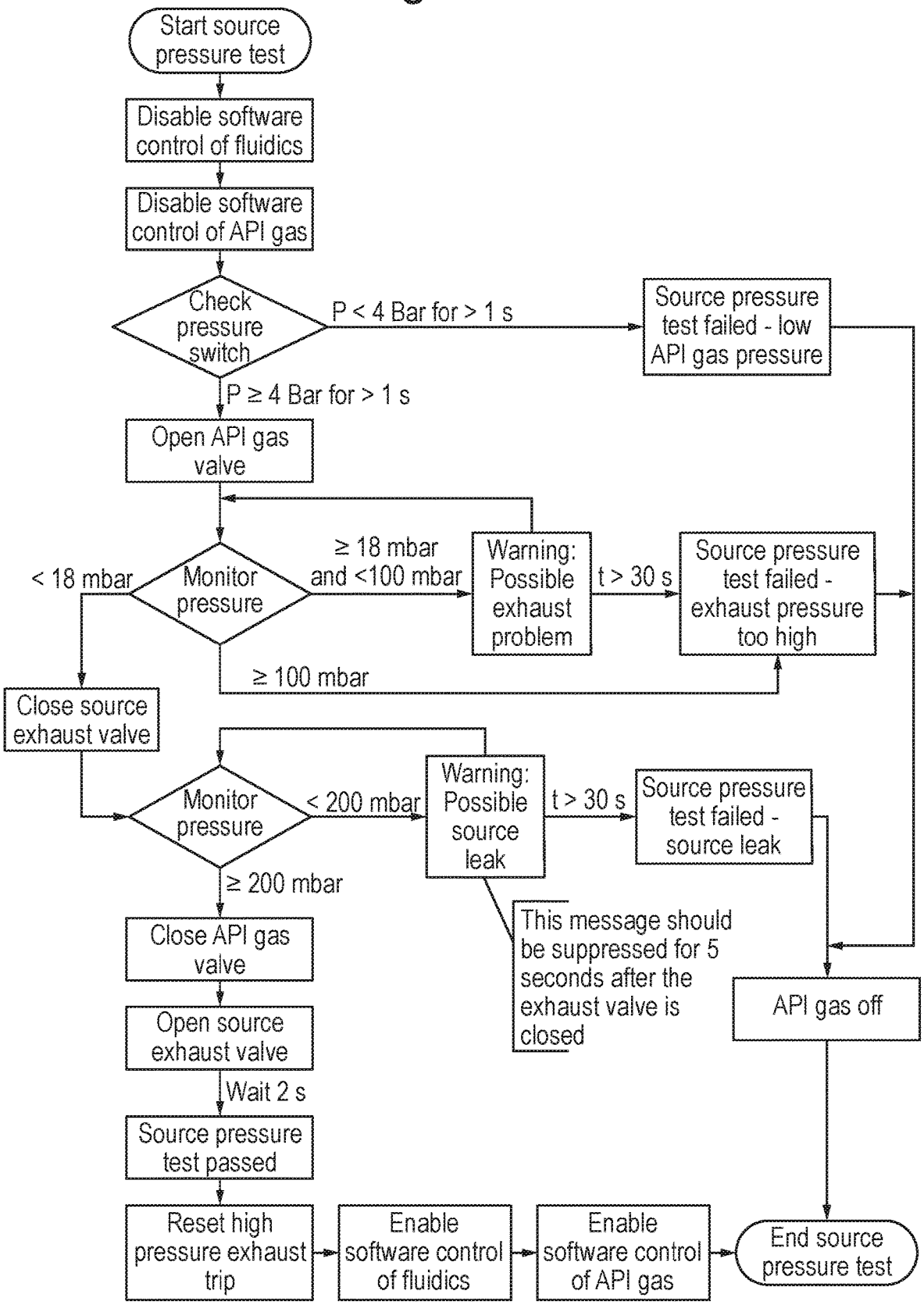

FIG. 7D shows a flow diagram illustrating a source pressure test which may be performed according to various embodiments. The source pressure test may be commenced and software control of fluidics may be disabled so that no fluid flows into the Electrospray probe 401. Software control of the API gas may also be disabled i.e. the API is turned OFF. The pressure switch may then be checked. If the pressure is above 4 bar for more than 1 second then the API gas valve may be opened. However, if the pressure is less than 4 bar for more than 1 second then the source pressure test may move to a failed state due to low API gas pressure.

Assuming that the API gas valve is opened then the pressure may then be monitored. If the pressure is in the range 18-100 mbar then a warning message may be output indicating a possible exhaust problem. If the warning status continues for more than 30 seconds then the system may conclude that the source pressure test has failed due to the exhaust pressure being too high.

If the monitored pressure is determined to be less than 18 mbar then the source exhaust valve is closed.

The pressure may then again be monitored. If the pressure is less than 200 mbar then a warning message indicating a possible source leak may be issued.

If the pressure is determined to be greater than 200 mbar then the API gas valve may be closed and the source exhaust valve may be opened i.e. the system looks to build pressure and to test for leaks. The system may then wait 2 seconds before determining that the source pressure test is passed.

If the source pressure test has been determined to have been passed then the high pressure exhaust trip may be reset and software control of fluidics may be enabled. Software control of the API gas may then be enabled and the source pressure test may then be concluded.

According to various embodiments the API gas valve may be closed within 100 ms of an excess pressure being sensed by the source pressure sensor.

In the event of a source pressure test failure, the divert valve position may be set to divert and the valve may be kept in this position until the source pressure test is either passed or the test is over-ridden.

It is contemplated that the source pressure test may be over-ridden in certain circumstances. Accordingly, a user may be permitted to continue to use an instrument where they have assessed any potential risk as being acceptable. If the user is permitted to continue using the instrument then the source pressure test status message may still be displayed in order to show the original failure. As a result, a user may be reminded of the continuing failed status so that the user may continually re-evaluate any potential risk.

In the event that a user requests a source pressure test over-ride then the system may reset a high pressure exhaust trip and then enable software control of the divert valve. The system may then enable software control of the API gas before determining that the source pressure test over-ride is complete.

The pressure reading used in the source pressure test and source pressure monitoring may include a zero offset correction.

The gas and fluidics control responsibility may be summarised as detailed below:

| Mode of operation | Software | Electronics |
|---|---|---|
| Operate | Gas and fluidics | None |
| Power save | Gas | Fluidics |
| Standby | Gas | Fluidics |
| SPT/Failure | None | Gas and fluidics |
| Vacuum loss | None | Gas and fluidics |
| Gas fail state | None | Gas and fluidics |
| Operate gas OFF | Gas | Fluidics |

A pressure test may be initiated if a user triggers an interlock.

The instrument may operate in various different modes of operation. If the turbo pump speed falls to less than 80% of maximum speed whilst in Operate, Over-pressure or Power save mode then the instrument may enter a Standby state or mode of operation.

If the pressure in the Time of Flight vacuum chamber is greater than $1\times10^{-5}$ mbar and/or the turbo speed is less than 80% of maximum speed then the instrument may be prevented from operating in an Operate mode of operation.

According to various embodiments the instrument may be operated in a Power save mode. In a Power save mode of operation the piston pump may be stopped. If the instrument is switched into a Power save mode while the divert valve is in the LC position, then the divert valve may change to a divert position. A Power save mode of operation may be considered as being a default mode of operation wherein all back voltages are kept ON, front voltages are turned OFF and gas is OFF.

If the instrument switches from a Power save mode of operation to an Operate mode of operation then the piston pump divert valves may be returned to their previous states i.e. their states immediately before a Power save mode of operation was entered.

If the Time of Flight region pressure rises above $1.5\times10^{-5}$ mbar while the instrument is in an Operate mode of operation then the instrument may enter an Over-pressure mode of operation or state.

If the Time of Flight pressure enters the range $1\times10^{-8}$ to $1\times10^{-5}$ mbar while the instrument is in an Over-pressure mode of operation then the instrument may enter an Operate mode of operation.

If the API gas pressure falls below its trip level while the instrument is in an Operate mode of operation then the instrument may enter a Gas Fail state or mode of operation.

The instrument may remain in a Gas Fail state until both: (i) the API gas pressure is above its trip level; and (ii) the instrument is operated in either Standby or Power save mode.

According to an embodiment the instrument may transition from an Operate mode of operation to an Operate with Source Interlock Open mode of operation when the source cover is opened. Similarly, the instrument may transition from an Operate with Source Interlock Open mode of operation to an Operate mode of operation when the source cover is closed.

According to an embodiment the instrument may transition from an Over-pressure mode of operation to an Over-pressure with Source Interlock Open mode of operation when the source cover is opened. Similarly, the instrument may transition from an Over-pressure with Source Interlock Open mode of operation to an Over-pressure mode of operation when the source cover is closed.

The instrument may operate in a number of different modes of operation which may be summarised as follows:

| Mode of operation | Analyser voltages | Front end voltages | Desolvation heater | Source heater | API gas control state |
|---|---|---|---|---|---|
| Standby | OFF | OFF | OFF | ON | Enabled |
| Operate | ON | ON | ON | ON | Enabled |
| Power Save | ON | OFF | OFF | ON | Enabled |
| Over-pressure | OFF | ON | ON | ON | Enabled |
| Gas Fail | ON | OFF | OFF | ON | Disabled |
| Operate with Source Interlock | ON | OFF | OFF | OFF | Disabled |
| Over-pressure with Source interlock | OFF | OFF | OFF | OFF | Disabled |
| Not Pumped | OFF | OFF | OFF | OFF | Enabled |

Reference to front end voltages relates to voltages which are applied to the Electrospray capillary electrode 402, the source offset, the source or first ion guide 301, aperture #1 (see FIG. 15A) and the quadrupole ion guide 302.

Reference to analyser voltages relates to all high voltages except the front end voltages.

Reference to API gas refers to desolvation, cone and nebuliser gases.

Reference to Not Pumped refers to all vacuum states except pumped.

If any high voltage power supply loses communication with the overall system or a global circuitry control module then the high voltage power supply may be arranged to switch OFF its high voltages. The global circuitry control module may be arranged to detect the loss of communication of any subsystem such as a power supply unit ("PSU"), a pump or gauge etc.

According to various embodiments the system will not indicate its state or mode of operation as being Standby if the system is unable to verify that all subsystems are in a Standby state.

As is apparent from the above table, when the instrument is operated in an Operate mode of operation then all voltages are switched ON. When the instrument transitions to operate in an Operate mode of operation then the following voltages are ON namely transfer lens voltages, ion guide voltages, voltages applied to the first ion guide 301 and the capillary electrode 402. In addition, the desolvation gas and desolvation heater are all ON.

If a serious fault were to develop then the instrument may switch to a Standby mode of operation wherein all voltages apart from the source heater provided in the ion block 802 are turned OFF and only a service engineer can resolve the fault. It will be understood that the instrument may only be put into a Standby mode of operation wherein voltages apart from the source heater in the ion block 802 are turned OFF only if a serious fault occurs or if a service engineer specifies that the instrument should be put into a Standby mode operation. A user or customer may (or may not) be able to place an instrument into a Standby mode of operation. Accordingly, in a Standby mode of operation all voltages are OFF and the desolvation gas flow and desolvation heater 404 are all OFF. Only the source heater in the ion block 802 may be left ON.

The instrument may be kept in a Power Save mode by default and may be switched so as to operate in an Operate mode of operation wherein all the relevant voltages and gas flows are turned ON. This approach significantly reduces the time taken for the instrument to be put into a useable state. When the instrument transitions to a Power Save mode of operation then the following voltages are ON—pusher electrode 305, reflectron 306, ion detector 307 and more generally the various Time of Flight mass analyser 304 voltages.

The stability of the power supplies for the Time of Flight mass analyser 304, ion detector 307 and reflectron 306 can affect the mass accuracy of the instrument. The settling time when turning ON or switching polarity on a known conventional instrument is around 20 minutes.

It has been established that if the power supplies are cold or have been left OFF for a prolonged period of time then they may require up to 10 hours to warm up and stabilise. For this reason customers may be prevented from going into a Standby mode of operation which would switch OFF the voltages to the Time of Flight analyser 304 including the reflectron 306 and ion detector 307 power supplies.

On start-up the instrument may move to a Power save mode of operation as quickly as possible as this allows the power supplies the time they need to warm up whilst the instrument is pumping down. As a result, by the time the instrument has reached the required pressure to carry out instrument setup the power supplies will have stabilised thus reducing any concerns relating to mass accuracy.

According to various embodiments in the event of a vacuum failure in the vacuum chamber housing the Time of Flight mass analyser 304 then power may be shut down or turned OFF to all the peripherals or sub-modules e.g. the ion source 300, first ion guide 301, the segmented quadrupole rod set ion guide 302, the transfer optics 303, the pusher electrode 305 high voltage supply, the reflectron 306 high voltage supply and the ion detector 307 high voltage supply. The voltages are primarily all turned OFF for reasons of instrument protection and in particular protecting sensitive components of the Time of Flight mass analyser 307 from high voltage discharge damage.

It will be understood that high voltages may be applied to closely spaced electrodes in the Time of Flight mass analyser 304 on the assumption that the operating pressure will be very low and hence there will be no risk of sparking or electrical discharge effects. Accordingly, in the event of a serious vacuum failure in the vacuum chamber housing the Time of Flight mass analyser 304 then the instrument may remove power or switch power OFF to the following modules or sub-modules: (i) the ion source high voltage supply module; (ii) the first ion guide 301 voltage supply module; (iii) the quadrupole ion guide 302 voltage supply module; (iv) the high voltage pusher electrode 305 supply module;

(v) the high voltage reflectron 306 voltage supply module; and (vi) the high voltage detector 307 module. The instrument protection mode of operation is different to a Standby mode of operation wherein electrical power is still supplied to various power supplies or modules or sub-modules. In contrast, in an instrument protection mode of operation power is removed to the various power supply modules by the action of a global circuitry control module. Accordingly, if one of the power supply modules were faulty it would still be unable in a fault condition to turn voltages ON because the module would be denied power by the global circuitry control module.

Figure 8:
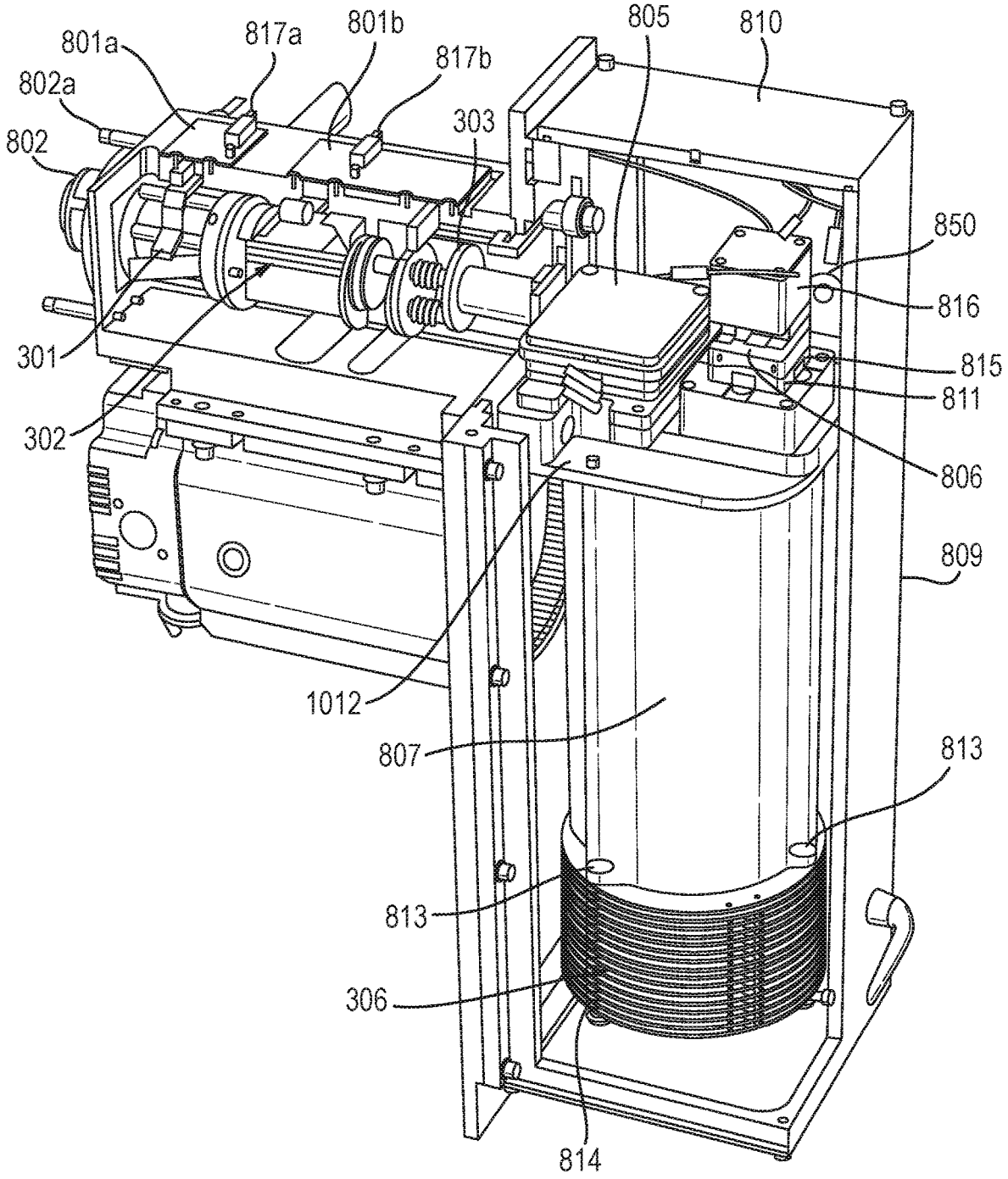
FIG. 8 shows in more detail a mass spectrometer according to various embodiments.

FIG. 8 shows a view of a mass spectrometer 100 according to various embodiments in more detail. The mass spectrometer 100 may comprise a first vacuum PCB interface 801*a* having a first connector 817*a* for directly connecting the first vacuum interface PCB 801*a* to a first local control circuitry module (not shown) and a second vacuum PCB interface 801*b* having a second connector 817*b* for directly connecting the second vacuum interface PCB 801*b* to a second local control circuitry module (not shown).

The mass spectrometer 100 may further comprise a pumping or ion block 802 which is mounted to a pumping block or thermal isolation stage (not viewable in FIG. 8). According to various embodiments one or more dowels or projections 802*a* may be provided which enable a source enclosure (not shown) to connect to and secure over and house the ion block 802. The source enclosure may serve the purpose of preventing a user from inadvertently coming into contact with any high voltages associated with the Electrospray probe 402. A micro-switch or other form of interlock may be used to detect opening of the source enclosure by a user in order to gain source access whereupon high voltages to the ion source 402 may then be turned OFF for user safety reasons.

Ions are transmitted via an initial or first ion guide 301, which may comprise a conjoined ring ion guide, and then via a segmented quadrupole rod set ion guide 302 to a transfer lens or transfer optics arrangement 303. The transfer optics 303 may be designed in order to provide a highly efficient ion guide and interface into the Time of Flight mass analyser 304 whilst also reducing manufacturing costs.

Ions may be transmitted via the transfer optics 303 so that the ions arrive in a pusher electrode assembly 305. The pusher electrode assembly 305 may also be designed so as to provide high performance whilst at the same time reducing manufacturing costs.

According to various embodiments a cantilevered Time of Flight stack 807 may be provided. The cantilevered arrangement may be used to mount a Time of Flight stack or flight tube 807 and has the advantage of both thermally and electrically isolating the Time of Flight stack or flight tube 807. The cantilevered arrangement represents a significant design deparature from conventional instruments and results in substantial improvements in instrument performance.

According to an embodiment an alumina ceramic spacer and a plastic (PEEK) dowel may be used.

According to an embodiment when a lock mass is introduced and the instrument is calibrated then the Time of Flight stack or flight tube 807 will not be subjected to thermal expansion. The cantilevered arrangement according to various embodiments is in contrast to known arrangements wherein both the reflectron 306 and the pusher assembly 305 were mounted to both ends of a side flange. As a result conventional arrangements were subjected to thermal impact.

Ions may be arranged to pass into a flight tube 807 and may be reflected by a reflectron 306 towards an ion detector 811. The output from the ion detector 811 is passed to a pre-amplifier (not shown) and then to an Analogue to Digital Converter ("ADC") (also not shown). The reflectron 306 is preferably designed so as to provide high performance whilst also reducing manufacturing cost and improving reliability.

As shown in FIG. 8 the various electrode rings and spacers which collectively form the reflectron subassembly may be mounted to a plurality of PEEK support rods 814. The reflectron subassembly may then be clamped to the flight tube 807 using one or more cotter pins 813. As a result, the components of the reflectron subassembly are held under compression which enables the individual electrodes forming the reflectron to be maintained parallel to each other with a high level of precision. According to various embodiments the components may be held under spring loaded compression.

The pusher electrode assembly 305 and the detector electronics or a discrete detector module may be mounted to a common pusher plate assembly 1012. This is described in more detail below with reference to FIGS. 10A-10C.

The Time of Flight mass analyser 304 may have a full length cover 809 which may be readily removed enabling extensive service access. The full length cover 809 may be held in place by a plurality of screws e.g. 5 screws. A service engineer may undo the five screws in order to expose the full length of the time of flight tube 807 and the reflectron 306.

The mass analyser 304 may further comprise a removable lid 810 for quick service access. In particular, the removable lid 810 may provide access to a service engineer so that the service engineer can replace an entrance plate 1000 as shown in FIG. 100. In particular, the entrance plate 1000 may become contaminated due to ions impacting upon the surface of the entrance plate 1000 resulting in surface charging effects and potentially reducing the efficiency of ion transfer from the transfer optics 303 into a pusher region adjacent the pusher electrode 305.

A SMA (SubMiniature version A) connector or housing 850 is shown but an AC coupler 851 is obscured from view.

Figure 9:
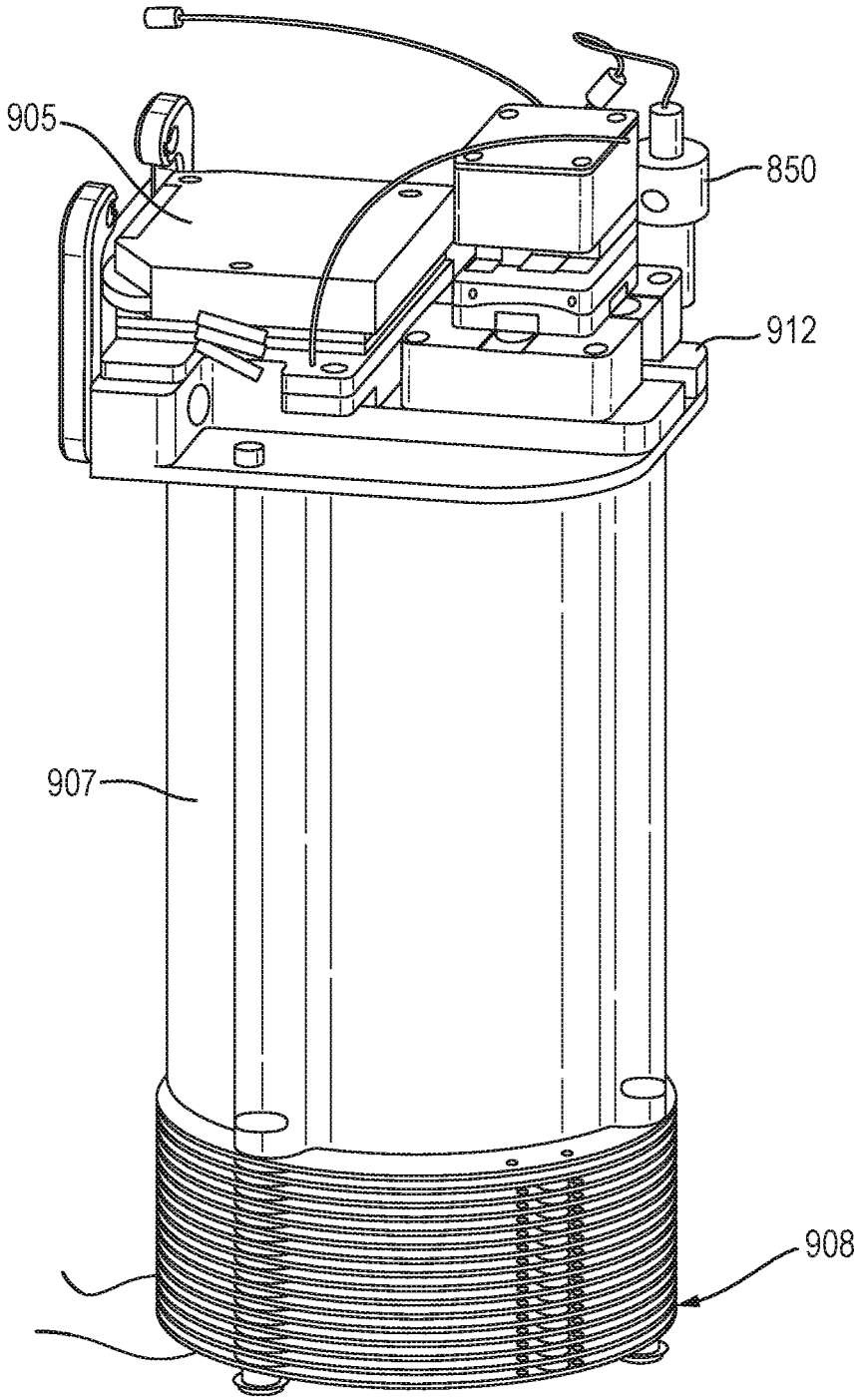
FIG. 9 shows a Time of Flight mass analyser assembly comprising a pusher plate assembly having mounted thereto a pusher electronics module and an ion detector module and wherein a reflectron assembly is suspended from an extruded flight tube which in turn is suspended from the pusher plate assembly.

FIG. 9 shows a pusher plate assembly 912, flight tube 907 and reflectron stack 908. A pusher assembly 905 having a pusher shielding cover is also shown. The flight tube 907 may comprise an extruded or plastic flight tube. The reflectron 306 may utilise fewer ceramic components than conventional reflectron assemblies thereby reducing manufacturing cost. According to various embodiments the reflectron 306 may make greater use of PEEK compared with conventional reflectron arrangements.

A SMA (SubMiniature version A) connector or housing 850 is shown but an AC coupler 851 is obscured from view.

According to other embodiments the reflectron 306 may comprise a bonded reflectron. According to another embodiment the reflectron 306 may comprise a metalised ceramic arrangement. According to another embodiment the reflectron 306 may comprise a jigged then bonded arrangement.

According to alternative embodiments instead of stacking, mounting and fixing multiple electrodes or rings, a single bulk piece of an insulating material such as a ceramic may be provided. Conductive metalised regions on the surface may then be provided with electrical connections to these regions so as to define desired electric fields. For example, the inner surface of a single piece of cylindrical shaped ceramic may have multiple parallel metalised conductive rings deposited as an alternative method of providing potential surfaces as a result of stacking multiple individual rings as is known conventionally. The bulk ceramic material provides insulation between the different potentials applied to different surface regions. The alternative arrangement reduces the number of components thereby simplifying the overall design, improving tolerance build up and reducing manufacturing cost. Furthermore, it is contemplated that multiple devices may be constructed this way and may be combined with or without grids or lenses placed in between. For example, according to one embodiment a first grid electrode may be provided, followed by a first ceramic cylindrical element, followed by a second grid electrode followed by a second ceramic cylindrical element.

Figure 10A:
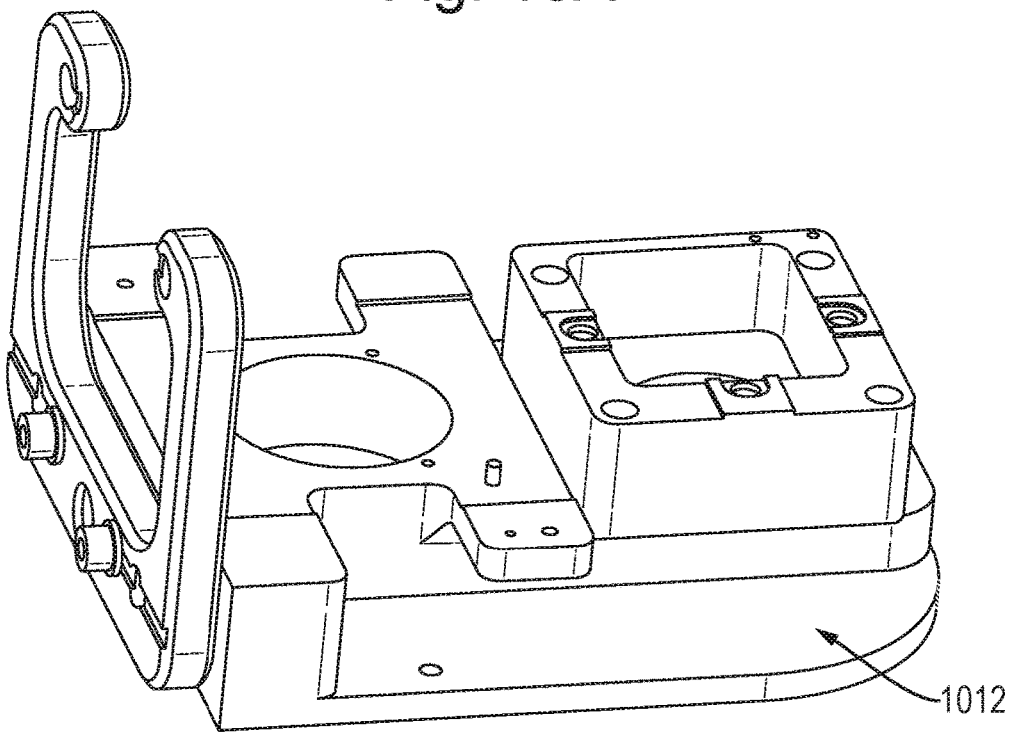
FIG. 10A shows in more detail a pusher plate assembly.
Figure 10B:
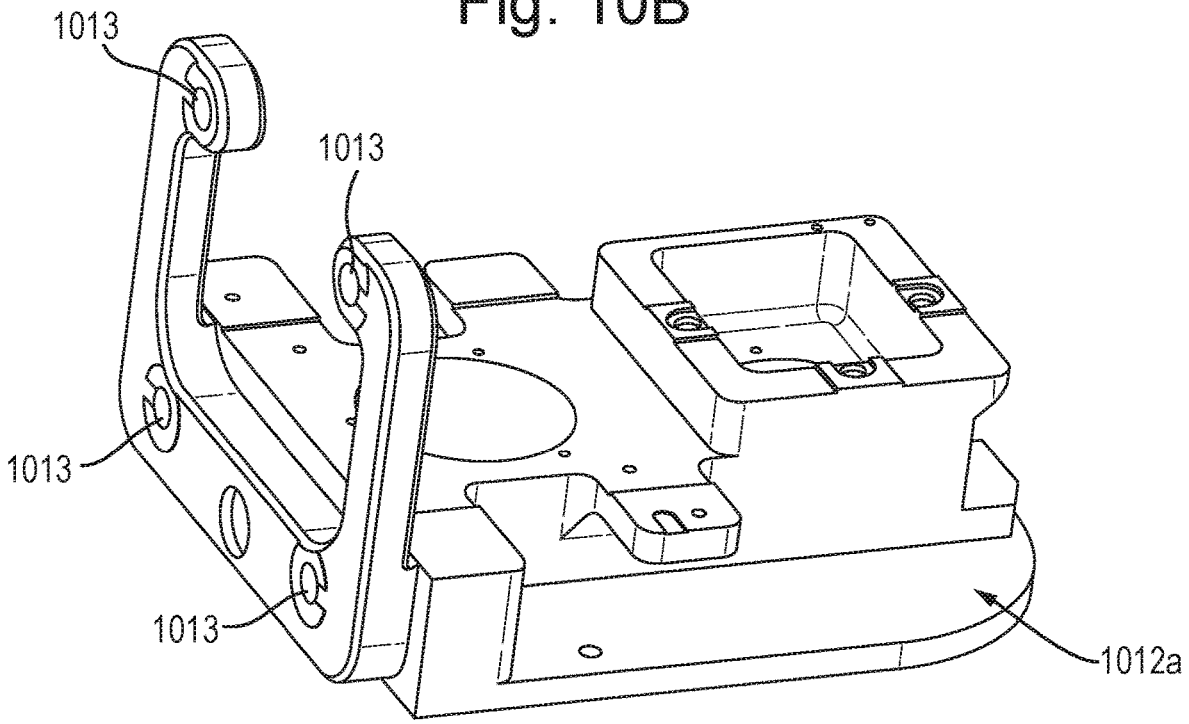
Figure 10C:
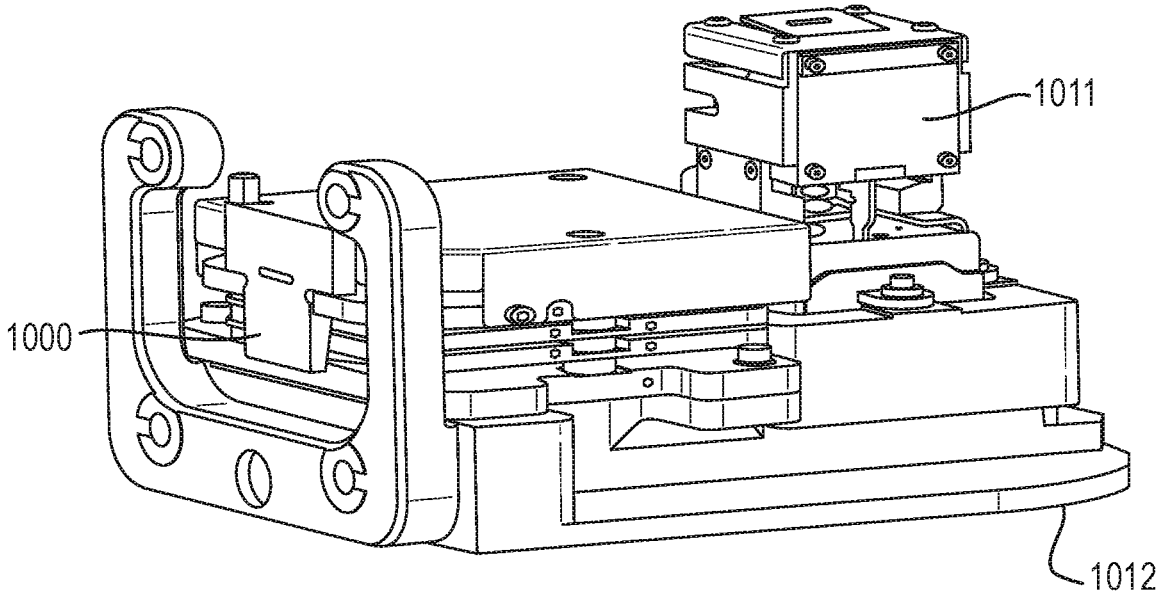

FIG. 10A shows a pusher plate assembly 1012 comprising three parts according to various embodiments. According to an alternative embodiment a monolithic support plate 1012*a* may be provided as shown in FIG. 10B. The monolithic support plate 1012*a* may be made by extrusion. The support plate 1012*a* may comprise a horse shoe shaped bracket having a plurality (e.g. four) fixing points 1013. According to an embodiment four screws may be used to connect the horse shoe shaped bracket to the housing of the mass spectrometer and enable a cantilevered arrangement to be provided. The bracket may be maintained at a voltage which may be the same as the Time of Flight voltage i.e. 4.5 kV. By way of contrast, the mass spectrometer housing may be maintained at ground voltage i.e. 0V.

FIG. 100 shows a pusher plate assembly 1012 having mounted thereon a pusher electrode assembly and an ion detector assembly 1011. An entrance plate 1000 having an ion entrance slit or aperture is shown.

Figure 16A:
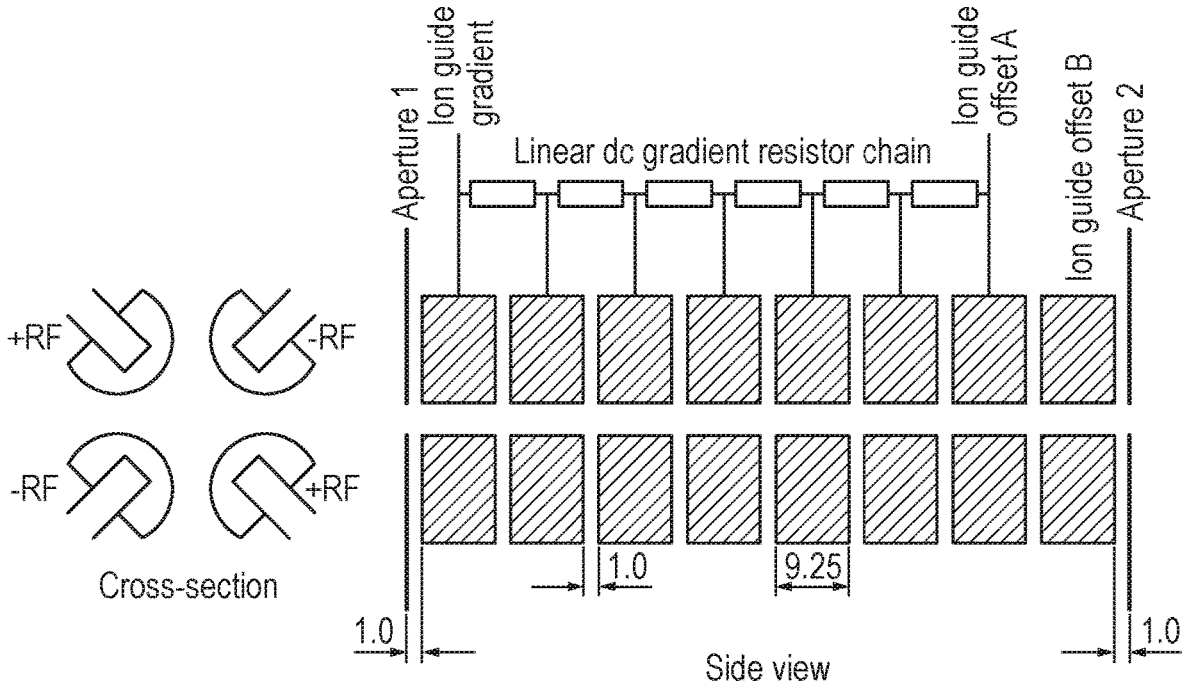
FIG. 16A shows in more detail a segmented quadrupole rod set ion guide according to various embodiments which may be provided downstream of the first ion guide and which comprises a plurality of rod electrodes.
Figure 16B:
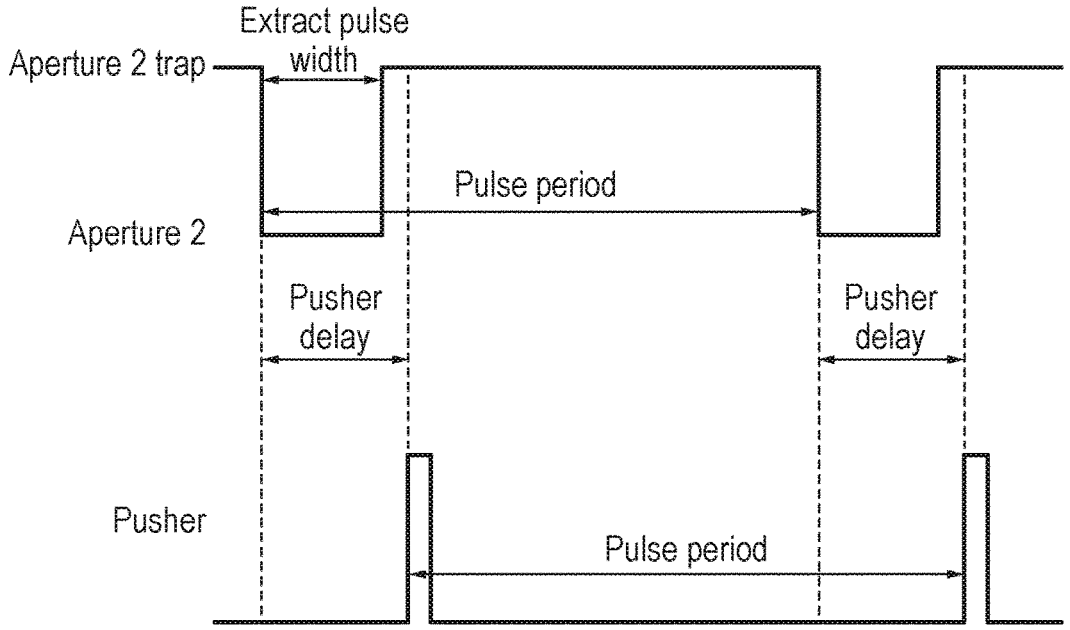
FIG. 16B illustrates how a voltage pulse applied to a pusher electrode of a Time of Flight mass analyser may be synchronised with trapping and releasing ions from the end region of the segmented quadrupole rod set ion guide.
Figure 16C:
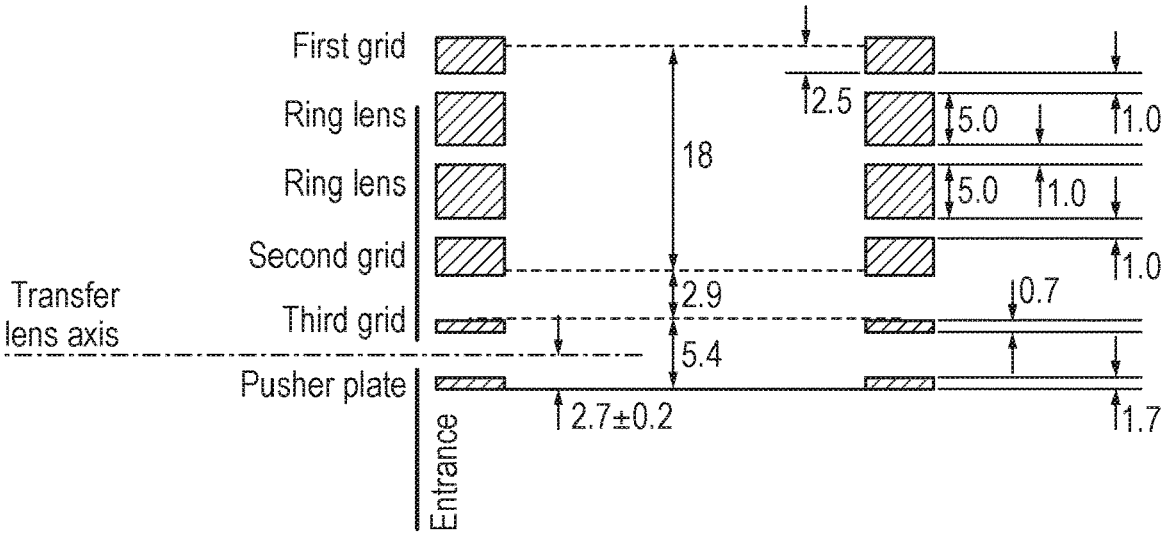
FIG. 16C illustrates in more detail the pusher electrode geometry and shows the arrangement of grid and ring lenses or electrodes and their relative spacing.

The pusher electrode may comprise a double grid electrode arrangement having a 2.9 mm field free region between a second and third grid electrode as shown in more detail in FIG. 16C.

Figure 11:
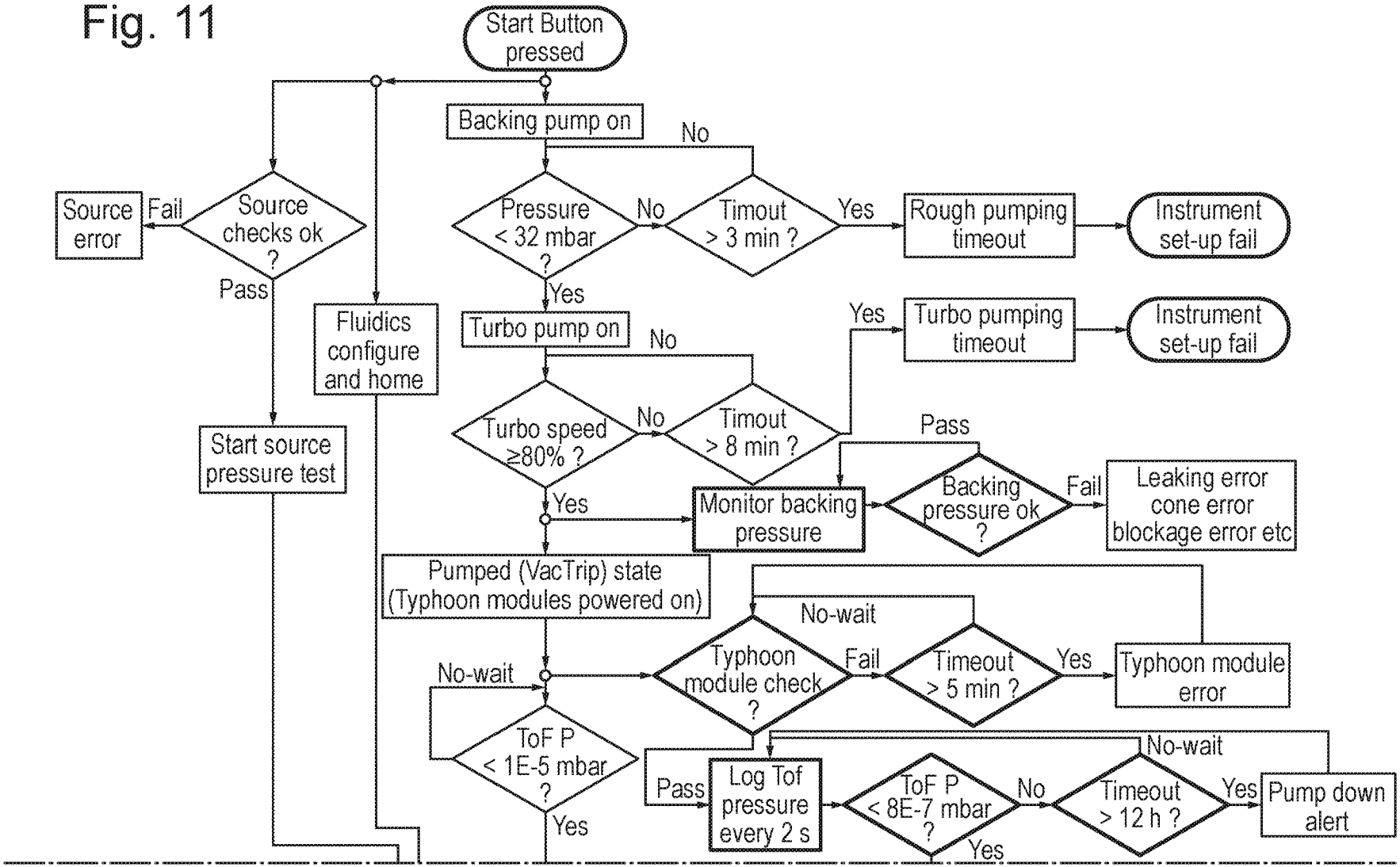
FIG. 11 shows a flow diagram illustrating various processes which occur upon a user pressing a start button on the front panel of the instrument according to various embodiments.
Figure 11:
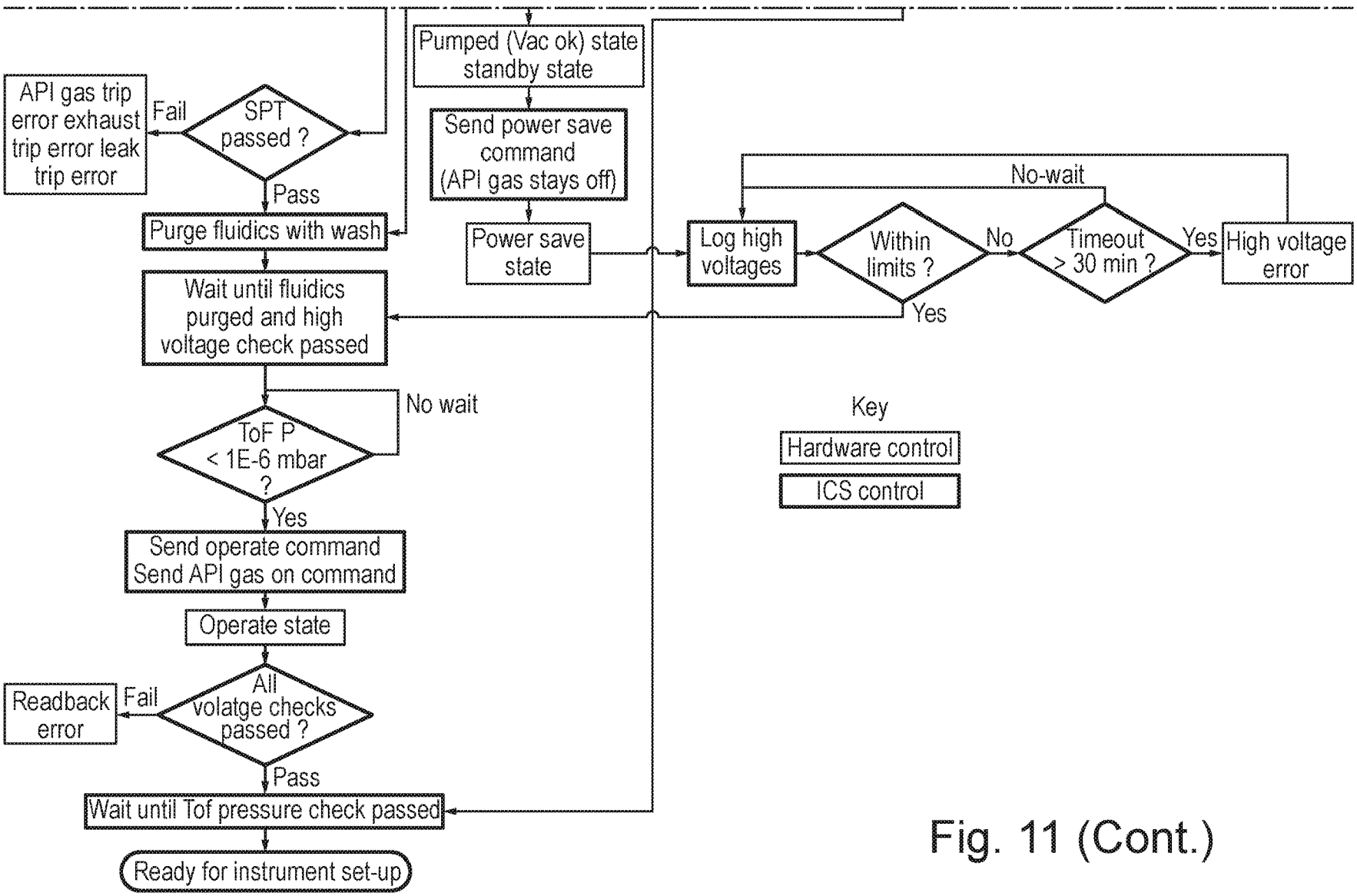

FIG. 11 shows a flow diagram illustrating various processes which may occur once a start button has been pressed.

According to an embodiment when the backing pump is turned ON a check may be made that the pressure is <32 mbar within three minutes of operation. If a pressure of <32 mbar is not achieved or established within three minutes of operation then a rough pumping timeout (amber) warning may be issued.

Figure 12A:
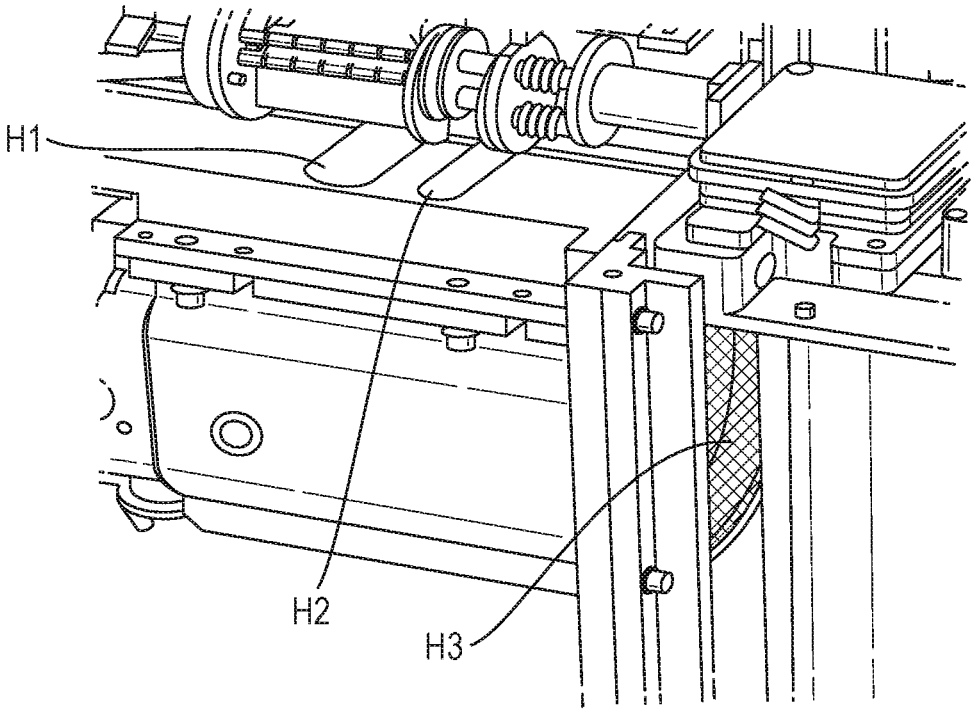
FIG. 12A shows in greater detail three separate pumping ports of a turbo molecular pump according to various embodiments and FIG. 12B shows in greater detail two of the three pumping ports which are arranged to pump separate vacuum chambers.

FIG. 12A shows the three different pumping ports of the turbo molecular pump according to various embodiments. The first pumping port H1 may be arranged adjacent the segmented quadrupole rod set 302. The second pumping port H2 may be arranged adjacent a first lens set of the transfer lens arrangement 303. The third pumping port (which may be referred to either as the H port or the H3 port) may be directly connected to Time of Flight mass analyser 304 vacuum chamber.

Figure 12B:
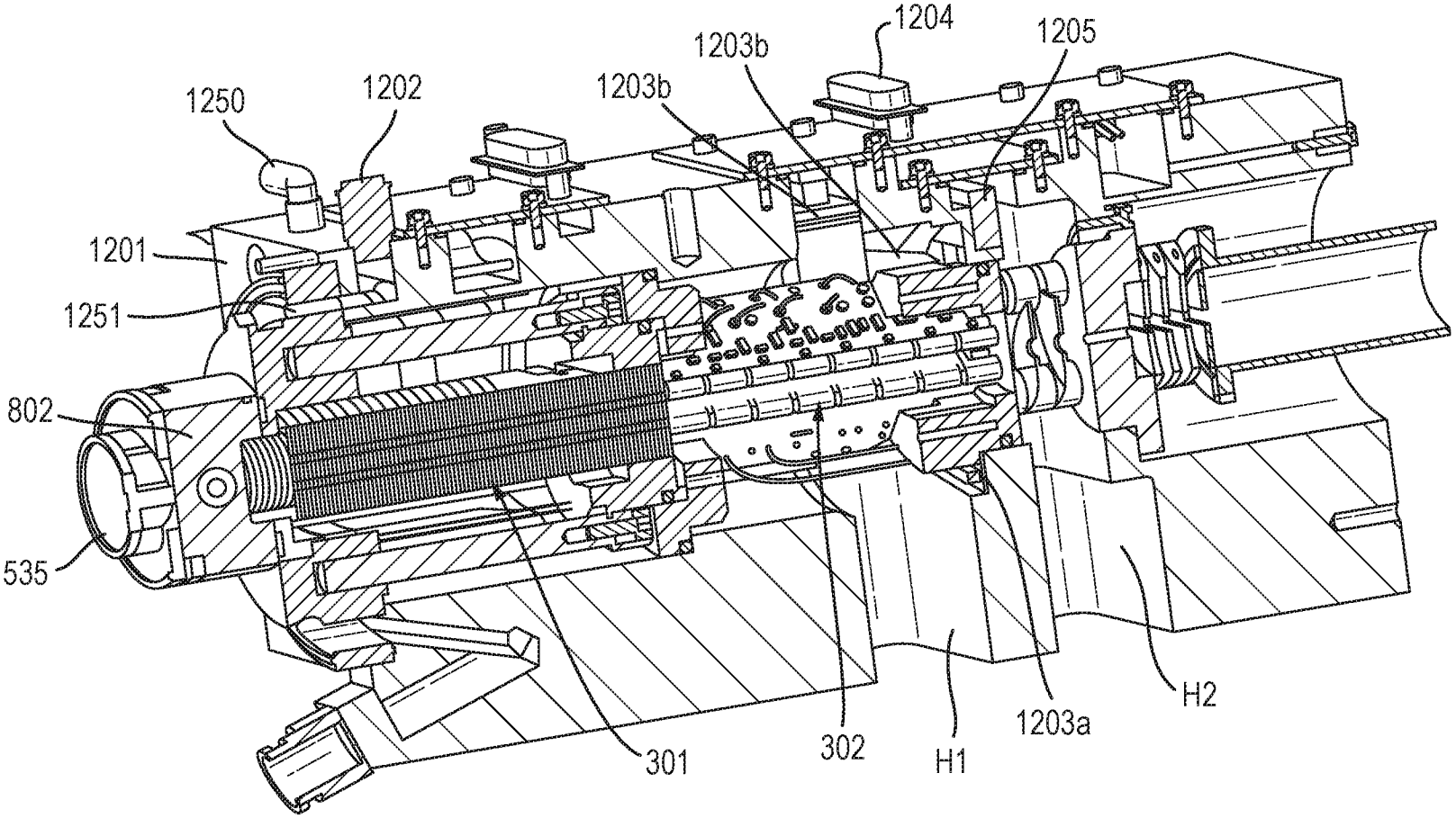

FIG. 12B shows from a different perspective the first pumping port H1 and the second pumping port H2. The user clamp 535 which is mounted in use to the ion block 802 is shown. The first ion guide 301 and the quadrupole rod set ion guide 302 are also indicated. A nebuliser or cone gas input 1201 is also shown. An access port 1251 is provided for measuring pressure in the source. A direct pressure sensor is provided (not fully shown) for measuring the pressure in the vacuum chamber housing the initial ion guide 301 and which is in fluid communication with the internal volume of the ion block 802. An elbow fitting 1250 and an over pressure relief valve 1202 are also shown.

One or more part-rigid and part-flexible printed circuit boards ("PCBs") may be provided. According to an embodiment a printed circuit board may be provided which comprises a rigid portion 1203*a* which is located at the exit of the quadrupole rod set region 302 and which is optionally at least partly arranged perpendicular to the optic axis or direction of ion travel through the quadrupole rod set 302. An upper or other portion of the printed circuit board may comprise a flexible portion 1203*b* so that the flexible portion 1203*b* of the printed circuit board has a stepped shape in side profile as shown in FIG. 12B.

According to various embodiments the H1 and H2 pumping ports may comprise EMC splinter shields.

It is also contemplated that the turbo pump may comprise dynamic EMC sealing of the H or H3 port. In particular, an EMC mesh may be provided on the H or H3 port.

Figure 13:
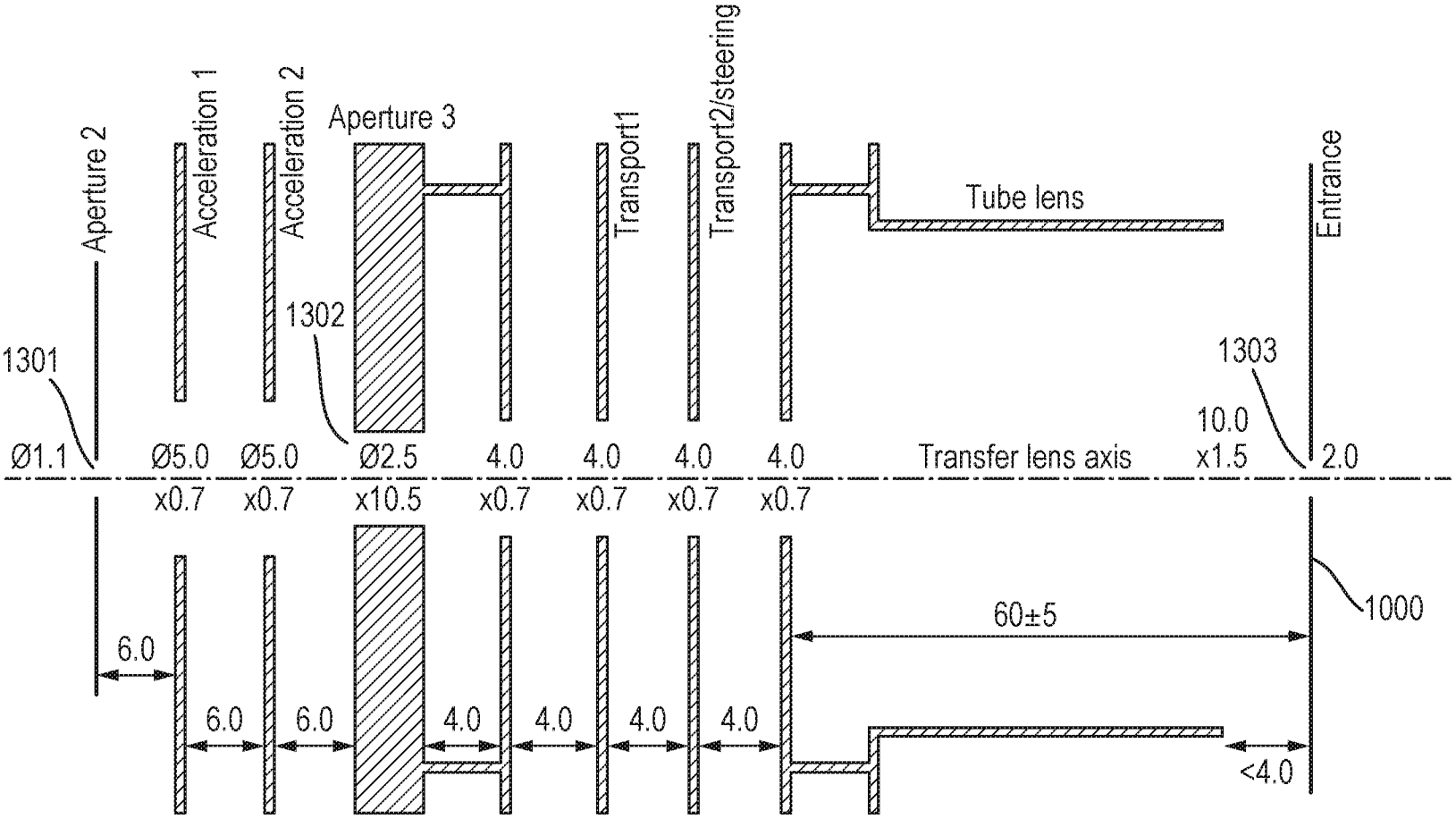
FIG. 13 shows in more detail a transfer lens arrangement.

FIG. 13 shows in more detail the transfer lens arrangement 303 and shows a second differential pumping aperture (Aperture #2) 1301 which separates the vacuum chamber housing the segmented quadrupole rod set 302 from first transfer optics which may comprise two acceleration electrodes. The relative spacing of the lens elements, their internal diameters and thicknesses according to an embodiment are shown. However, it should be understood that the relative spacing, size of apertures and thicknesses of the electrodes or lens elements may be varied from the specific values indicated in FIG. 13.

The region upstream of the second aperture (Aperture #2) 1301 may be in fluid communication with the first pumping port H1 of the turbo pump. A third differential pumping aperture (Aperture #3) 1302 may be provided between the first transfer optics and second transfer optics.

The region between the second aperture (Aperture #2) 1301 and the third aperture (Aperture #3) 1302 may be in fluid communication with the second pumping port H2 of the turbo pump.

The second transfer optics which is arranged downstream of the third aperture 1302 may comprises a lens arrangement comprising a first electrode which is electrical connection with the third aperture (Aperture #3) 1302. The lens arrangement may further comprise a second (transport) lens and a third (transport/steering) lens. Ions passing through the second transfer optics then pass through a tube lens before passing through an entrance aperture 1303. Ions passing through the entrance aperture 1303 pass through a slit or entrance plate 1000 into a pusher electrode assembly module.

The lens apertures after Aperture #3 1302 may comprise horizontal slots or plates. Transport 2/steering lens may comprise a pair of half plates.

The entrance plate 1000 may be arranged to be relatively easily removable by a service engineer for cleaning purposes.

One or more of the lens plates or electrodes which form a part of the overall transfer optics 303 may be manufactured by introducing an overcompensation etch of 5%. An additional post etch may also be performed. Conventional lens plates or electrodes may have a relatively sharp edge as a result of the manufacturing process. The sharp edges can cause electrical breakdown with conventional arrangements. Lens plates or electrodes which may be fabricated according to various embodiments using an overcompensation etching approach and/or additional post etch may have significantly reduced sharp edges which reduces the potential for electrical breakdown as well as reducing manufacturing cost.

Figure 14A:
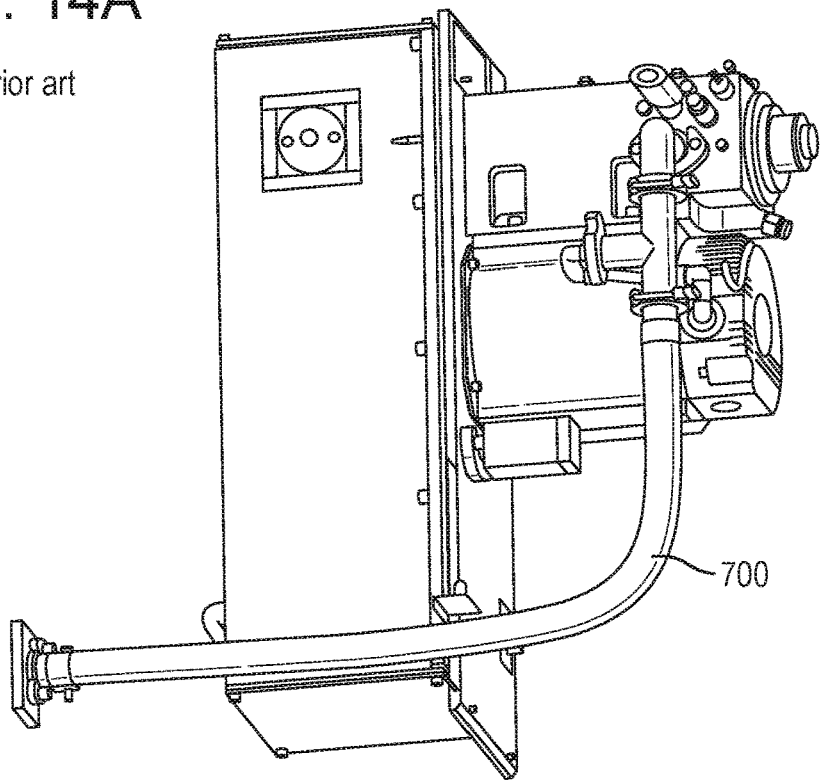
Fig. 14A Prior art
FIG. 14A shows details of a known internal vacuum configuration and FIG. 14B shows details of a new internal vacuum configuration according to various embodiments.
Figure 14B:
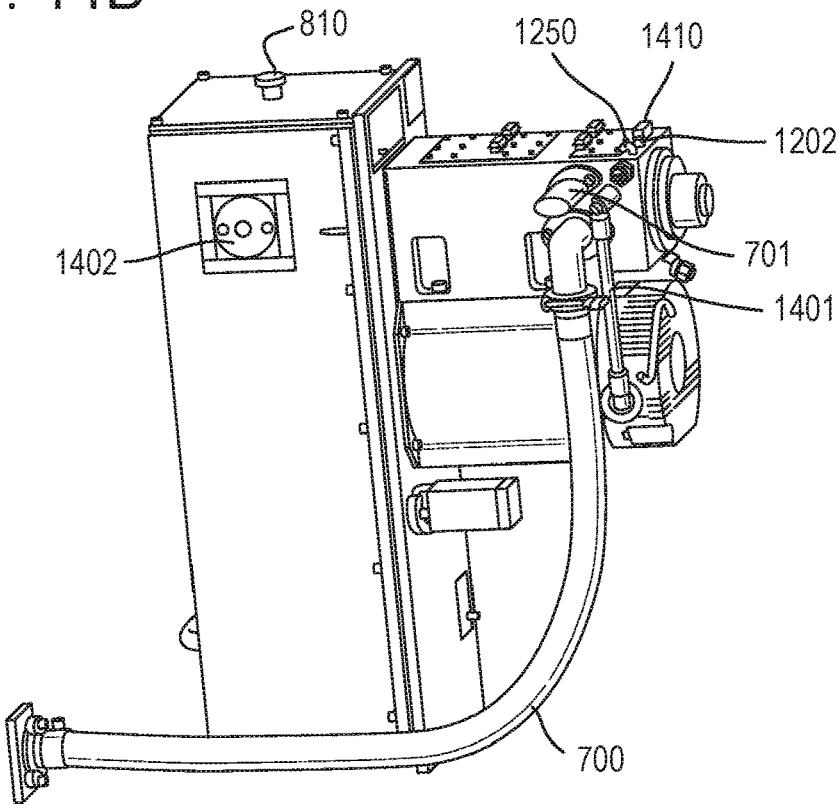

FIG. 14A shows details of a known internal vacuum configuration and FIG. 14B shows details of a new internal vacuum configuration according to various embodiments.

A conventional arrangement is shown in FIG. 14A wherein the connection 700 from the backing pump to the first vacuum chamber of a mass spectrometer makes a T-connection into the turbo pump when backing pressure is reached. However, this requires multiple components so that multiple separate potential leak points are established. Furthermore, the T-connection adds additional manufacturing and maintenance costs.

FIG. 14B shows an embodiment wherein the backing pump 700 is only directly connected to the first vacuum chamber i.e. the T-connection is removed. A separate connection 1401 is provided between the first vacuum chamber and the turbo pump.

A high voltage supply feed through 1402 is shown which provides a high voltage (e.g. 1.1 kV) to the pusher electrode module 305. An upper access panel 810 is also shown. A Pirani pressure gauge 701 is arranged to measure the vacuum pressure in the vacuum chamber housing the first ion guide 301. An elbow gas fitting 1250 is shown through which desolvation/cone gas may be supplied. With reference to FIG. 14B, behind the elbow gas fitting 1250 is shown the over pressure relief valve 1202 and behind the over pressure relief valve 1202 is shown a further elbow fitting which enables gas pressure from the source to be directly measured.

Figure 15A:
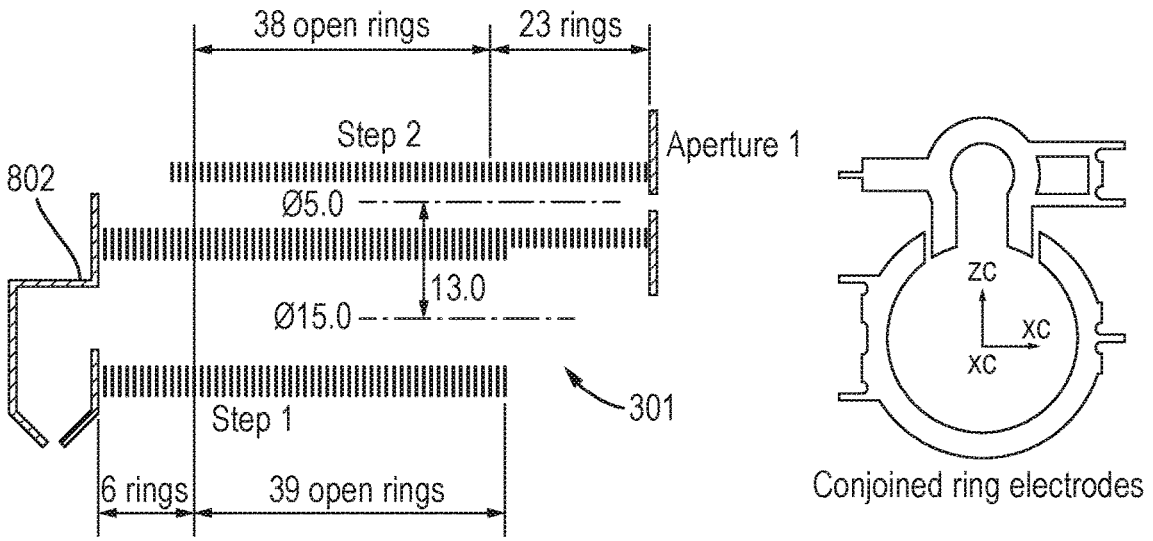
FIG. 15A shows a schematic of an arrangement of ring electrodes and conjoined ring electrodes forming a first ion guide which is arranged to separate charged ions from undesired neutral particles.

FIG. 15A shows a schematic of the ion block 802 and source or first ion guide 301. According to an embodiment the source or first ion guide 301 may comprise six initial ring electrodes followed by 38-39 open ring or conjoined electrodes. The source or first ion guide 301 may conclude with a further 23 rings. It will be appreciated, however, that the particular ion guide arrangement 301 shown in FIG. 15A may be varied in a number of different ways. In particular, the number of initial ring electrodes (e.g. 6) and/or the number of final stage (e.g. 23) ring electrodes may be varied. Similarly, the number of intermediate open ring or conjoined ring electrodes (e.g. 38-39) may also be varied.

It should be understood that the various dimensions illustrated on FIG. 15A are for illustrative purposes only and are not intended to be limiting. In particular, embodiments are contemplated wherein the sizing of ring and/or conjoined ring electrodes may be different from that shown in FIG. 15A.

A single conjoined ring electrode is also shown in FIG. 15A.

According to various embodiment the initial stage may comprise 0-5, 5-10, 10-15, 15-20, 20-25, 25-30, 30-35, 35-40, 40-45, 45-50 or >50 ring or other shaped electrodes. The intermediate stage may comprise 0-5, 5-10, 10-15, 15-20, 20-25, 25-30, 30-35, 35-40, 40-45, 45-50 or >50 open ring, conjoined ring or other shaped electrodes. The final stage may comprise 0-5, 5-10, 10-15, 15-20, 20-25, 25-30, 30-35, 35-40, 40-45, 45-50 or >50 ring or other shaped electrodes.

The ring electrodes and/or conjoined ring electrodes may have a thickness of 0.5 mm and a spacing of 1.0 mm. However, the electrodes may have other thicknesses and/or different spacings.

Aperture #1 plate may comprise a differential pumping aperture and may have a thickness of 0.5 mm and an orifice diameter of 1.50 mm. Again, these dimensions are illustrative and are not intended to be limiting.

A source or first ion guide RF voltage may be applied to all Step 1 and Step 2 electrodes in a manner as shown in FIG. 15A. The source or first ion guide RF voltage may comprise 200 V peak-to-peak at 1.0 MHz.

Embodiments are contemplated wherein a linear voltage ramp may be applied to Step 2 Offset (cone).

The Step 2 Offset (cone) voltage ramp duration may be made equal to the scan time and the ramp may start at the beginning of a scan. Initial and final values for the Step 2 Offset (cone) ramp may be specified over the complete range of Step 2 Offset (cone).

Figure 15B:
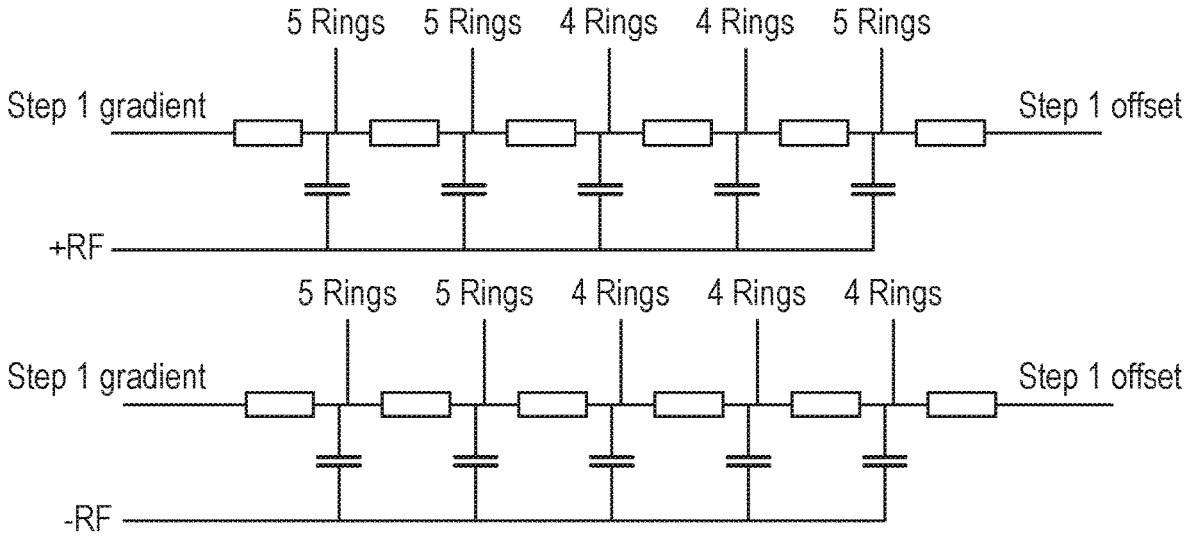
FIG. 15B shows a resistor chain which may be used to produce a linear axial DC electric field along the length of a first portion of the first ion guide and FIG. 15C shows a resistor chain which may be used to produce a linear axial DC electric field along the length of a second portion of the first ion guide.

According to various embodiments a resistor chain as shown in FIG. 15B may be used to produce a linear axial field along the length of Step 1. Adjacent ring electrodes may have opposite phases of RF voltage applied to them.

Figure 15C:
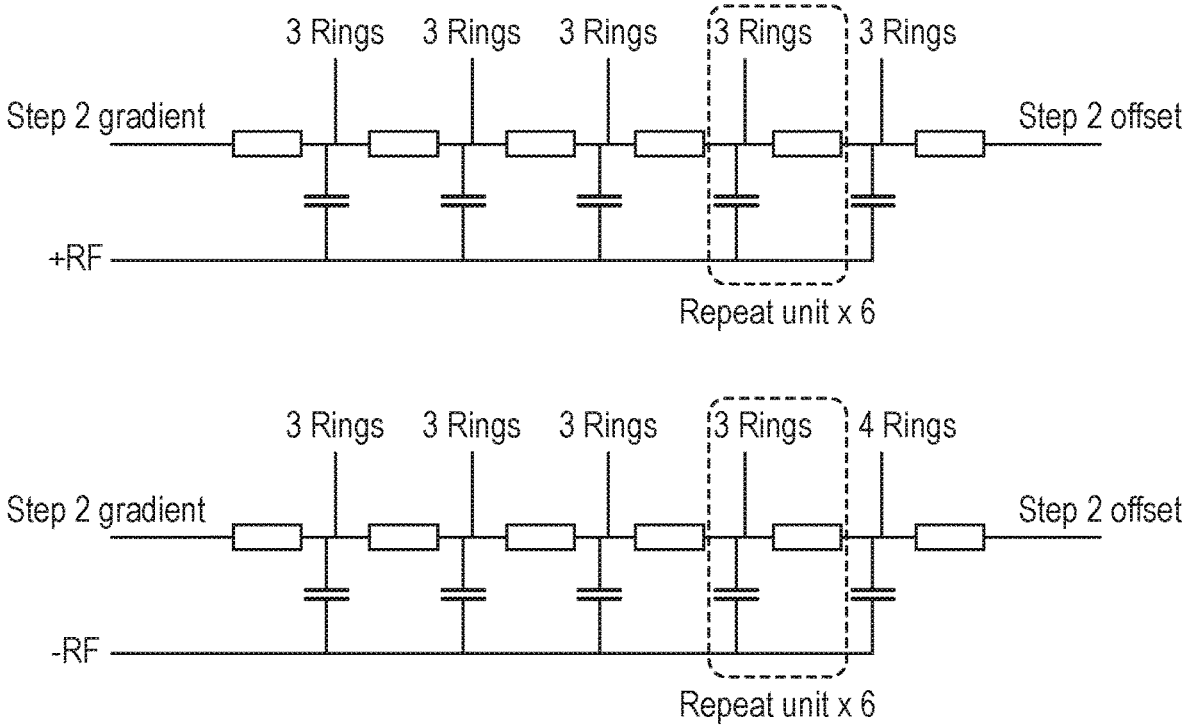

A resistor chain may also be used to produce a linear axial field along the length of Step 2 as shown in FIG. 15C. Adjacent ring electrodes may have opposite phases of RF voltage applied to them.

Embodiments are contemplated wherein the RF voltage applied to some or substantially all the ring and conjoined ring electrodes forming the first ion guide 301 may be reduced or varied in order to perform a non-mass to charge ratio specific attenuation of the ion beam. For example, as will be appreciated, with a Time of Flight mass analyser 304 the ion detector 307 may suffer from saturation effects if an intense ion beam is received at the pusher electrode 305. Accordingly, the intensity of the ion beam arriving adjacent the pusher electrode 305 can be controlled by varying the RF voltage applied to the electrodes forming the first ion guide 301. Other embodiments are also contemplated wherein the RF voltage applied to the electrodes forming the second ion guide 302 may additionally and/or alternatively be reduced or varied in order to attenuate the ion beam or otherwise control the intensity of the ion beam. In particular, it is desired to control the intensity of the ion beam as received in the pusher electrode 305 region.

FIG. 16A shows in more detail the quadrupole ion guide 302 according to various embodiments. The quadrupole rods may have a diameter of 6.0 mm and may be arranged with an inscribed radius of 2.55 mm. Aperture #2 plate which may comprise a differential pumping aperture may have a thickness of 0.5 mm and an orifice diameter of 1.50 mm. The various dimensions shown in FIG. 16A are intended to be illustrative and non-limiting.

The ion guide RF amplitude applied to the rod electrodes may be controllable over a range from 0 to 800 V peak-to-peak.

The ion guide RF voltage may have a frequency of 1.4 MHz. The RF voltage may be ramped linearly from one value to another and then held at the second value until the end of a scan.

As shown in FIG. 16B, the voltage on the Aperture #2 plate may be pulsed in an Enhanced Duty Cycle mode operation from an Aperture 2 voltage to an Aperture 2 Trap voltage. The extract pulse width may be controllable over the range 1-25 μs. The pulse period may be controllable over the range 22-85 μs. The pusher delay may be controllable over the range 0-85 μs.

FIG. 16C shows in more detail the pusher electrode arrangement. The grid electrodes may comprise Ø60 parallel wire with 92% transmission (Ø0.018 mm parallel wires at 0.25 mm pitch). The dimensions shown are intended to be illustrative and non-limiting.

Figure 16D:
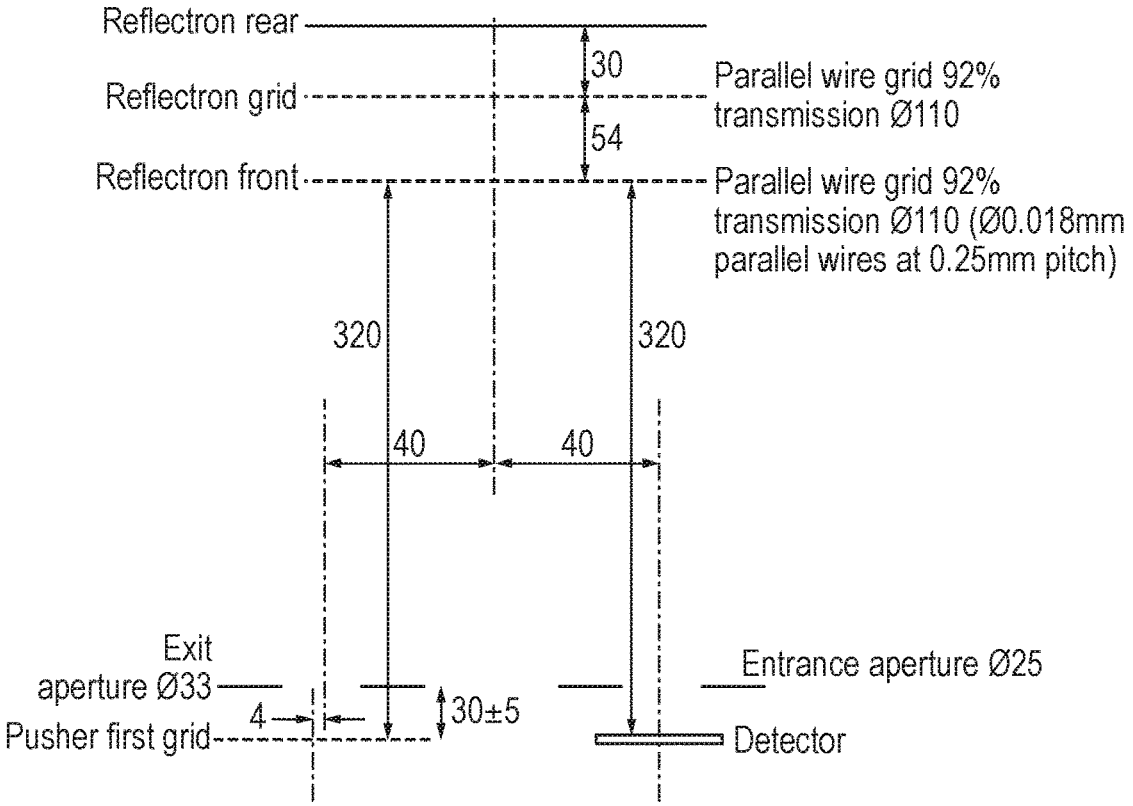
FIG. 16D illustrates in more detail the overall geometry of the Time of Flight mass analyser including the relative spacings of elements of the pusher electrode and associated electrodes, the reflectron grid electrodes and the ion detector.

FIG. 16D shows in more detail the Time of Flight geometry. The region between the pusher first grid, reflectron first grid and the detector grid preferably comprises a field free region. The position of the ion detector 307 may be defined by the ion impact surface in the case of a MagneTOF® ion detector or the surface of the front MCP in the case of a MCP detector.

The reflectron ring lenses may be 5 mm high with 1 mm spaces between them. The various dimensions shown in FIG. 16D are intended to be illustrative and non-limiting.

According to various embodiments the parallel wire grids may be aligned with their wires parallel to the instrument axis. It will be understood that the instrument axis runs through the source or first ion guide 301 through to the pusher electrode assembly 305.

A flight tube power supply may be provided which may have an operating output voltage of either +4.5 kV or −4.5 kV depending on the polarity requested.

A reflectron power supply may be provided which may have an operating output voltage ranging from 1625±100 V or −1625±100 V depending on the polarity requested.

Figure 16E:
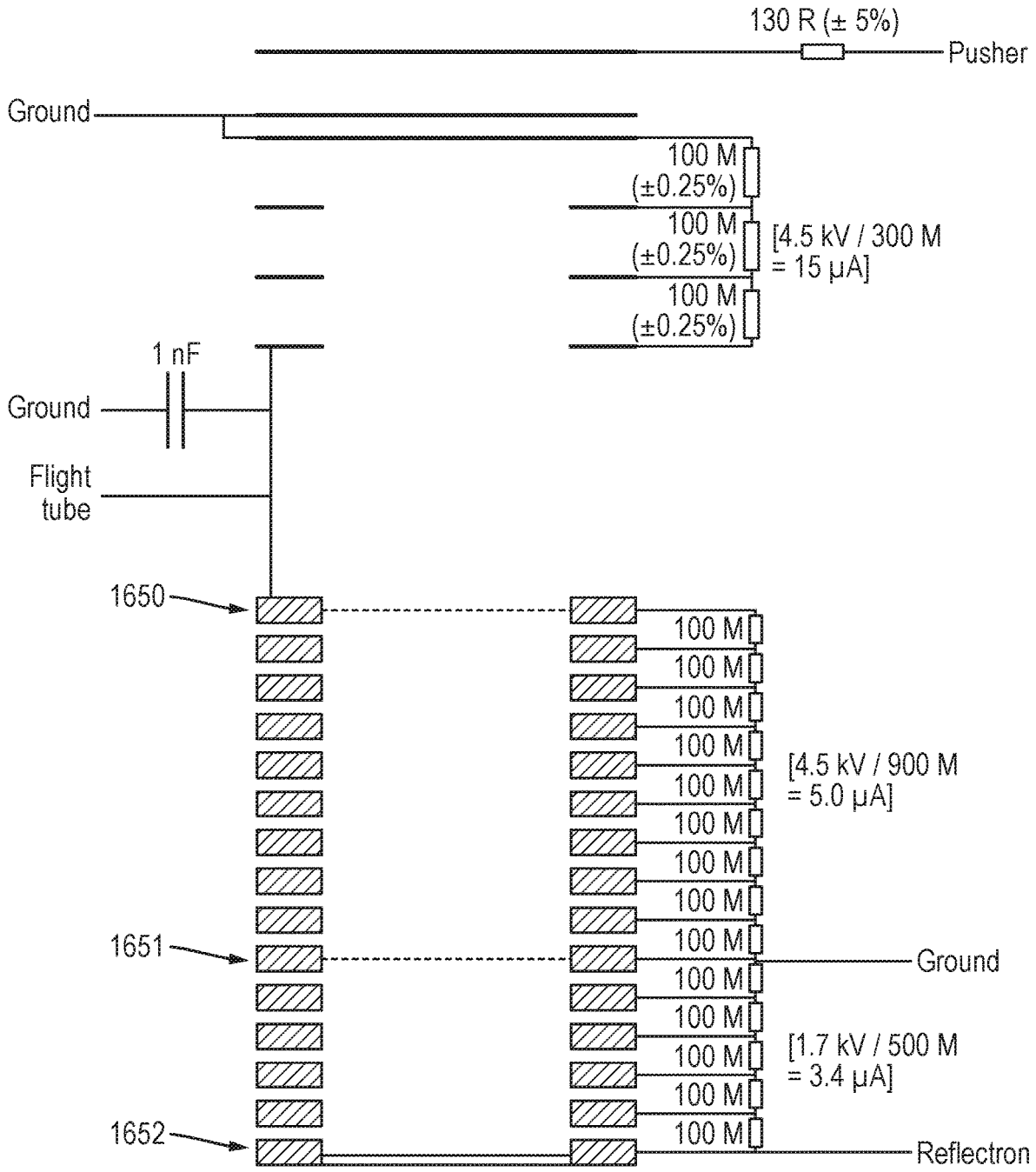
FIG. 16E is a schematic illustrating the wiring arrangement according to various embodiments of the pusher electrode and associated grid and ring electrodes and the grid and ring electrodes forming the reflectron.

FIG. 16E is a schematic of the Time of Flight wiring according to an embodiment. The various resistor values, voltages, currents and capacitances are intended to be illustrative and non-limiting.

According to various embodiments a linear voltage gradient may be maintained along the length of the reflectron 306. In a particular embodiment a reflectron clamp plate may be maintained at the reflectron voltage.

An initial electrode and associated grid 1650 of the reflectron 306 may be maintained at the same voltage or potential as the flight tube 807 and the last electrode of the pusher electrode assembly 305. According to an embodiment the initial electrode and associated grid 1650 of the reflectron 306, the flight tube 807 and the last electrode and associated grid of the pusher electrode assembly 305 may be maintained at a voltage or potential of e.g. 4.5 kV of opposite polarity to the instrument or mode of operation. For example, in positive ion mode the initial electrode and associated grid 1650 of the reflectron 306, the flight tube 807 and the last electrode and associated grid of the pusher electrode assembly 305 may be maintained at a voltage or potential of −4.5 kV.

The second grid electrode 1651 of the reflectron 306 may be maintained at ground or 0V.

The final electrode 1652 of the reflectron 306 may be maintained at a voltage or potential of 1.725 kV of the same polarity as the instrument. For example, in positive ion mode the final electrode 1652 of the reflectron 306 may be maintained at a voltage or potential of +1.725 kV.

It will be understood by those skilled in the art that the reflectron 306 acts to decelerate ions arriving from the time of flight region and to redirect the ions back out of the reflectron 306 in the direction of the ion detector 307.

The voltages and potentials applied to the reflectron 306 according to various embodiments and maintaining the second grid electrode 1651 of the reflectron at ground or 0V is different from the approach adopted in conventional reflectron arrangements.

The ion detector 307 may always be maintained at a positive voltage relative to the flight tube voltage or potential. According to an embodiment the ion detector 307 may be maintained at a +4 kV voltage relative to the flight tube.

Accordingly, in a positive ion mode of operation if the flight tube is maintained at an absolute potential or voltage of −4.5 kV then the detector may be maintained at an absolute potential or voltage of −0.5 kV.

FIG. 16F shows the DC lens supplies according to an embodiment. It will be understood that Same polarity means the same as instrument polarity and that Opposite polarity means opposite to instrument polarity. Positive means becomes more positive as the control value is increased and Negative means becomes more negative as the control value is increased. The particular values shown in FIG. 16F are intended to be illustrative and non-limiting.

Figure 16G:
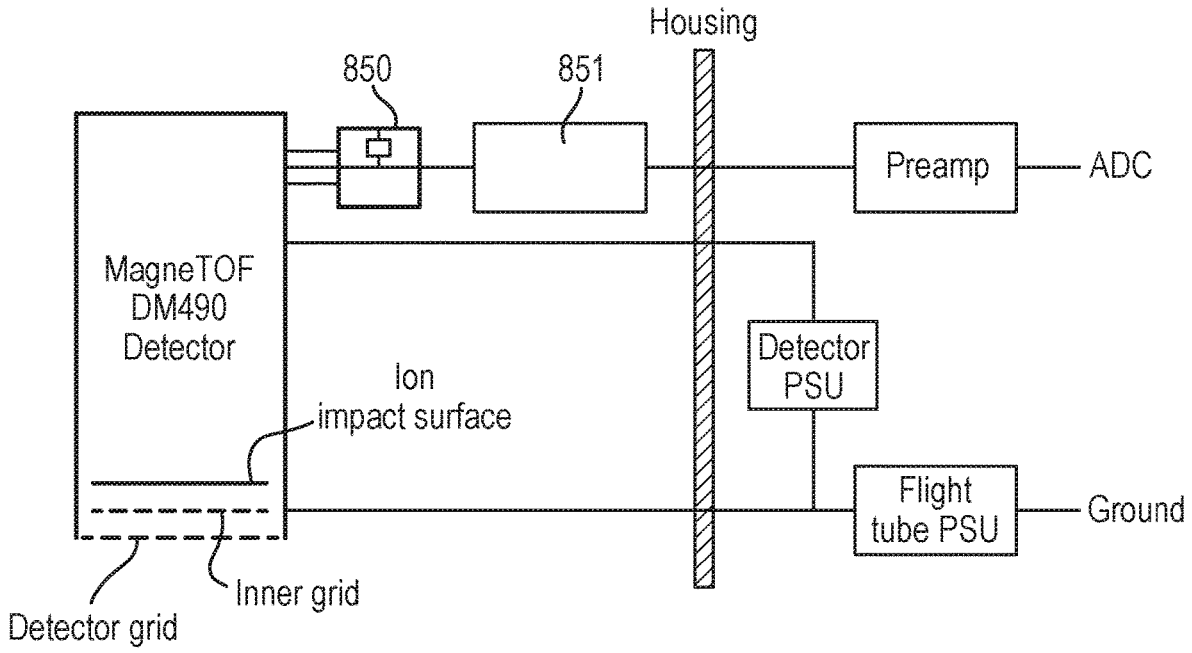
FIG. 16G is a schematic of an ion detector arrangement according to various embodiments and which shows various connections to the ion detector which are located both within and external to the Time of Flight housing and FIG. 16H shows an illustrative potential energy diagram.

FIG. 16G shows a schematic of an ion detector arrangement according to various embodiments. The detector grid may form part of the ion detector 307. The ion detector 307 may, for example, comprise a MagneTOF®, DM490 ion detector. The inner grid electrode may be held at a voltage of +1320 V with respect to the detector grid and flight tube via a series of zener diodes and resistors. The ion detector 307 may be connected to a SMA 850 and an AC coupler 851 which may both be provided within or internal to the mass analyser housing or within the mass analyser vacuum chamber. The AC coupler 851 may be connected to an externally located preamp which in turn may be connected to an Analogue to Digital Converter ("ADC") module.

Figure 16H:
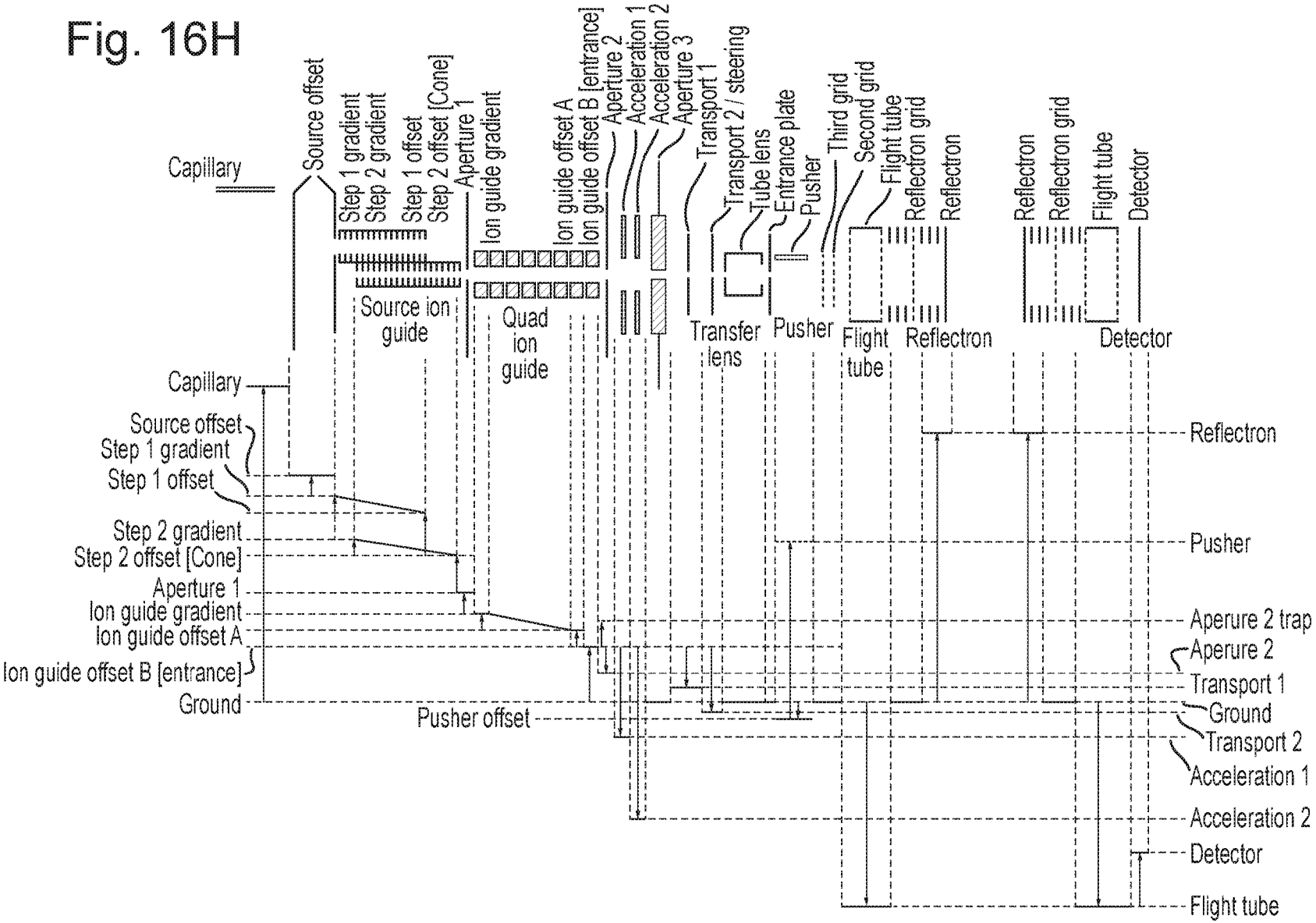

FIG. 16H shows a potential energy diagram for an instrument according to various embodiments. The potential energy diagram represents an instrument in positive ion mode. In negative ion mode all the polarities are reversed except for the detector polarity. The particular voltages/potentials shown in FIG. 16H are intended to be illustrative and non-limiting.

The instrument may include an Analogue to Digital Converter ("ADC") which may be operated in peak detecting ADC mode with fixed peak detecting filter coefficients. The ADC may also be run in a Time to Digital Converter ("TDC") mode of operation wherein all detected ions are assigned unit intensity. The acquisition system may support a scan rate of up to 20 spectra per second. A scan period may range from 40 ms to 1 s. The acquisition system may support a maximum input event rate of $7\times10^6$ events per second.

According to various embodiments the instrument may have a mass accuracy of 2-5 ppm may have a chromatographic dynamic range of $10^4$. The instrument may have a high mass resolution with a resolution in the range 10000-15000 for peptide mapping. The mass spectrometer 100 is preferably able to mass analyse intact proteins, glycoforms and lysine variants. The instrument may have a mass to charge ratio range of approx. 8000.

Instrument testing was performed with the instrument fitted with an ESI source 401. Sample was infused at a flow rate of 400 mL/min. Mass range was set to m/z 1000. The instrument was operated in positive ion mode and high resolution mass spectral data was obtained.

According to various embodiments the instrument may have a single analyser tune mode i.e. no sensitivity and resolution modes.

According to various embodiments the resolution of the instrument may be in the range 10000-15000 for high mass or mass to charge ratio ions such as peptide mapping applications. The resolution may be determined by measuring on any singly charged ion having a mass to charge ratio in the range 550-650.

The resolution of the instrument may be around 5500 for low mass ions. The resolution of instrument for low mass ions may be determined by measuring on any singly charged ion having a mass to charge ratio in the range 120-150.

According to various embodiments the instrument may have a sensitivity in MS positive ion mode of approx. 11,000 counts/second. The mass spectrometer 100 may have a mass accuracy of approx. 2-5 ppm Mass spectral data obtained according to various embodiments was observed as having reduced in-source fragmentation compared with conventional instruments. Adducts are reduced compared with conventional instruments. The mass spectral data also has cleaner valleys (<20%) for mAb glycoforms.

As disclosed in US 2015/0076338 (Micromass), the contents of which are incorporated herein by reference, the instrument according to various embodiment may comprise a plurality of discrete functional modules. The functional modules may comprise, for example, electrical, mechanical, electromechanical or software components. The modules may be individually addressable and may be connected in a network. A scheduler may be arranged to introduce discrete packets of instructions to the network at predetermined times in order to instruct one or more modules to perform various operations. A clock may be associated with the scheduler.

The functional modules may be networked together in a hierarchy such that the highest tier comprises the most time-critical functional modules and the lowest tier comprises functional modules which are the least time time-critical. The scheduler may be connected to the network at the highest tier.

For example, the highest tier may comprise functional modules such as a vacuum control system, a lens control system, a quadrupole control system, an electrospray module, a Time of Flight module and an ion guide module. The lowest tier may comprise functional modules such as power supplies, vacuum pumps and user displays.

The mass spectrometer 100 according to various embodiments may comprise multiple electronics modules for controlling the various elements of the spectrometer. As such, the mass spectrometer may comprise a plurality of discrete functional modules, each operable to perform a predetermined function of the mass spectrometer 100, wherein the functional modules are individually addressable and connected in a network and further comprising a scheduler operable to introduce discrete packets of instructions to the network at predetermined times in order to instruct at least one functional module to perform a predetermined operation.

The mass spectrometer 100 may comprise an electronics module for controlling (and for supplying appropriate voltage to) one or more or each of: (i) the source; (ii) the first ion guide; (iii) the quadrupole ion guide; (iv) the transfer optics; (v) the pusher electrode; (vi) the reflectron; and (vii) the ion detector.

This modular arrangement may allow the mass spectrometer to be reconfigured straightforwardly. For example, one or more different functional elements of the spectrometer may be removed, introduced or changed, and the spectrometer may be configured to automatically recognised which elements are present and to configure itself appropriately.

The instrument may allow for a schedule of packets to be sent onto the network at specific times and intervals during an acquisition. This reduces or alleviates the need for a host computer system with a real time operating system to control aspects of the data acquisition. The use of packets of information sent to individual functional modules also reduces the processing requirements of a host computer.

The modular nature conveniently allows flexibility in the design and/or reconfiguring of a mass spectrometer. According to various embodiments at least some of the functional modules may be common across a range of mass spectrometers and may be integrated into a design with minimal reconfiguration of other modules. Accordingly, when designing a new mass spectrometer, wholesale redesign of all the components and a bespoke control system are not necessary. A mass spectrometer may be assembled by connecting together a plurality of discrete functional modules in a network with a scheduler.

Furthermore, the modular nature of the mass spectrometer 100 according to various embodiments allows for a defective functional module to be replaced easily. A new functional module may simply be connected to the interface. Alternatively, if the control module is physically connected to or integral with the functional module, both can be replaced.

As described above, the various embodiments comprise a relatively high pressure ion source, such as an atmospheric pressure ionisation (API) ion source. For example, the ion source may be an electrospray ionisation (ESI) source. The ion source may have an ion source enclosure mounted over the ion block 802, and the ion source enclosure may be maintained at said a relatively high pressure, such as atmospheric, pressure during mass analysis.

With reference to FIG. 8, the mass spectrometer may comprise an ion block 802 which separates the ion source from the downstream vacuum chambers of the spectrometer, which are maintained at pressures that are lower than that in which the ion source is located. The ion block has an ion inlet assembly mounted therein for receiving analyte ions from the ion source and transmitting them downstream into the vacuum chamber. The ion inlet assembly may comprise a cone assembly, as will be discussed in more detail below. The vacuum chambers may house at least one of a first ion guide 301, a second ion guide 803, transfer optics 804, a pusher assembly 805, and a ToF stack 807 (such as those described above). Other downstream components may additionally or alternatively be provided, such as a mass separation device. The vacuum chambers may be differentially pumped regions (as described above).

As described above in relation to FIG. 6C, the ion block 802 has an ion inlet assembly mounted therein. The vacuum holding member 531 is mounted inside the aperture 511 in the ion block housing, i.e. an aperture into the first vacuum chamber of the spectrometer. The vacuum holding member 531 has an aperture therein and the disk 525 having the ion sampling orifice is mounted over the vacuum holding member 531 such that the apertures through these two components are coaxial. The inner gas cone 513 is then mounted over the disk 525. The inner gas cone has an aperture 515 therein that is coaxial with that of the disk 525. The outer gas cone 517 is slidably mountable in the clamp 535. Once the outer gas cone 517 has been slid into a receiving slot in the clamp 535, the clamp is then mounted to the main body of the ion block such that the aperture 521 of the outer gas cone 517 is coaxial with the aperture 515 in the inner gas cone 513.

FIG. 6F shows the outer gas cone 517 partially slid into the clamp 535 just prior to mounting the clamp 535 to the main body of the ion block 802. FIG. 6F also shows a view of an embodiment in which the outer gas cone 517 and inner gas cone 513 are attached together and slidably mountable to and demountable from the clamp 535 together.

It may be desired to deconstruct at least part of the ion inlet assembly, e.g. in order to clean the various components thereof. The clamp 535 may be configured such that removal of the clamp causes the outer cone 517 (and optionally the inner cone 513) to be slidably removed from the ion inlet assembly along with the clamp 535. In a condition where the outer cone 517 has been removed, the inner cone 513 (and disk 535) of the ion inlet assembly is then accessible for removal. It may be desirable to remove the outer cone 517 and inner cone 513 on a relatively regular basis for cleaning, repair or maintenance. It may also be desirable to remove the disk 535 of the ion inlet assembly for cleaning, repair or maintenance. The disk 535 may be a disposable component and may simply be replaced rather than cleaned.

The vacuum holding member 531 is configured to remain in place when the outer cone 517, inner cone 513 and disk 525 are removed. The vacuum holding member 531 is configured to maintain a relatively high pressure differential across the vacuum holding member 531, such that an interior (downstream side) of the ion block is maintained at an internal pressure that is less than the upstream ion source pressure (due to the differential pumping of the vacuum chambers downstream of the ion block) even when the outer cone 517, inner cone 513 and disk 525 are removed. The vacuum holding member is configured to restrict the loss of internal vacuum pressure, and therefore to reduce the rate at which the vacuum pressure is lost when the cones and disk are removed, and reduce the time taken for the instrument to return to an operational pressure when the disk 525 and cones are replaced.

The outer cone 517 has an orifice 521 at the tip of the cone for receiving analyte ions therethrough. The inner cone 513 also has a orifice 515 at its tip for receiving analyte ions therethrough. The orifice 515 of the inner cone 513 may be smaller than the orifice 521 of the outer cone 517. The orifice of the inner cone 513 may be configured to restrict the amount of contaminant reaching the disk 525. For example, the orifice 525 of the inner cone 513 may have a 1 mm diameter. The disk 525 may have a smaller aperture 529 (e.g. 0.2 mm diameter) than that in the inner cone. The aperture 529 of the disk may become blocked or contaminated during use, and hence the cone assembly is designed such that the disk 525 can be easily removed and cleaned or replaced.

According to various embodiments the disk 525 and the vacuum holding member 531 may have substantially smaller diameter apertures than conventional arrangements. For example, a known instrument utilises a vacuum holding member 531 having a 1 mm diameter aperture. In contrast, according to the embodiments herein the vacuum holding member 531 may have a much smaller diameter aperture, e.g. the vacuum holding member 531 may have a diameter of ≤0.6 mm, ≤0.5 mm, ≤0.4 mm, or ≤0.3 mm. For example, the aperture in the vacuum holding member 531 may have a diameter between 0.3 mm and 0.40 mm.

The mass spectrometer may be configured to supply the cone assembly on the ion block with a cone gas (e.g. nitrogen). The cone gas may be directed through the ion block such that it flows through the annular region between the inner cone 513 and outer cone 517 and out of the cone assembly towards the ion source, i.e. in the opposite direction to the ions, which travel towards and into the cone assembly. The cone assembly is configured such that the cone gas flows from the annular region and passed the orifice in the inner cone so as to push away contaminants or analyte clusters/deposits. This helps to keep the ion cone orifices clean and/or unobstructed during use.

The ion block may be provided with an ion block heater (which may also be referred to as the "source heater"). The ion block heater is configured to prevent sample/analyte from condensing when passing through the ion block. The ion block heater is configured to maintain a constant, fixed heat or temperature, e.g. up to 120° C. This heating may also cause a heating of the cone gas as it passes through the ion block, which may assist the cone gas with keeping the cone orifices clean.

The outer cone 517, inner cone 513, disk 525 and vacuum holding member 531 may each be constructed of a metal, although other suitable materials may be used. In embodiments, at least one of the outer cone 517, inner cone 513 and vacuum holding member 531 may be formed of stainless steel. The disk 525 may comprise nickel. The disk 525 may be a nickel electroformed disk. Hence, the outer cone 517, inner cone 513, disk 525 and the vacuum holding member 531 may be each formed of electrically and/or thermally conductive materials. In use, these components of the ion inlet assembly will become hot due to the ion block heater and also due to heated desolvation gas flowing past the outer cone (as will be described in further detail later on).

The ion source may comprise an API source such as an electrospray ionisation (ESI) ion source, e.g. as shown in FIG. 4, having a nebulising probe 401. An analyte solution (e.g. from an upstream LC separation device) is directed through the inner capillary 402 of the probe to the tip thereof. A nebuliser gas is supplied through a nebulising conduit, that surrounds the inner capillary 402, for nebulising the analyte solution leaving the inner capillary 402 to form a nebulised spray at the end thereof. A desolvation conduit may be provided surrounding the nebulising conduit for supplying desolvation gas to the tip of the probe. A heater 404 may be provided surrounding the desolvation conduit for heating the desolvation gas, e.g. to a temperature of around 600° C. The heated desolvation gas assists evaporation of solvent from the droplets of analyte solution that are sprayed from the inner capillary 402, thus helping to liberate analyte ions.

FIG. 7B shows an exemplary configuration for the gas flow supplies for the mass spectrometer. The spectrometer comprises a gas inlet that is connected to the probe, for supplying the nebuliser gas and/or desolvation gas to the probe. The gas inlet may be connected to a pressurised gas supply, such as a supply of inert gas, e.g. nitrogen. The gas inlet may also, or alternatively, be connected to the cone assembly for supplying the cone gas to the cone assembly. In various embodiments, such as that depicted in FIG. 7B, the same gas inlet is connected to the nebuliser gas conduit, the desolvation gas conduit, and the annular cone gas conduit. A valve may be provided between each of these conduits and the gas inlet, for selectively allowing gas to flow to the conduits when the valve is open and preventing such a gas flow when the valve is closed. A single valve may be provided for controlling the supply to all of the conduits. In these embodiments, gas flow restrictors may be provided between the gas inlet and at least some of the conduits (e.g. the desolvation conduit and/or the annular cone gas conduit) for restricting the flow of gas through these conduits. Alternatively, separate valves may be provided for controlling the supply of gas to the separate conduits.

The ion source probe is positioned in the vicinity of the ion cone assembly that is on the ion block, e.g. in an ion source enclosure mounted over the cone assembly. Accordingly, the flow of heated desolvation gas passed the cone assembly may cause heating of at least the outer cone 517 of the cone assembly. For example, the outer cone 517 may reach a temperature of around 200° C. As described above, the ion block may also be heated, thus contributing to the heating of the cone assembly.

As described above, it may be desirable to remove the outer cone 517, inner cone 513, disk 525 and/or vacuum holding member 531 assembly for cleaning, maintenance, replacement and/or repair. The clamp member 535 may be removed in order to remove the outer cone, and the clamp member may be formed of a plastic, such as PEEK, so that it may be cooler to touch than the outer cone 517. The outer cone 517 may then be slidably removed from the clamp member 535 as described above. However, although the clamp 535 may be relatively cool, there is still a burn risk associated with a user touching the hot outer cone, or other hot components of the cone assembly or ion block.

Conventionally, when a user wishes to access the cone assembly, and particularly an outer cone of an ion inlet assembly, there is no indication of whether the outer cone is at a temperature that is safe to touch. When the user wishes to access the outer cone, the mass spectrometer switches off the entire ion block assembly and the ion source, thus stopping the desolvation, nebuliser and cone gas flows, and the ion source and sample probe heaters. The cone is then be left to cool, resulting in the maintenance taking a relatively long time.

Embodiments of the invention provides means for reducing the burn risk associated with performing maintenance on the ion source or ion inlet assembly such as the cone assembly or disk. According to the embodiments, the spectrometer is configured to actively cool at least some of these components by passing gas over them and/or through the ion inlet assembly.

When the user wishes to perform maintenance on the ion inlet assembly or ion source, the user may select a maintenance mode on a user interface of the spectrometer such that the spectrometer enters a cooling mode. Alternatively, the spectrometer may automatically enter this mode, e.g. if a door to the ion source is opened or if the source enclosure is removed. If the spectrometer comprises an ion block heater and/or a desolvation gas heater, then the spectrometer may be configured such that when it enters the cooling mode it switches off either or both of these heaters. The spectrometer may control the gas valves supplying gas to the probe and/or cone assembly so as to maintain (or start) the gas flow through these components. For example, the spectrometer may maintain (or start) the gas flow through the desolvation conduit and/or nebuliser conduit and/or annular conduit through the cone assembly. The flow of (unheated) gas through the probe and/or cone assembly actively cools the ion inlet assembly. The (unheated) gas may also cool the probe and/or fill the source enclosure and cool the source enclosure. The mass spectrometer may therefore be configured to operate the ion block heater and the desolvation gas heater independently of their respective gas flows.

The mass spectrometer may comprise one or more temperature sensor for monitoring the temperature of the ion block (e.g. cone assembly) and/or probe and/or source enclosure during the cooling mode. Each of the one or more temperature sensor may be, for example, a thermocouple. The temperature sensor may be provided integrally with the ion block, e.g. within the ion block heater so as to sense the temperature of the ion block heater. As the ion block is thermally conductive, the temperature of the cone assembly may be inferred from the sensed temperature of another part of the ion block, such as the ion block heater.

The spectrometer may be configured to monitor the temperature sensed by the temperature sensor to determine when the temperature of the ion block (e.g. the cone assembly temperature) has decreased to a safe temperature for it to be handled (such as 55° C., for example). The determination may be performed by a suitable processor. The mass spectrometer may control a user interface or signalling device to provide an indication to a user of when the ion block (e.g. cone assembly) is too hot to handle and/or has reached a safe temperature to handle. The indication may be provided on a display monitor of a computer or other electronic device. Whilst the cone assembly is being cooled, the spectrometer may display the temperature of the cone assembly on a suitable display (e.g. on a display monitor). However, it is alternatively contemplated that signalling devices such as an audible alert or light may be used to either signal when the cone assembly is too hot to handle and/or safe to handle.

The mass spectrometer is configured to wait until it has determined that the temperature of the cone assembly has fallen to a predetermined temperature designated as a safe temperature (e.g. 55° C.). Upon determination that the temperature of the cone assembly has reached the predetermined temperature, the spectrometer may be configured to turn off the gas flows used for cooling the cone assembly.

Figure 18:
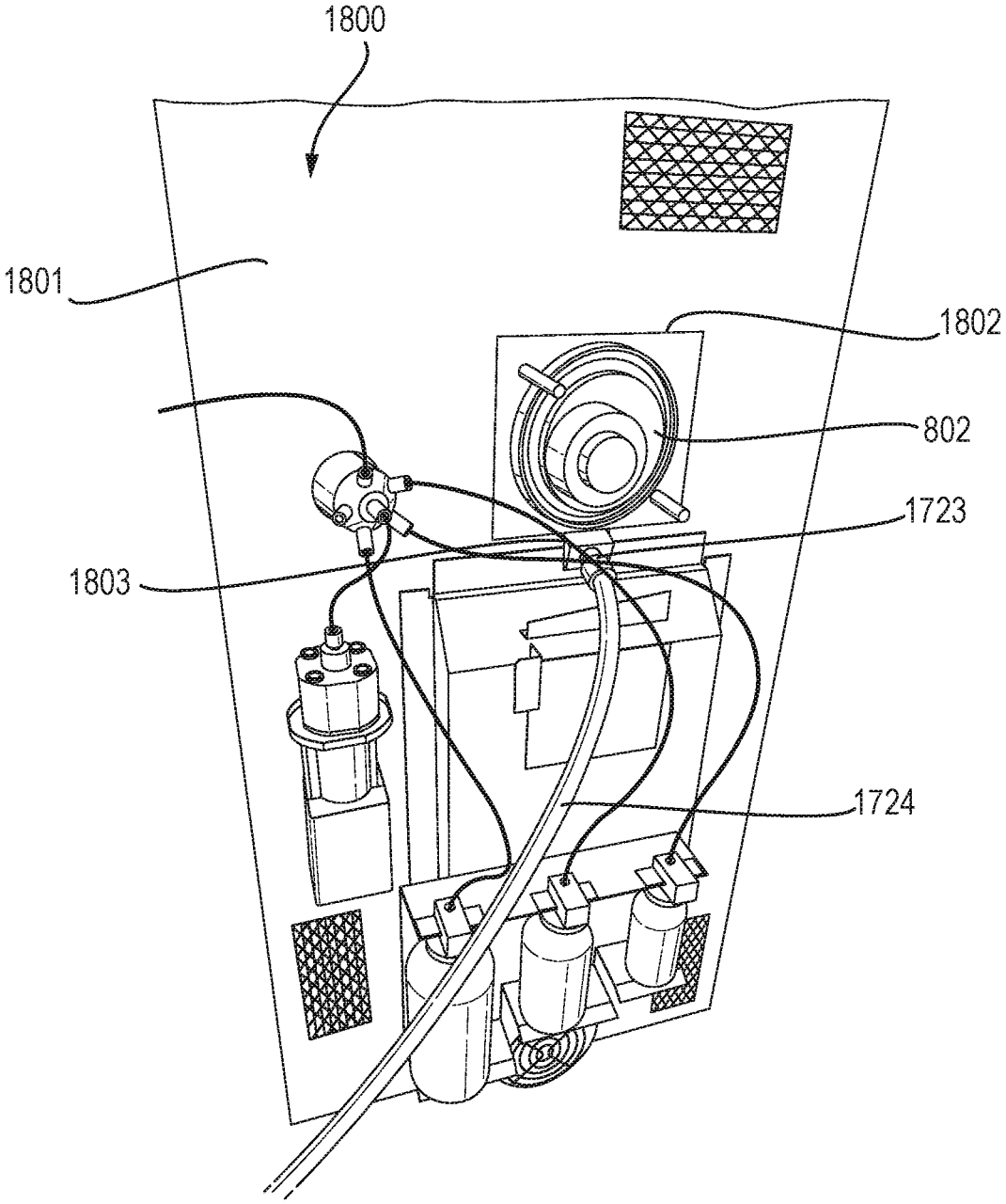
FIG. 18 shows a front view of the spectrometer (with the outer casing removed) from which the tubing for the solvent waste can be seen relative to the ion block.
Figure 19:
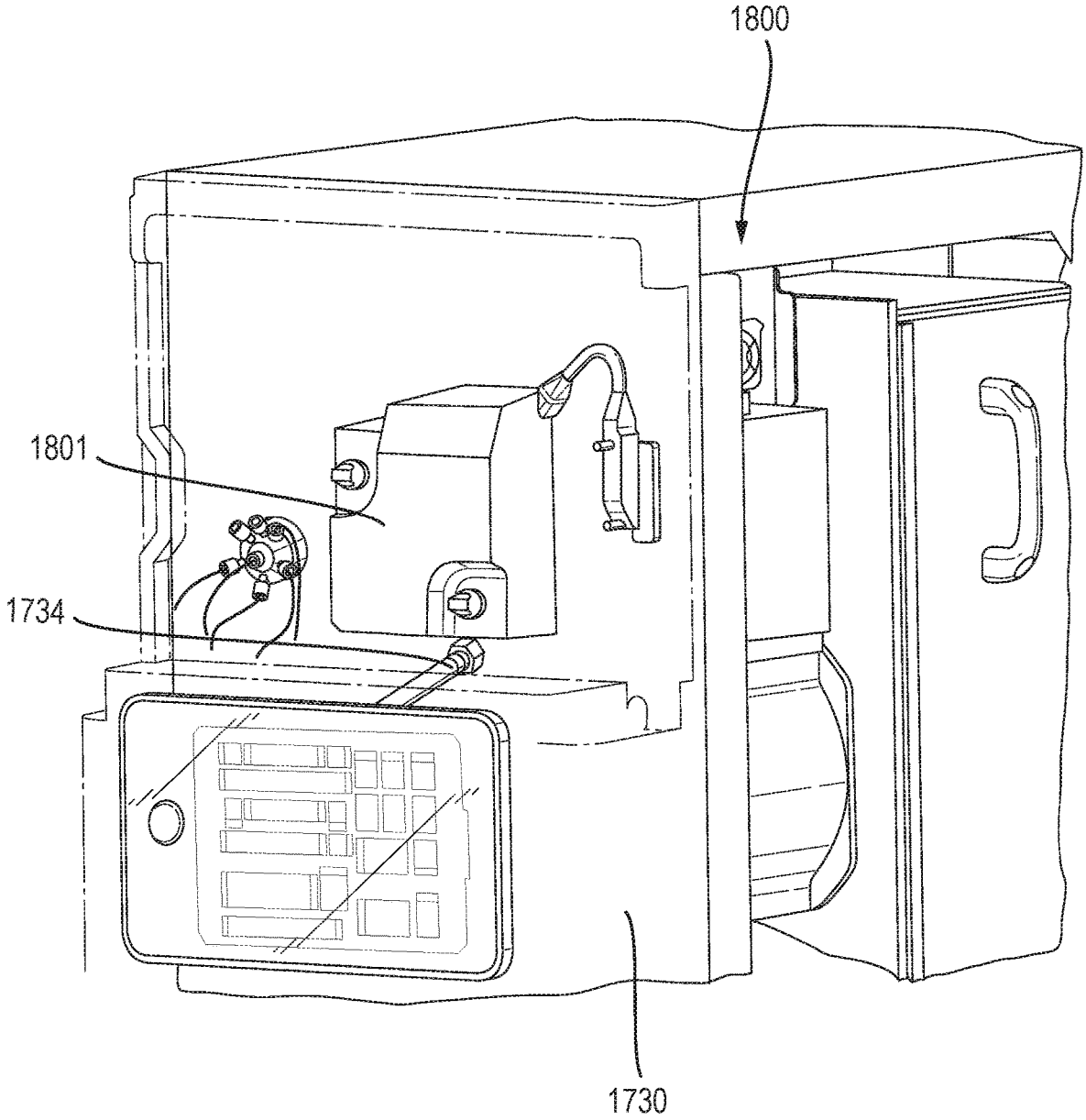
FIG. 19 shows a partial cut-away of the front of the mass spectrometer with the access door to the ion source removed.

The spectrometer comprises an outermost housing, such as that shown in FIGS. 1, 2A and 2B. The outer housing may have a top panel, a front panel, and one or more side panels. The outer housing is adapted to house the components of the mass spectrometer such as the ion block 802, and downstream components such as a first ion guide, a second segmented quadrupole ion guide 803, transfer optics 804, a pusher assembly 805, and a ToF mass analyser 807. The front panel of the outer housing may comprise a door which is openable by a user. The ion source, and the ion block are situated behind the door. For reference. FIG. 19 is a schematic shown without the door, such that the position of the ion source 1801 behind the door can be seen. For reference, FIG. 18 shows the relative orientation of the ion block 802 which would be covered by ion source enclosure, in use.

The door of the housing can be opened to allow access to the ion source, and hence also the ion block 802, e.g. for maintenance purposes. The spectrometer may be provided with a detector that is configured to detect when this door is opened. The detector may comprise, for example, a microswitch although any form of mechanical or electrical detector may be used. The spectrometer may be configured to enter the cooling mode in response to detecting that the user is attempting to access the ion source and/or ion block, e.g. by detecting the opening of the door. This starts the cooling of the components ready for handling. Alternatively, the spectrometer may be configured to pause or stop the cooling mode (i.e. the one or more cooling gas supply) when the door is opened, since the cooling gas may present a suffocation hazard. It is alternatively contemplated that the spectrometer may be provided with a detector that is configured to detect when the ion source enclosure is opened. The detector may comprise, for example, a microswitch although any form of mechanical or electrical detector may be used. The spectrometer may be configured to enter the cooling mode in response to detecting that the user is attempting to access the ion source and/or ion block, e.g. by detecting the opening of the ion source enclosure. This starts the cooling of the components ready for handling. Alternatively, the spectrometer may be configured to pause or stop the cooling mode (i.e. the one or more cooling gas supply) when the ion source enclosure is opened, since the cooling gas may present a suffocation hazard.

Once the user has finished performing maintenance on the components (e.g. cleaning or replacing the inner cone 513 or disk 529), the user will remount these components and the ion source. The user will then close the door. Upon closing of the door, the mass spectrometer may perform a source pressure test. In embodiments, a source pressure test is initiated automatically when the mass spectrometer detects that the door (to the ion source) has been closed. Alternatively, the mass spectrometer may be configured to initiate a source pressure test in response to an indication provided by a user (e.g. an indication provided via an interactive interface, such as a software interface displayed on a display screen of a device associated with the mass spectrometer). The source pressure test is described in more detail elsewhere herein.

Once the source pressure test has been performed, the mass spectrometer may await further instructions from the user before switching the probe gas and/or cone gas, and heaters back on. These may be switched on in response to an indication provided by the user that the ion block (or cone assembly) maintenance has been completed. The indication may be received from a suitable input device, such as a software interface.

After turning on the gas and heaters, the mass spectrometer will wait for the source temperature to return to a normal operational temperature for mass analysis before advising the user that they may proceed with operating the mass spectrometer for mass analysis. Hence, the mass spectrometer may monitor the temperature of the ion block (e.g. by means of the temperature sensor described above), as the ion block is heated (e.g. by the ion block heater and by the heated desolvation gas). The mass spectrometer may be configured to determine that the ion block has reached a predetermined temperature (which corresponds to a normal operational temperature). Upon determining that the ion block temperature has reached the predetermined temperature, the mass spectrometer may be configured to provide an indication to a user.

It will be appreciated that the mass spectrometer may be configured to run and/or interact with appropriate software for performing any of the above steps, as appropriate. In an embodiment, the software provides an interactive interface on an appropriate display (e.g. a monitor display) for providing the above described indications to the user. The software may be adapted to receive the above described indications from a user by means of any suitable input device (e.g. a keyboard and/or mouse). The software interface may comprise a maintenance section, which a user can select to indicate that they wish to perform cone maintenance.

In conventional mass spectrometers a solvent is used to convey the analyte into an upstream end of the mass spectrometer. However, it is not desired to analyse the solvent itself and so waste solvent must be removed from the spectrometer. For example, waste solvent may arise just after entry into the mass spectrometer ion source, e.g. at an atmospheric pressure ion source such as APCI, ESI, DESI sources etc. Conventionally, this solvent waste is routed from the upstream end of the mass spectrometer, through the instrument and out of the rear of the instrument, before being directed into an appropriate storage vessel such as a waste bottle.

The inventors have recognised that such a configuration of the solvent waste route can be problematic from safety and serviceability perspectives. For instance, if the conduit carrying the solvent waste leaks, then the solvent is relatively likely to come into contact with electrical components inside the mass spectrometer, potentially presenting fire and/or electrocution hazards. Moreover, as the solvent waste conduit travels a significant distance through the spectrometer, the risk of there being a leak inside the instrument is relatively high. Also, such a leak may not be detected until it has become quite substantial, since it will be hidden inside the instrument.

The embodiments of the present invention provide arrangements in which solvent waste is routed towards an upstream end of the mass spectrometer, avoiding passing most of the components which are downstream of the ion source.

Referring to FIG. 8, some of the principal components of a mass spectrometer assembly 800 in accordance with an embodiment are shown. The mass spectrometer assembly 800 generally transmits ions from an upstream end to a downstream end. A pumping block 802 is located proximal the upstream end of the mass spectrometer. The pumping block 802 is adapted to receive ions from an atmospheric pressure ion source (not shown). An ion source enclosure (not shown) is configured to surround the ion source and the pumping block 802, and is maintained at approximately atmospheric pressure. A first ion guide 813 is positioned downstream of the pumping block. The ion guide 813 is configured to transmit ions away from the pumping block 802 in a longitudinal direction towards the downstream end of the mass spectrometer. A second ion guide 803, transfer lens or transfer optics 804, pusher assembly 805, ToF stack 806 and detector 811 may also be provided downstream of the pumping block.

The downstream components may be provided in one or more vacuum regions or vacuum chambers, which may each be defined by a vacuum housing. FIG. 8 shows a partially cut-away view of the vacuum housing(s) which contain downstream components (such as an ion guide, segmented quadrupole 803, transfer lens or transfer optics 804, pusher assembly 805, ToF stack 806 and detector 811). The vacuum housing(s) may be constructed of metal.

Figure 17:
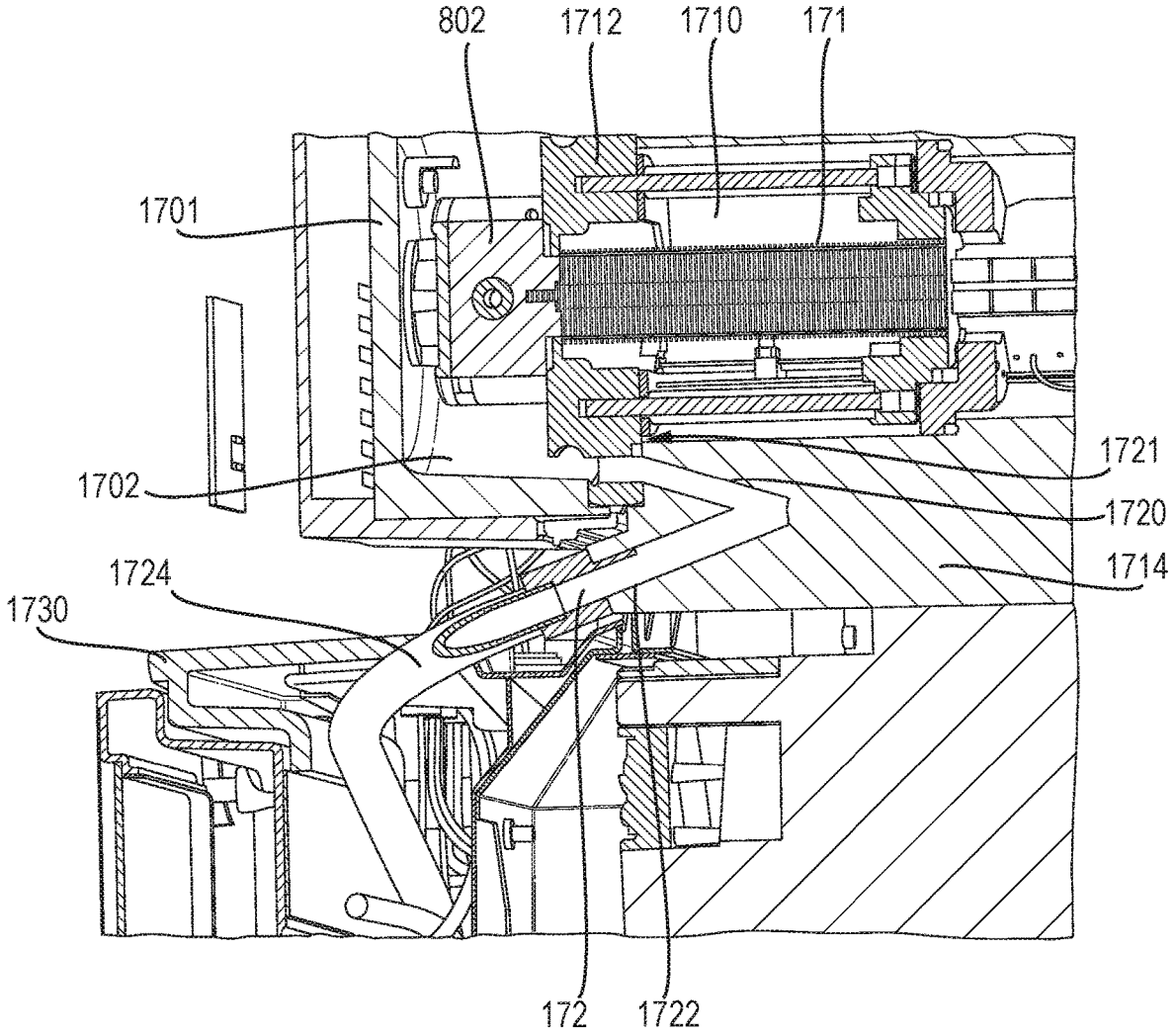
FIG. 17 shows a cross-sectional side view of the portion of an embodiment showing the ion source enclosure and solvent waste conduit.

FIG. 17 shows a cross section of the mass spectrometer near the upstream end of the mass spectrometer. As shown in FIG. 17, the mass spectrometer comprises an ion block 802. The mass spectrometer is configured to be fitted with an ion source proximal to the ion block. The ion source may be configured to receive a solution of analyte carried in solvent and to desolvate the solution, thereby producing solvent waste. The ion source may be an atmospheric pressure ionisation (API) ion source, for example an ESI ion source. The ion source and ion block 802 may be surrounded by an ion source enclosure 1701, which may prevent a user from touching the ion source or ion block 802 during use. Solvent waste from the ion source may be captured within the source enclosure 1701, so that a user is not exposed to the solvent waste when operating the mass spectrometer.

The mass spectrometer is configured to direct solvent waste out of the source enclosure, such that the solvent waste exits the mass spectrometer proximal to an upstream end of the mass spectrometer. FIG. 17 shows an embodiment for the capture and directing of solvent waste out of the source enclosure.

The ion block is positioned adjacent to a vacuum housing 1710. The vacuum housing 1710 is positioned downstream relative to the ion block 802. The ion block 802 is configured to direct analyte ions towards the vacuum housing, and into the first ion guide 1711 contained within the vacuum housing.

As shown in FIG. 17, there is provided a conduit 1720 for directing solvent waste out of the source enclosure. The conduit 1720 has an entrance opening 1721 in the ion source enclosure, which is capable of receiving waste solvent. During use, the ion source is configured to desolvate a solution containing analyte ions. This involves evaporating the solvent using a suitable heat source (such as a heated desolvation gas). The evaporated solvent may condense against the internal walls of the source enclosure and drip towards a base of the source enclosure. The entrance opening 1721 of the solvent waste conduit 1720 may be adjacent a lowermost internal surface 1702 of the ion source enclosure 1701. In this manner, the solvent waste may drain out of the ion source enclosure by means of gravity. As shown in FIG. 17, the entrance opening 1721 of the solvent waste conduit 1720 may comprise an aperture at a rearmost (downstream) end of the ion source enclosure 1701.

The ion block 802 may be secured to a downstream ion guide 1711 within the vacuum housing by means of a connector 1712 (the connector 1712 may also be known as a "pumping block"). A rear (downstream) wall of the source enclosure 1701 may be defined, at least partially, by the connector 1712. The connector 1712 may radially surround a first end of the ion guide 1711, the first end being adapted to receive ions from the ion block 802. The entrance opening (aperture) 1721 of the solvent waste conduit may be provided in the connector 1712 at a location that is radially outwards from the ion guide 1711, so that solvent waste is not transferred into the ion guide. The connector 1712 may be formed of a thermoplastic such as PEEK.

The solvent waste conduit 1720 proceeds from the entrance opening 1720 and passes into a first side 1713 of the vacuum housing 1710, within a wall 1714 of the vacuum housing, and back out of the wall 1714 of the vacuum housing. The conduit may exit the wall 1714 of the vacuum housing at an outlet aperture 1722. The portion of the solvent waste conduit within the wall of the vacuum housing may be referred to as the "first portion" of the solvent waste conduit. The first portion of the solvent waste conduit 1720 may comprise tubing or a suitable hollow structure within the wall 1714 of the vacuum housing. Alternatively, as shown in FIG. 17, the first portion of the solvent waste conduit 1720 may comprise a bore or other channel within the wall 1714 of the vacuum housing.

Since the entrance opening 1721 is positioned towards the rear of the source enclosure 1701, the entrance opening 1721 receives waste solvent flowing in the direction of the rear (downstream) end of the mass spectrometer. Between the entrance opening 1721 and the outlet aperture 1722, the solvent waste conduit first extends in generally in a direction towards the rear (downstream) end of the mass spectrometer, and then in a direction towards the front (upstream) end of the mass spectrometer (in order to direct solvent waste back towards the upstream end of the mass spectrometer).

The first section of the conduit 1720 may not extend a substantial distance towards the downstream end of the mass spectrometer. For instance, the conduit 1720 may not extend past the first vacuum housing 1711. This can help to reduce problems in the case of a leak of waste solvent.

The extent of the first section of the conduit 1720 can be described with respect a length LT of a transfer region. The transfer region corresponds to the region upstream of the (time of flight) mass analyser 806, which is configured to transfer charged analyte ions from the source enclosure 1710 to the mass analyser 806. In particular, the length LT can be defined as the longitudinal distance between a rear end of the source enclosure and an entrance to the mass analyser (or more particularly to an entrance of the pusher assembly 805). In embodiments, the first section of the conduit 1720 extends over less than 50% of the length LT, optionally less than 20%, optionally less than 10%, optionally less than 5%.

A connector 1723 is fitted at (or proximal to) the outlet aperture 1722 of the first section of conduit 1720. The connector 1723 connects the outlet aperture 1722 to a second portion of the conduit 1724. The connector 1723 may be formed of metal, and may have a central bore through which solvent waste may flow. The second portion of the conduit may comprise tubing 1724 which is optionally flexible, and optionally transparent. The second portion of the conduit may extend towards or proximal the upstream (front) end of the mass spectrometer relative to the ion block 802. The tubing 1724 can also be see in FIGS. 18 and 19.

As shown in FIGS. 18 and 19, the mass spectrometer may be provided with an inner casing 1800 which contains various components of the mass spectrometer, such as the ion guide 1711, segmented quadrupole 803, transfer optics 804, pusher assembly 805, time of flight stack 806 and detector 811. The inner casing 1800 has a front panel 1801 at the front (upstream) end of the mass spectrometer. The ion block 802 is positioned in front of the front panel 1801 (as shown in FIG. 18), and the ion source enclosure 1701 is fitted over the ion block 802 (and hence is also in front of the front panel 1801). As shown in FIGS. 17, 18 and 19, the connector 1723 extends in front of the front panel 1801, and the tubing 1724 connects to the connector 1723 in front of the front panel 1801.

The front panel 1801 has a first aperture 1802 which through which the ion block 802 extends. There is a second aperture 1803 in the front panel 1801 below the first aperture 1801 (i.e. below the pumping block 802). The second aperture 1803 allows waste solvent to exit through the front panel 1801. In an embodiment, the first and second apertures 1802, 1803 are joined to form a single aperture. The connector 1723 extends through the second aperture 1803. The tubing 1724 joins to the connector in front of the front panel 1801. Hence, the solvent waste tubing 1724 is located externally of the inner casing 1800. The connector 1723 is positioned to be below the ion source enclosure 1701.

Figure 20:
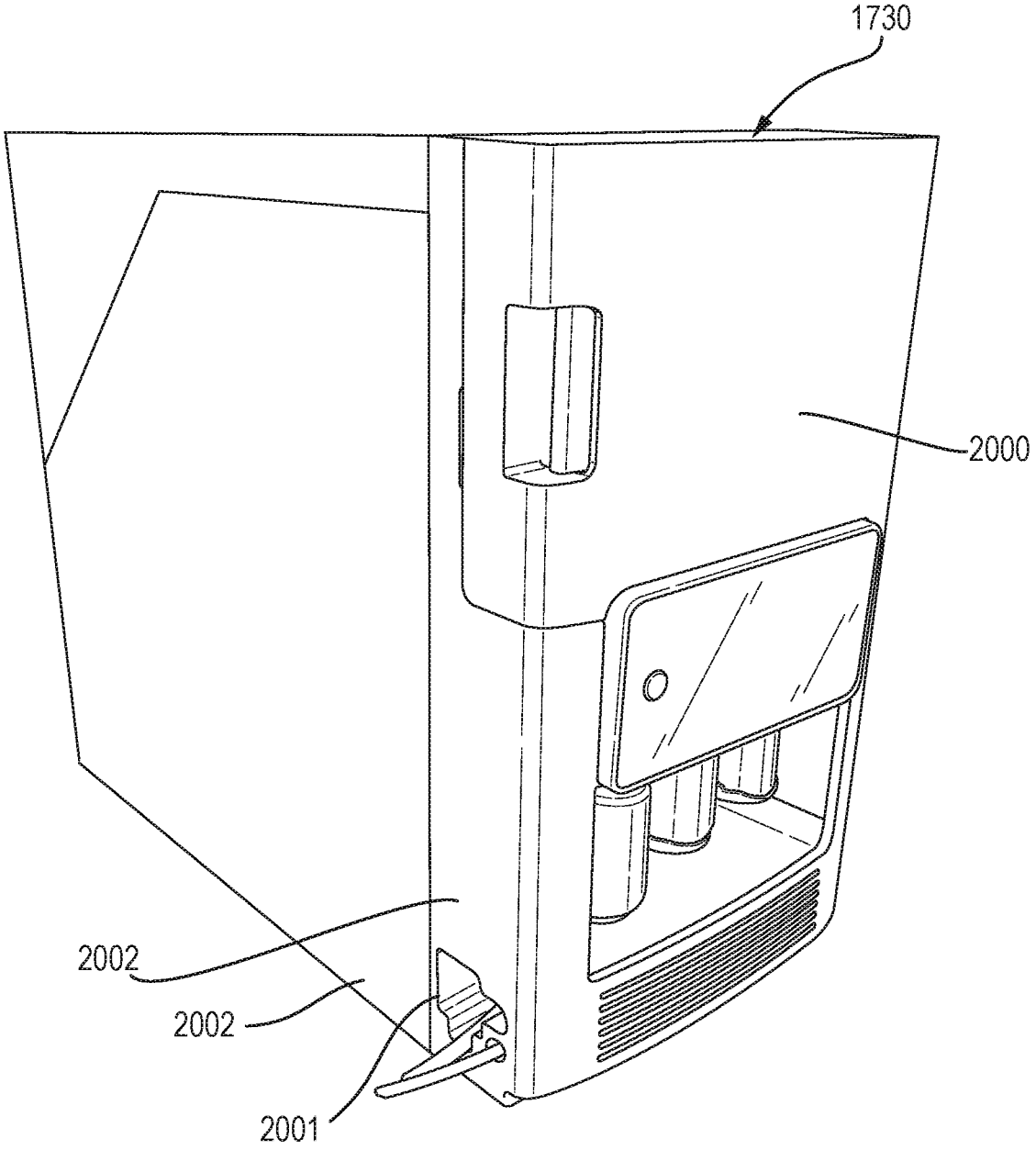
FIG. 20 shows a perspective front view of the mass spectrometer, showing how the solvent waste tubing exits the outermost casing of the mass spectrometer.

As shown best in FIG. 20, the mass spectrometer comprises an outermost casing 1730. The outermost casing 1730 surrounds the inner casing 1800. The outermost casing may be formed of an opaque plastic to provide a cosmetic outer covering for the mass spectrometer. As shown in FIGS. 17, 19 and 20, the tubing 1724 has a portion that travels inside of the outermost casing 1730 (passing between the inner casing 1800 and outermost casing 1730). As shown in FIG. 20, the tubing 1724 may exit the outermost casing 1730 at an aperture 2001 in the outermost casing. The aperture 2001 may be positioned towards the front end 2000 of the outermost casing, and towards the base 2005. The aperture 2001 may be positioned on a side 2002 of the outermost casing 1730 which is orthogonal to the front end 2000 of the outermost casing. Hence, it can be seen that the aperture 2001 through which the tubing 1734 exits the outermost casing 1730 is orthogonal to the front panel 1801 of the inner casing, and also orthogonal to the first side 1713 of the vacuum housing 1710.

The tubing 1724 is directed such that solvent waste may flow through the tubing and out of the outermost cover 1730 under the influence of gravity. Hence it can be seen that the tubing 1724 does not pass inside of the inner casing 1800 or proximal to any of the sensitive components of the assembly 900 (such as the ion guide 813, segmented quadrupole 803 and the other downstream components described above).

In embodiments, solvent waste is initially directed away from the source enclosure 1701 through a first portion of conduit 1720. In the first portion of the conduit 1720 the solvent waste is directed firstly in the downstream direction of the mass spectrometer and then routed towards the front (upstream) end of the mass spectrometer. The solvent waste then passes through tubing 1724 which directs the solvent waste out of the mass spectrometer by passing through an aperture 2001 proximal to the front end 2000 and base 2005 of the outermost casing 1730 of the mass spectrometer.

The tubing may terminate in a distal end at which the exit opening is located, which can be directed into a suitable waste containment vessel.

With reference to FIG. 8, the mass spectrometer may comprise an ion block 802 which separates the ion source from the downstream vacuum chambers of the spectrometer, which are maintained at pressures that are lower than that in which the ion source is located. The vacuum chambers may house at least one of a first ion guide 301, a second ion guide 803, transfer optics 804, a pusher assembly 805, and a ToF stack 807 (such as those described above). Other downstream components may additionally or alternatively be provided, such as a mass separation device. The vacuum chambers may be differentially pumped regions (as described above).

The mass spectrometer may be configured to perform an ion source pressure test to determine if the ion source is capable of operating normally. The spectrometer may be configured to initiate the source pressure test automatically in response to one or more triggers, or the source pressure test may be initiated manually at a user interface of the spectrometer by an operator.

Exemplary situations in which a source pressure test may be performed include: after fitting the ion source to the spectrometer, after replacing the ion source, after maintenance of the ion source, or after maintenance of the ion block or cone assembly. For example, it may be desired to run the source pressure test to determine if the ion source has been fitted correctly, as if it has not it may leak.

In embodiments, the mass spectrometer is configured to automatically perform the source pressure test upon detecting certain events. For example, the spectrometer may comprise a door for accessing the ion source and the spectrometer may be configured to detect if this door has been opened and/or closed and run the pressure test in response thereto. Additionally, or alternatively, the spectrometer may be configured to run the pressure test if part of the ion source has been moved.

Referring to FIG. 20, the mass spectrometer has an outer housing or casing 1730. The front side of the outer housing may comprise a source access door 2000 that is openable by a user in order to gain access to the ion source 1801 (shown in FIG. 19) and ion block 802, which are housed within the housing.

FIG. 19 shows a schematic of the spectrometer with the source access door 2000 removed (and the side panel removed). Although the source access door is shown as being completely removed, for clarity, the door may be hingedly attached to the main body of the spectrometer so that it is openable and closable without being completely detached therefrom. Opening the source access door 2000 reveals an ion source enclosure 1801 that is mounted over the ion block 802 (see FIG. 8). As described above, the ion source may be an API ion source, such as an ESI ion source, and hence has a probe arranged inside the source enclosure for delivering an analyte solution into the ion block 802. The probe also delivers gas, as described in relation to FIG. 4, into the source enclosure in order to assist in nebulising the analyte solution and/or desolvating solvent from the analyte solution.

FIG. 17 shows a cross-sectional side view of the portion of the spectrometer at which the ion block 802 is located. As can be seen more clearly from this Figure, the source enclosure 1701 is mounted to the pumping block 1714, over the ion block 802. The ion source probe is located in the source housing so as to generate analyte ions inside the source enclosure 1701, which are then transmitted into the ion block 802 through the ion inlet or cone assembly. The source enclosure 1701 may have an inner metal surface 1702 that becomes hot in use, and an outer plastic casing for protecting the user from being burned. The spectrometer also has a solvent waste conduit 1720 for removing the waste solvent from the source enclosure, as described elsewhere herein.

As described above, it may be desirable to access the ion source and/or cone assembly of the ion block 802, e.g. for maintenance or to replace various components. In order to do this, the source access door 2000 in the outer casing is first opened. The source enclosure 1702 is then removed from over the ion block 802, e.g. to replace the probe therein, and/or to access the cone assembly on the ion block. After the desired maintenance or replacements have been performed, the source enclosure is remounted over the cone assembly on the ion block and the source access door is closed. However, the ion source may have been reassembled incorrectly, potentially leasing to problems such as leakage from the ion source. In order to diagnose this, the spectrometer may be configured to perform a source pressure test.

The spectrometer may be configured to automatically perform the source pressure test. For example, the spectrometer may have a door sensor for detecting when the source access door 2000 is closed, and the spectrometer may be configured to perform the source pressure test in response to detecting that the source access door has been closed. The door sensor may be a switch, such as a mechanical or electronic switch. For example, the sensor may be a microswitch. Alternatively, the spectrometer may have a source enclosure sensor for detecting when the source enclosure is mounted over the ion block, and the spectrometer may be configured to perform the source pressure test in response to detecting that this mounting has occurred. The sensor may be a switch, such as a mechanical or electronic switch (e.g. a microswitch). The spectrometer may comprise both the door sensor and a source enclosure sensor, and may be configured to run the source pressure test after both sensors indicate that both the source enclosure has been mounted and the source access door has been closed.

FIG. 7B shows details of the gas handling system for the mass spectrometer and FIG. 7D shows an embodiment of the ion source pressure test.

Referring to FIG. 7D, the pressure test may start by disabling the software control of the fluidics system. This may stop the analyte solution from being delivered into the ion source enclosure. For example, any pumps for delivering fluid into the source enclosure via the probe may be stopped. A divert valve may be set to a divert position so as to direct the analyte into a waste receptacle, rather than to the probe in the source enclosure. The ion source gas flows to the probe for nebulising and/or desolvating the analyte solution may also be at least partially stopped, by disabling the software control for the API gas.

The spectrometer then performs a first pressure check in which the pressure of the gas supply to the ion source (e.g. for the nebulising and/or desolvating) is checked. This may be performed by checking a pressure sensor associated with the gas supply (e.g. sensor 722 in FIG. 7B). If the pressure is below a threshold value (e.g. 4 Bar) for a predetermined time (e.g. at least 1 s) then it is determined that the gas supply pressure is too low and the spectrometer may indicate to the user that the pressure test has been failed. The gas supply to the probe may then remain closed, or may be fully closed. In contrast, if the pressure is at or above the threshold value (e.g. 4 Bar) for a predetermined time (e.g. at least 1 s) then it is determined that the gas supply pressure is sufficient and the spectrometer may open a gas supply valve so that the gas supply is able to supply gas from the probe into the source enclosure. This may be performed, for example, by opening the API gas solenoid valve in FIG. 7B.

If the first pressure check is successful then the spectrometer moves on to a second pressure check for checking the pressure inside the source enclosure, or in the exhaust, to determine if an exhaust from the source enclosure is blocked or not. For example, the exhaust may be the solvent waste conduit described elsewhere herein. The spectrometer may comprise an exhaust valve for selectively opening and closing the exhaust. For this pressure check, the spectrometer opens the exhaust valve. If the pressure is determined to be above a first threshold value (e.g. at or above 100 mBar) then it may immediately be considered to have been caused by the exhaust being blocked, since it indicates that the gas is unable to escape from the source enclosure through the exhaust at a sufficiently high rate. The spectrometer thus determines that the pressure test has been failed and may immediately indicate this to the user via a user interface, optionally along with a message indicating that there is a problem with the exhaust. Additionally, or alternatively, the spectrometer may shut off the gas supply to the source enclosure.

In contrast, if the second pressure check determines that the pressure is below the first threshold value (e.g. 100 mBar) and above a second threshold value (e.g. 18 mBar), then there is considered to potentially be a problem with the exhaust being partially blocked, since it indicates that the gas is unable to escape from the source enclosure through the exhaust at a desired rate. The spectrometer may indicate to the user, via the user interface, that there is a potential problem with the exhaust. However, rather than immediately determining that the pressure test has been failed and shutting off the gas supply to the source enclosure, the spectrometer may wait and continue to monitor the pressure for a predetermined period of time (e.g. ≥10 s, ≥20 s, or ≥30 s). If the pressure does not fall below the second threshold value within the predetermined period of time, then the spectrometer determines that the pressure test has been failed and may indicate this to the user via a user interface, optionally along with a message indicating that there is a problem with the exhaust. Additionally, or alternatively, the spectrometer may shut off the gas supply to the source enclosure. In contrast, if the pressure does fall below the second threshold value within the predetermined period of time, then the second pressure check is considered to be successful and the spectrometer moves on to a third pressure check.

As the spectrometer waits up until the end of the predetermined period of time before considering the pressure test to have been failed, this avoids false failures of the pressure test, e.g. due to partial blocking of the exhaust by the presence of residual fluid (such as waste solvent) from previous ion source operation which may still be draining out of the exhaust. The predetermined period of time is set such that at the end of this period it would be expected that all such fluid would have drained out of the exhaust, and that therefore a high pressure at the end of this period is indicative of a genuine problem with the exhaust, such as being blocked.

If it is determined that the pressure is below the second threshold value (e.g. 18 mBar) at the start of the second pressure check, then the second pressure check is considered to be successful and the spectrometer moves on to a third pressure check, i.e. without waiting for the predetermined period. Although the second pressure check described above has a check to determine a partially blocked exhaust, this check may be omitted and the second pressure check may instead simply have a threshold pressure above which the exhaust is considered blocked and below which it is not.

If the second pressure check is successful then the spectrometer closes the exhaust valve, such that the gas should not be able to escape from the source enclosure, and moves on to the third pressure check for checking whether there is a leak from the source enclosure, e.g. due to poor sealing of the source enclosure. If the third pressure check determines that the pressure is below a third threshold value (e.g. 200 mBar) then it is determined that there is potentially an unintended leak from the source enclosure. The spectrometer may continue to monitor the pressure, and may indicate to the user via the user interface that there is a potential (unintended) leak from the source enclosure. It will be appreciated that the gas pressure begins to build up in the source enclosure after the exhaust valve has been closed. Therefore, the spectrometer may suppress the leak warning message from being displayed at the user interface for a predetermined period of time (e.g. ≥1, ≥2, ≥3, ≥4 or ≥5 seconds) after the exhaust has been closed, or may not perform the first pressure check until such a predetermined period of time (e.g. ≥1, ≥2, ≥3, ≥4 or ≥5 seconds) expires.

The spectrometer may continue to monitor the pressure and if the pressure remains below the third threshold value (e.g. 200 mBar) for a second predetermined time (e.g. at least 10, 20 or 30 seconds) after the exhaust valve has been closed then it is determined that there is a leak from the source enclosure. The use of the second predetermined time delay helps prevent false failures of the test, e.g. due to trapped liquid being present in the system.

The spectrometer may indicate this to the user via the user interface and that the pressure test has been failed. The gas supply to the probe may then be closed.

In contrast, if the third pressure check determines that the pressure is at or above the third threshold value (e.g. 200 mBar), then the third pressure check is considered to be successful. The spectrometer may then close the gas supply to the probe and open the exhaust valve such that the ion source is ready for use in ionising ions. The spectrometer may then indicate to the user, via the user interface, that the source pressure test has been passed. The spectrometer may then prepare the various components of the spectrometer for mass analysis of the analyte solution, for example, such as resetting a pressure trip switch for the exhaust, re-enabling the software control of the fluidics, as re-enabling the software control of the gas to the probe.

It is contemplated that the source pressure test may be over-ridden in certain circumstances. Accordingly, a user may be permitted to continue to use an instrument where they have assessed any potential risk as being acceptable. If the user is permitted to continue using the instrument then the source pressure test status message may still be displayed in order to show the original failure. As a result, a user may be reminded of the continuing failed status so that the user may continually re-evaluate any potential risk.

According to the embodiments herein, in the event of a source pressure test failure, the divert valve position may be kept in the divert position until the source pressure test is either passed or the test is over-ridden.

The embodiments enable the spectrometer to determine when the ion source is not fit for normal operation, e.g. due to a low gas supply pressure, a blocked exhaust, or a gas leak due to poor gas sealing. For example, the failure of the pressure test may indicate that the seal between the source enclosure and ion block is insufficient, or that the seal in the source enclosure around the probe is insufficient. Such embodiments are particularly advantageous when the mass spectrometer is configured to receive different types of ion sources and/or ion source probes, e.g. as it is not necessary to provide a detector direction on the ion source or probe for detecting when the integrity of the source enclosure may have been compromised.

Although the present invention has been described with reference to preferred embodiments, it will be understood by those skilled in the art that various changes in form and detail may be made without departing from the scope of the invention as set forth in the accompanying claims.

The invention claimed is:

1. A mass spectrometer comprising:

a vacuum chamber;

an ion inlet assembly for transmitting analyte ions into the vacuum chamber; and one or more temperature sensor for monitoring a temperature of the ion inlet assembly and/or an ion block in which the ion inlet assembly is mounted;

a gas inlet for receiving pressurised gas from a pressurised gas supply;

one or more valve for selectively supplying said pressurised gas from the gas inlet to said ion inlet assembly so as to provide one or more gas flow to the ion inlet assembly for actively cooling the ion inlet assembly in a cooling mode; and a processor configured to:

monitor the temperature sensed by the one or more temperature sensor during the cooling mode;

determine when the temperature sensed by the one or more temperature sensor has decreased to a predetermined temperature; and control the one or more valve so as to end the one or more gas flow to the ion inlet assembly, and to thereby end the cooling mode, when the temperature sensed by the one or more temperature sensor has decreased to the predetermined temperature.

2. The spectrometer of claim 1, comprising an ion source and an ion source heater for heating the ion source, and/or an ion block in which the ion inlet assembly is mounted and an ion block heater for heating the ion block, wherein the processor is configured to switch off, or reduce electrical power to, the ion source heater and/or ion block heater, in the cooling mode.

3. The spectrometer of claim 1, wherein the processor is configured to end the cooling mode by switching off said one or more gas flow to the ion inlet assembly for actively cooling the ion inlet assembly.

4. The spectrometer of claim 1, wherein the ion inlet assembly comprises an inner cone having an inner aperture therein for receiving and transmitting the analyte ions to the vacuum chamber, and an outer cone surrounding the inner cone and having an outer aperture therein; wherein said one or more gas flow is provided between said inner and outer cones and through said outer aperture, in said cooling mode, for cooling the inner and outer cones.

5. The spectrometer of claim 1, comprising an ion source including a probe having at least one gas conduit for supplying one of said one or more gas flow to the ion inlet assembly, in said cooling mode, for cooling the ion inlet assembly.

6. The spectrometer of claim 5, wherein the probe comprises a liquid conduit for supplying liquid towards a tip of the probe, and a nebuliser gas conduit for supplying a nebulising gas to the tip of the probe for nebulising the liquid; and wherein the one or more valve is configured to supply one of said one or more gas flows through said nebuliser gas conduit, in said cooling mode, for cooling said ion inlet assembly.

7. The spectrometer of claim 5, wherein the probe further comprises a desolvation gas conduit for supplying a desolvation gas to the tip of the probe for desolvating the liquid and a desolvation gas heater for heating the desolvation gas and/or desolvation gas conduit; wherein the processor is configured to switch off or turn down the desolvation gas heater and supply one of said one or more gas flows through said desolvation gas conduit for cooling said ion inlet assembly, in said cooling mode.

8. The spectrometer of claim 5, comprising an ion source enclosure mounted over the ion inlet assembly such that the probe tip is between the ion source enclosure and the ion inlet assembly.

9. The spectrometer of claim 5, wherein the processor is configured to control said one or more gas flow, in said cooling mode, for actively cooling the probe and/or ion source enclosure.

10. The spectrometer of claim 1, comprising said pressurised gas supply.

11. The spectrometer of claim 1, wherein the processor is configured to control a user interface or signalling device to signal when the temperature sensed by the one or more temperature sensor has decreased to the predetermined temperature and/or remains above the predetermined temperature.

12. The spectrometer of claim 1, comprising an ion source, an access door for accessing the ion source, and a detector for detecting when the door is opened; wherein the processor is configured to turn off said one or more gas flow in response to the detector detecting that the door has been opened.

13. A method comprising:

providing a mass spectrometer as claimed claim 1; and operating the spectrometer in the cooling mode in which it supplies the one or more gas flow to the ion inlet assembly so as to cool the ion inlet assembly.

14. The method of claim 13, comprising dismantling the ion inlet assembly after it has been cooled by the one or more gas flow.

15. The spectrometer of claim 1, wherein the ion inlet assembly defines an aperture in the wall of the vacuum chamber for ions to pass through.

* * * * *